US006996358B2

(12) United States Patent
Ayaki et al.

(10) Patent No.: US 6,996,358 B2
(45) Date of Patent: Feb. 7, 2006

(54) TONER KIT, TONER, METHOD FOR FORMING AN IMAGE, AND IMAGE FORMING APPARATUS

(75) Inventors: Yasukazu Ayaki, Kanagawa (JP); Takeshi Ikeda, Shizuoka (JP); Yukio Nagase, Shizuoka (JP); Nobuyuki Itoh, Shizuoka (JP); Isami Itoh, Shizuoka (JP); Tomohito Ishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 10/441,165

(22) Filed: May 20, 2003

(65) Prior Publication Data

US 2004/0013958 A1 Jan. 22, 2004

(30) Foreign Application Priority Data

| | | |
|---|---|---|
| May 20, 2002 | (JP) | 2002-144250 |
| Aug. 9, 2002 | (JP) | 2002-232667 |
| Aug. 9, 2002 | (JP) | 2002-232668 |
| Aug. 9, 2002 | (JP) | 2002-233858 |
| Aug. 9, 2002 | (JP) | 2002-233859 |

(51) Int. Cl.
*G03G 15/01* (2006.01)

(52) U.S. Cl. ..... 399/223; 430/45; 430/107.1

(58) Field of Classification Search ..... 399/49, 399/222, 223, 231; 430/45, 107.1, 54, 97, 430/120, 126

See application file for complete search history.

(56) References Cited

U.S. PATENT DOCUMENTS

| | | | | | |
|---|---|---|---|---|---|
| 6,013,403 | A | * | 1/2000 | Ichikawa | 430/97 |
| 6,057,866 | A | * | 5/2000 | Haneda et al. | 347/118 |
| 6,221,548 | B1 | | 4/2001 | Shiba et al. | 430/106 |
| 6,327,450 | B1 | | 12/2001 | Ito | 399/227 |
| 6,498,910 | B2 | * | 12/2002 | Haneda | 399/51 |
| 2001/0028805 | A1 | | 10/2001 | Haneda | 399/51 |

FOREIGN PATENT DOCUMENTS

| | | | |
|---|---|---|---|
| JP | 2000/347476 | | 12/2000 |
| JP | 2002-72572 | * | 3/2002 |

* cited by examiner

*Primary Examiner*—Hoan Tran
(74) *Attorney, Agent, or Firm*—Fitzpatrick, Cella, Harper & Scinto

(57) ABSTRACT

A color image forming apparatus forms an image using a deep toner and a pale toner at least for one color such that the pale toner is used to form an image in a high lightness area, and the pale toner and the deep toner are used in combination to form the image in a half tone area. A toner kit has a deep toner and a pale toner which are separated from each other. A method for forming an image uses the color image forming apparatus, the toner kit, and the deep toner and the pale toner. A high quality image can be formed while inhibiting graininess and roughness over a broad image area.

123 Claims, 36 Drawing Sheets

TONER KIT, TONER, METHOD FOR FORMING AN IMAGE, AND IMAGE FORMING APPARATUS

This application claims the right of priority under 35 U.S.C. § 119 based on Japanese Patent Application No.JP 2002-144250, JP 2002-232668, JP 2002-232667, JP 2002-233859, and JP 2002-233858 which are hereby incorporated by reference herein in their entirety as if fully set forth herein.

BACKGROUND OF THE INVENTION

1. Field of the Invention

The present invention relates to a toner kit for developing an electrostatic image or a toner kit for forming a toner image in accordance with a method for forming an image using a toner-jet system in a method for forming an image such as electrophotography or electrostatic printing. In particular, the present invention relates to a toner kit that comprises a toner to be used in a fixation system in which a toner image is fixed on a transfer material such as a print sheet under heat and pressure. Furthermore, the present invention relates to a method for forming an image of electrophotographic type method for forming an image to be used in a copying machine, a printer, a facsimile machine, a digital-proofing device, etc. and an image forming apparatus of electrophotographic type to which the method is applied 2. Description of the Related Art Heretofore, various kinds of electrophotographic methods have been known in the art. Generally, those methods include the steps of: uniformly charging the surface of a latent image bearing member made of a photoconductive material by charging such as corona charging or a direct charging with a charging roller or the like; forming an electric latent image on the latent image bearing member by irradiation with optical energies; forming a toner image by developing the electric latent image with a positively charged toner or a negatively charged toner; optionally transferring the toner image to a transfer material such as a sheet of paper; and fixing the toner image on the transfer material under heat, pressure, or the like. Through those steps, a copy of the original is obtained. Then, the residual toner without being transferred to the transfer material in the transfer step is removed from the transfer material by any of the well-known methods, followed by repeating the preceding steps.

In recent years, electrophotographic image forming apparatuses such as printers and copying machines capable of forming images of higher resolutions are on demand. In particular, for electrophotographic color image forming apparatuses, the demand for excellent image qualities are increasing and the applications thereof are becoming widely various as these apparatuses are becoming widely available. In other words, the reproduction of an image copy of the original such as a photograph, a catalogue, or a map in which the image is reliably reproduced with high precision is on demand for the color image forming apparatus. Concurrently, there are other demands of further increasing the color distinction of the image and further extending the color-reproduction range of the image.

For addressing these needs, there is a method in which an electric latent image is formed by adjusting the density of dots with a constant potential at the time of forming the electric latent image in an electrophotographic image forming apparatus which uses, for example, digital image signals. In this method, however, toner particles are hardly placed on each dot with precision, so that the toner particles may lie off the dot. Therefore, a problem is likely to occur in that the gradation of a toner image corresponding to the ratio of dot densities in black and white portions in a digital latent image.

As a method for addressing the needs described above, for example, there is a method that improves the resolution of an image by decreasing the size of dots that form the above electric latent image. In this method, however, it is difficult to reproduce the electric latent image formed from minute dots, resulting in a poor resolution. Therefore, the resulting image tends to have particularly poor gradation in a highlight portion lacks in sharpness. Furthermore, irregularities in an arrangement of dots cause graininess in the image, which leads to decrease in the image quality of the highlight portion.

For solving these problems, as another method for addressing the needs described above, there is proposed a method that forms an image using a pale toner in a highlight portion and a deep toner in a solid portion.

As the method for forming an image for forming an images the method in which toners having different concentrations are combined together and used in the process of an image formation has been disclosed in JP 05-25038 A, JP 08-171252 A, JP 11-84764 A, JP 2000-231279, JP 2000-305339 A, JP 2000-347476 A, JP 2001-290319 A, etc. In these documents, however, there is no teach or description about the amount or concentration of a colorant to be added in the toner and there is no teach or description about a favorable formulation of the toner.

As an image forming apparatus for the above method for forming an image for forming an image, for example, JP 2000-347476 A discloses an image forming apparatus in which a deep toner is combined with a pale toner such that the maximum reflecting density of the pale toner is half the maximum reflecting density of the deep toner or less. In JP 2000-231279 A, there is proposed an image forming apparatus that utilizes a deep toner having an image density of 1.0 or more and a pale toner having an image density of less than 1.0 in combination when the amount of the toner on a transfer material is 0.5 mg/cm$^2$. Furthermore, in JP 2001-290319 A, there is proposed an image forming apparatus that uses a combination of pale and deep toners in which the ratio between the recording density gradient of the deep toner and the recording density gradient of the pale toner is in a range of 0.2 to 0.5.

According to the studies of the present inventors, it became evident that these image forming apparatuses had a problem of eminently increasing the graininess of an intermediate density area where the deep toner and the pale toner are mixed even though the gradation and the graininess of a low density area composed of only the pale toner are improved. According to the studies of the present inventors, it became evident that the above image forming apparatuses had been designed insufficiently with respect to an extension of the range of color reproduction.

SUMMARY OF THE INVENTION

An object of the present invention is to solve the above-mentioned problems in the conventional art. In other words, it is an object of the present invention to provide: a toner kit having deep and pale toners, which is capable of at least forming an image having a higher quality by decreasing the graininess or roughness from the low density area to the high density area; and a method of forming an image using the above deep and pale toners.

Another object of the present invention is to provide: a toner kit capable of at least forming a vivid cyan or magenta image with a broader color reproduction range than in the conventional art and having a cyan or magenta toner that allows such an image formation; and a method of forming an image using the above cyan or magenta toner.

A further another object of the present invention is to provide an image forming apparatus capable of forming a high-quality image by realizing a broad color reproduction range from a half tone to a high lightness area, which will become important at the time of outputting a natural image or the like.

The present invention relates to an image forming apparatus of an electrophotographic system, which performs a color image formation using a plurality of toners, wherein the image forming apparatus is configured, for at least one color, to: use a deep toner and a pale toner which have hues different from each other; form an image on a high lightness area using only the pale toner; and form an image on a half tone area using the deep toner and the pale toner in combination.

Further, the present invention relates to an image forming apparatus of an electrophotographic system, which performs a color image formation using a plurality of toners, wherein the image forming apparatus is configured, for at least one color, to: use a deep toner and a pale toner which have different concentrations, and lightnesses different from each other at a point on a CIELAB color space, where a color saturation of the deep toner and a color saturation of the pale toner are equal to each other; form an image on a high lightness area using only the pale toner; and form an image on a half tone area using the deep toner and the pale toner in combination.

Further, the present invention relates to a toner kit comprising: a pale cyan toner comprising at least a binder resin and a colorant; and a deep cyan toner comprising at least a binder resin and a colorant, the pale cyan toner and the deep cyan toner being separated from each other, wherein: when a toner image fixed on plain paper is expressed by an L*a*b* color coordinate system where a* represents a hue in the red-green direction, b* represents a hue in the yellow-blue direction, and L* represents a lightness, in a fixed image of the pale toner, the pale cyan toner has a value of a* ($a^*_{C1}$) in a range of −19 to −30 when b* is −20 and a value of a* ($a^*_{C2}$) in a range of −29 to −45 when b* is −30; and in a fixed image of the deep cyan toner, the deep cyan toner has a value of a* ($a^*_{C3}$) in a range of −7 to −18 when b* is −20 and a value of a* ($a^*_{C4}$) in a range of −10 to −28 when b* is −30.

Further, the present invention relates to a deep cyan toner to be used in combination with a pale cyan toner that comprises: at least a resin binder and a colorant; when a toner image fixed on plain paper is expressed by an L*a*b* color coordinate system where a* represents a hue in the red-green direction, b* represents a hue in the yellow-blue direction, and L* represents a lightness, a value of a* ($a^*_{C1}$) in a range of −19 to −30 when b* is −20; and a value of a* ($a^*_{C2}$) in a range of −29 to −45 when b* is −30, the deep cyan toner comprising at least a resin binder and a colorant, wherein: when the toner image fixed on plain paper is expressed by the L*a*b* color coordinate system, a value of a* ($a^*_{C3}$) when b* is −20 is in a range of −7 to −18; and a value of a* ($a^*_{C4}$) when b* is −30 is in a range of −10 to −28.

Further, the present invention relates to a pale cyan toner to be used in combination with a deep cyan toner that comprises: at least a resin binder and a colorant; when a toner image fixed on plain paper is expressed by an L*a*b* color coordinate system where a* represents a hue in the red-green direction, b* represents a hue in the yellow-blue direction, and L* represents a lightness, a value of a* ($a^*_{C3}$) in a range of −7 to −18 when b* is −20; and a value of a* ($a^*_{C4}$) in a range of −10 to −28 when b* is −30, the pale cyan toner comprising at least a resin binder an a colorant, wherein: when the toner image fixed on plain paper is expressed by the L*a*b* color coordinate system, a value of a* ($a^*_{C1}$) when b* is −20 is in a range of −19 to −30; and a value of a* ($a^*_{C2}$) when b* is −30 is in a range of −29 to −45.

Further, the present invention relates to a method for forming an image comprising the steps of: forming an electrostatic charge image on an electrostatic charge image bearing member being charged; forming a toner image by developing the formed electrostatic charge image by a toner; transferring the formed toner image on a transfer material; and fixing the transferred toner image on the transfer material under heat and pressure to obtain a fixed image, wherein: the step of forming the electrostatic charge image comprises the steps of: forming a first electrostatic charge image to be developed by a first toner selected from a pale cyan toner and a deep cyan toner; and forming a second electrostatic charge image to be developed by a second toner selected from the pale cyan toner and the deep cyan toner, except of the first toner; the step of forming the toner image comprises the steps of: forming a first cyan toner image by developing the first electrostatic charge image with the first toner; and forming a second cyan toner image by developing the second electrostatic charge image with the second toner; the step of transferring comprises the step of transferring the first cyan toner image and the second cyan toner image to form a cyan toner image composed of the first cyan toner image and the second cyan toner image which are being overlapped one on another on the transfer material; the pale cyan toner comprises at least a binder resin and a colorant and a deep cyan toner comprises at least a binder resin and a colorant; when a toner image fixed on plain paper is expressed by an L*a*b* color coordinate system where a* represents a hue in the red-green direction, b* represents a hue in the yellow-blue direction, and L* represents a lightness, in a fixed image of the pale cyan toner, the pale cyan toner has a value of a* ($a^*_{C1}$) in a range of −19 to −30 when b* is −20 and a value of a* ($a^*_{C2}$) in a range of −29 to −45 when b* is −30; and in a fixed image of the deep cyan toner, the deep cyan toner has a value of a* ($a^*_{C3}$) in a range of −7 to −18 when b* is −20 and a value of a* ($a^*_{C4}$) in a range of −10 to −28 when b* is −30.

Further, the present invention relates to a toner kit comprising: a pale magenta toner comprising at least a binder resin and a colorant; and a deep magenta toner comprising at least a binder resin and a colorant, the pale magenta toner and the deep magenta toner being separated from each other, wherein: when a toner image fixed on plain paper is expressed by an L*a*b* color coordinate system where a* represents a hue in the red-green direction, b* represents a hue in the yellow-blue direction, and L* represents a lightness, in a fixed image of the pale magenta toner, the pale magenta toner has a value of b* ($b^*_{M1}$) in a range of −18 to 0 when a* is 20 and value of b* ($b^*_{M2}$) in a range of −26 to 0 when a* is 30; and in a fixed image of the deep magenta toner, the deep magenta toner has a value of b* ($b^*_{M3}$) in a range of −16 to 2 when a* is 20 a value of b* ($b^*_{M4}$) in a range of −24 to 3 when a* is 30, a difference between $b^*_{M1}$ and $b^*_{M3}$ ($b^*_{M1}-b^*_{M3}$) in a range of −8 to −1, and a difference between $b^*_{M2}$ and $b^*_{M4}$ ($b^*_{M2}-b^*_{M4}$) in a range of −12 to −1.

Further, the present invention relates to a deep magenta toner to be used in combination with a pale magenta toner that comprises: at least a resin binder and a colorant; when a toner image fixed on plain paper is expressed by an L*a*b* color coordinate system where a* represents a hue in the red-green direction, b* represents a hue in the yellow-blue direction, and L* represents a lightness, a value of b* ($b^*_{M1}$) in a range of −18 to 0 when a* is 20 in a fixed image; and a value of b* ($b^*_{M2}$) in a range of −26 to 0 when a* is 30, the deep magenta toner comprising at least a resin binder and a colorant, wherein: when the toner image fixed on plain paper is expressed by the L*a*b* color coordinate system, a value of b* ($b^*_{M3}$) when a* is 20 is in a range of −16 to 2; a value of b* ($b^*_{M4}$) when a* is 30 is in a range of −24 to 3; a difference between $b^*_{M1}$ and $b^*_{M3}$ ($b^*_{M1}-b^*_{M3}$) is in a range of −8 to −1; and a difference between $b^*_{M2}$ and $b^*_{M4}$ ($b^*_{M2}-b^*_{M4}$) is in a range of −12 to −1.

Further, the present invention relates to a pale magenta toner to be used in combination with a deep magenta toner that comprises: at least a resin binder and a colorant; when a toner image fixed on plain paper is expressed by an L*a*b* color coordinate system where a* represents a hue in the red-green direction, b* represents a hue in the yellow-blue direction, and L* represents a lightness, a value of b* ($b^*_{M3}$) in a range of −16 to 2 when a* is 20 in a fixed image; and a value of b* ($b^*_{M4}$) in a range of −24 to 3 when a* is 30, the pale magenta toner comprising at least a resin binder an a colorant, wherein: a value of b* ($b^*_{M1}$) when a* is 20 in a fixed image is in a range of −18 to 0; a value of b* ($b^*_{M2}$) when a* is 30 is in a range of −26 to 0; a difference between $b^*_{M1}$ and $b^*_{M3}$ ($b^*_{M1}-b^*_{M3}$) is in a range of −8 to −1; and a difference between $b^*_{M2}$ and $b^*_{M4}$ ($b^*_{M2}-b^*_{M4}$) is in a range of −12 to −1.

Further, the present invention relates to a method for forming an image comprising the steps of: forming an electrostatic charge image on an electrostatic charge image bearing member being charged; forming a toner image by developing the formed electrostatic charge image by a toner; transferring the formed toner image on a transfer material; and fixing the transferred toner image on the transfer material under heat and pressure to obtain a fixed image, wherein: the step of forming the electrostatic charge image comprises the steps of; forming a first electrostatic charge image to be developed by a first toner selected from a pale magenta toner and a deep magenta toner; and forming a second electrostatic charge image to be developed by a second toner selected from the pale magenta toner and the deep magenta toner, except of the first toner; the step of forming the toner image comprises the steps of: forming a first magenta toner image by developing the first electrostatic charge image with the first toner; and forming a second magenta toner image by developing the second electrostatic charge image with the second toner; the step of transferring comprises the step of transferring the first magenta toner image and the second magenta toner image to form a magenta toner image composed of the first magenta toner image and the second magenta toner image which are being overlapped one on another on the transfer material; the pale magenta toner comprises at least a binder resin and a colorant and a deep magenta toner comprises at least a binder resin and a colorant; when a toner image fixed on plain paper is expressed by an L*a*b* color coordinate system where a* represents a hue in the red-green direction, b* represents a hue in the yellow-blue direction, and L* represents a lightness, in a fixed image of the pale magenta toner, the pale magenta toner has a value of b* ($b^*_{M1}$) in a range of −18 to 0 when a* is 20 and a value of b* ($b^*_{M2}$) in a range of −26 to 0 when a* is 30; and in a fixed image of the deep magenta toner, the deep magenta toner has a value of b* ($b^*_{M3}$) in a range of −16 to 2 when a* is 20 and a value of b* ($b^*_{M4}$) in a range of −24 to 3 when a* is 30, a difference between $b^*_{M1}$ and $b^*_{M3}$ ($b^*_{M1}-b^*_{M3}$) in a range of −8 to −1, and a difference between $b^*_{M2}$ and $b^*_{M4}$ ($b^*_{M2}-b^*_{M4}$) in a range of −12 to −1.

DETAILED DESCRIPTION OF PREFERRED EMBODIMENTS

[Image forming Apparatus]

Referring now to the attached drawings, we describe one of preferred embodiments of the present invention in detail. An image forming apparatus adapted to an electrophotographic system described below is a preferable one used for a laser beam printer, a copying machine, a laser facsimile machine, a digital-proofing device, and so on.

At first, referring to FIG. 19, a principal configuration of the electrophotographic image forming apparatus will be described.

Figure 19:
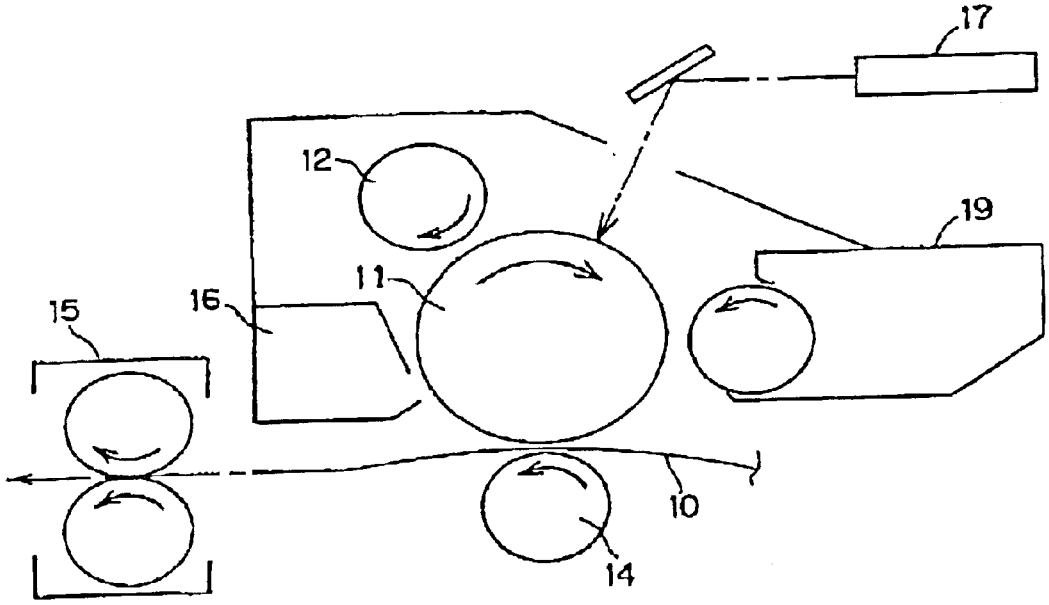
FIG. 19 is an explanation view for illustrating a basic configuration of an electrophotographic image forming apparatus.

The image forming apparatus shown in FIG. 19 adopts an electrophotographic system and comprises a photosensitive drum 11 provided as an electrostatic charge image bearing member, and an electric charger 12, an image exposing device 17, a developing device 19, a transfer charging device 14, a fixing device 15, and a cleaning member 16, which are arranged around the photosensitive drum 11.

The photosensitive drum 11 includes a conductive supporting substrate as a bottom layer and one or more layers on the substrate. In other words, the photosensitive drum 11 may be of a function-separated type, such as one having a two-layer structure composed of a charge generation layer and a charge transport layer on the substrate, or may be of a single-layer type.

The electric charger 12 is means for uniformly charging the photosensitive drum 11 in this case, for example, the charging may be performed by a corona charging system using a corona charger constructed of a wire and an electric field control grid or a roller charging system in which a direct current or a superposed bias composed of direct and alternate currents is applied on a charging roller contacted with an image bearing member.

The image exposing device 17 is means for performing an image exposure on the surface of the photosensitive drum 11 after charging to form an electrostatic latent image. In this case, for example, the exposure means may preferably use one of various kinds of optical systems, such as a scanner using a semiconductor laser, a light emitting diode (LED) that performs an image exposure through a selfoc lens serving as a condensing device, an electroluminescent (EL) element, and a plasma emitting element.

The developing device 19 is means for an image development to form a toner image (a visualized image) by attaching toner particles to an electrostatic latent image on the photosensitive drum 11. In this case, a developing system adopted to the developing device 19 may be one selected from various kinds of developing systems including: a non-contact developing system using magnetic one-component toner, where a magnetic toner is transferred by magnetic force and is then flown to the surface of an image bearing member at a developing nip in a non-contact manner; a magnetic contact developing system that performs a developing process by making contact with an image bearing member at a developing nip; a non-contact developing system using nonmagnetic one-component toner, where a nonmagnetic toner is charged under control with a blade and is then carried on a developing sleeve, followed by transferring and throwing the nonmagnetic toner to an image bearing member for an image development in a non-contact manner; a contact developing system using nonmagnetic one-component toner, where an image development is performed by making contact with an image bearing member at a developing nip; and a two-component developing system that performs an image development by mixing nonmagnetic toner with magnetic powders provided as carriers, followed by transferring to a developing nip by a developing sleeve.

The transfer charger 14 is means for transferring a toner image on the photosensitive drum 11 to a sheet 10 such as a sheet of paper. In this case, a transfer system may be one utilizing an electric force or a mechanical force. As a method of transferring the toner image using an electric force, several systems have been known in the art, such as a corona transfer system and a roller transfer system. The corona transfer system transfers the toner image to the sheet 10 by applying a DC bias having a polarity opposite to the charged polarity of the toner on the sheet 10 using a corona wire. The roller transfer system brings a roller into press contact with the sheet 10, followed by applying a bias opposite to the charged polarity of the toner on the sheet 10 to transfer the toner image to the sheet 10.

Figure 20:
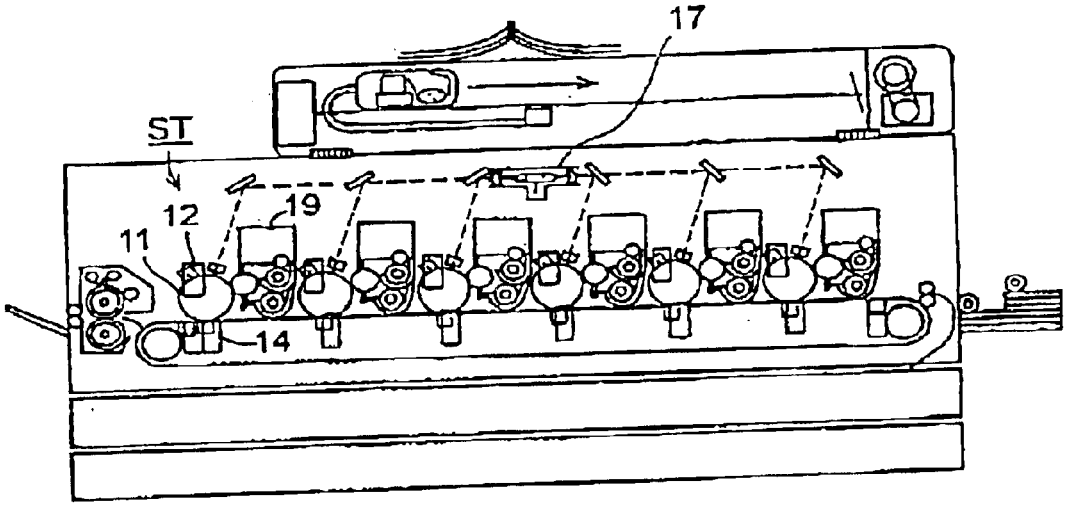
FIG. 20 is a schematic cross sectional side view for illustrating an example of the configuration of an image forming apparatus according to an embodiment of the present invention.
Figure 21:
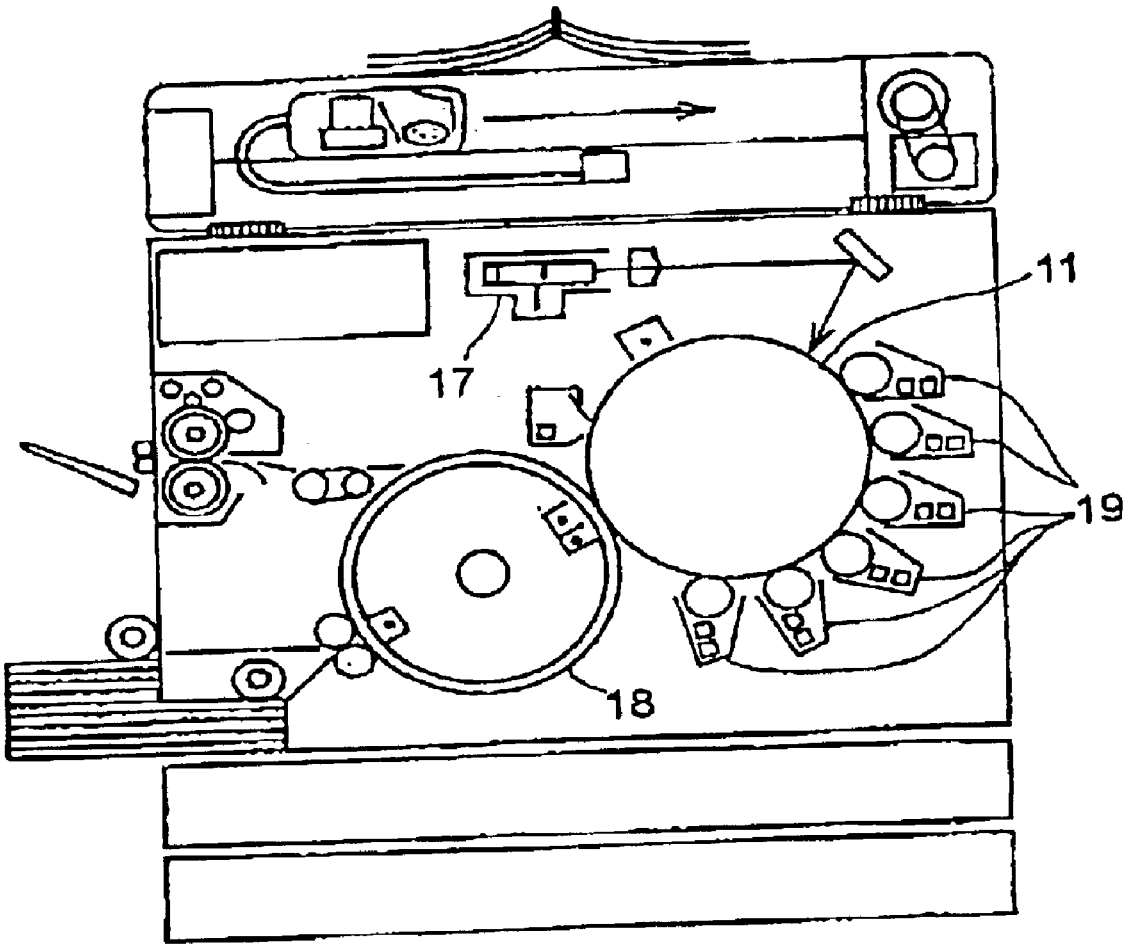
FIG. 21 is a schematic cross sectional side view for illustrating another example of the configuration of the image forming apparatus according to the embodiment of the present invention.

FIGS. 20 and 21 are schematic diagrams for illustrating a typified configuration of the image forming apparatus of the present embodiment. In the present embodiment, as shown in the figures, an image forming apparatus comprising a plurality of developing devices 19 to perform a color image formation using a plurality of different color toners is used.

The image forming apparatus shown in FIG. 20 is designed to have a plurality of image forming stations (ST) (six stations are illustrated in the figure) placed in a line along a sheet-feeding direction. Each of the image forming stations ST comprises a photosensitive drum 11, an electric charger 12, a developing device 19, and a transfer charger 14. In addition, the developing device 19 of each image forming station ST contains a toner with its own color or concentration different from those of the other stations ST. In this image forming apparatus, a color image is formed by making toner images at the respective stations ST and sequentially overlaying one toner image on another.

Furthermore, the image forming apparatus shown in FIG. 21 is designed such that a plurality of developing devices 19 (six devices in the figure) are arranged around a single photosensitive drum 11. In each of the developing devices 19, a toner with its own color or concentration different from those of other developing devices is contained. In this apparatus, the developing devices 19 are sequentially changed to form their respective toner images. Then, the toner images of the respective colors are placed one on top of another on an intermediate transfer member 18, followed by transferring the overlapped toner images to the sheet at once to form a color image on the sheet.

Any configuration may be preferably applied on the image forming apparatus as distinct from those described above as far as the apparatus includes two or more developing devices to perform an image formation using two or more kinds of toners.

In this embodiment, for at least one color, the image forming apparatus configured as described above uses a deep color toner and a pale color toner, where the concentration levels of these toners are different from each other. The pale toner is mainly used in a high lightness area (a high light area) to improve the graininess of the high lightness area and realize high gradation reproductivity.

In the present invention, "deep" of the deep toner includes "dark" in addition to meaning of a narrow sense of the "deep". Similarly, in the present invention, "pale" of the pale toner includes "light" or "bright" in addition to meaning of a narrow sense of the "pale". Specifically, when a color saturation of the deep toner and a color saturation of the pale toner are equal and lightnesses of these toners are different, "pale toner" means a toner having a higher lightness, and "deep toner" means a toner having a lower lightness. In addition, when a lightness of the deep toner and a lightness of the pale toner are equal and color saturations are different, "pale toner" means a toner having a higher color saturation, and "deep toner" means a toner having a lower color saturation.

Toners which can be used in each of the developing devices may include a pale cyan toner (Pale cyan), a pale magenta toner (Pale magenta), a deep yellow toner (Deep Yellow), and a light black toner (Light Black) in addition to the typical toners (i.e., cyan, magenta, yellow, and black toners). Furthermore, various combinations of these toners may be used. The typical combinations thereof are listed below.

1. Cyan, Pale cyan, Magenta, Yellow, Black (5 colors in total)
2. Cyan, Pale cyan, Magenta, Pale magenta, Yellow, Black (6 colors in total)
3. Cyan, Pale cyan, Magenta, Pale magenta, Yellow, Deep Yellow, Black (7 colors in total)
4. Cyan, Pale cyan, Magenta, Pale magenta. Yellow, Deep Yellow, Black, Light Black (8 colors in total)
5. Pale Blue, Cyan, Pale Red, Magenta, Pale Green, Deep Yellow, Black (7 colors in total)
6. Pale cyan, Blue, Pale magenta, Red, Yellow, Green, Black (7 colors in total)
7. Black, Light Black (2 colors in total)

In addition to the above combinations of the toners, other combinations of the toners may be arbitrarily applied. For example, three or more toners having different concentration levels may be used, or the range of color expressions may be extended using a toner of a specific color such as orange, gold, silver, or white, or the lustrous properties of an image to be formed may be increased using a colorless toner that does not contain any colorant.

In one of the embodiments of the present invention, the hue of a deep toner and the hue of a pale toner can be defined such that their hue angles are different from one another.

It becomes possible to extend the range of color reproduction in the direction of color saturation on the lightness area in the neighborhood of a point for switching the deep toner and the pale toner by making a difference between the hues of two or more kinds of toners having different concentration levels.

Namely, using a deep toner and a pale toner, which are different from each other in terms of their concentrations of color and hues, the image forming apparatus is allowed to realize an extended color reproduction range as a result of a displacement in the hue angle of toner.

Figure 22:
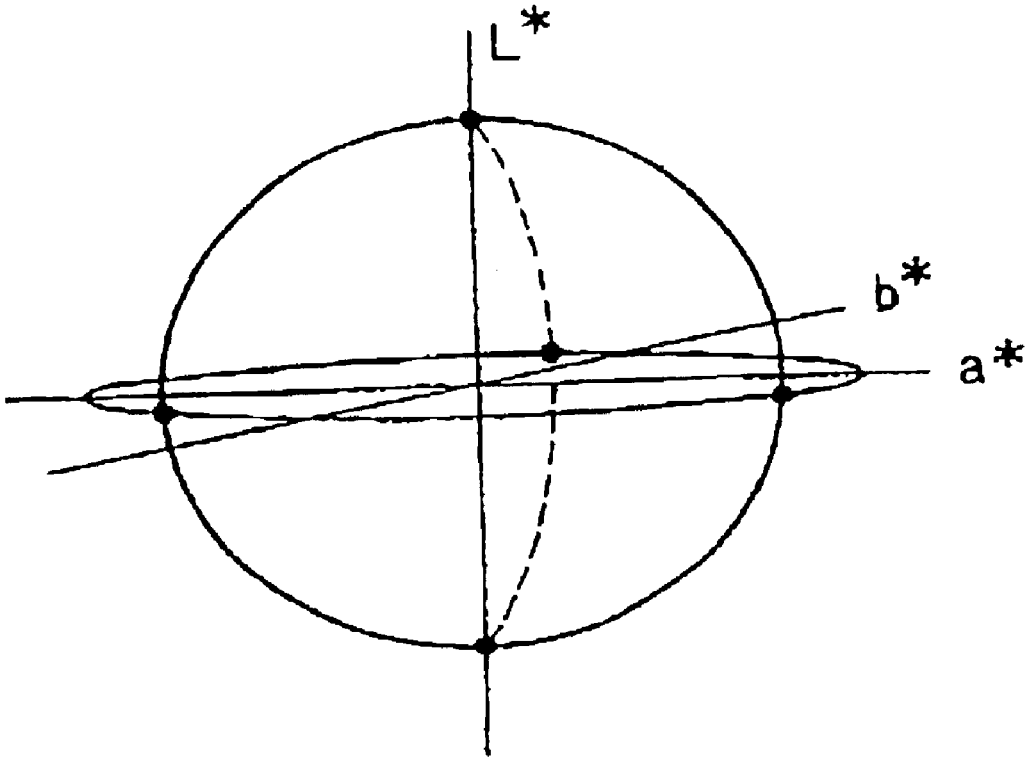
FIG. 22 is a schematic view for illustrating a color reproduction range when the hue of deep toner and the hue of pale toner are equal to each other.
Figure 23:
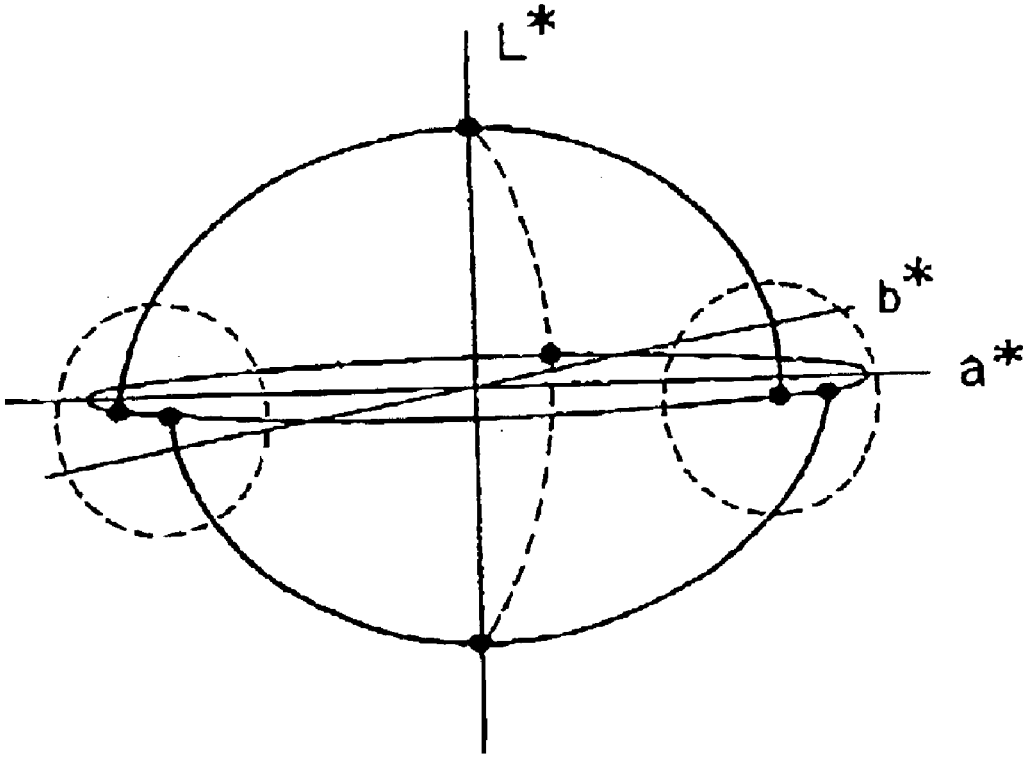
FIG. 23 is a schematic view for illustrating the color reproduction range when the hue of deep toner and the hue of pale toner are different from each other.

The color reproduction range at this time will be now described with reference to FIGS. 22 to 24. Each of these figures is a schematic view representing the color reproduction range of the image forming apparatus using the deep and pale toners in the CIELAB (the CIE L*a*b* Color coordinate system) color space. FIG. 22 illustrates the case in which the hue of the deep toner and the hue of the pale toner are equal. FIG. 23 illustrates the case in which the hue of the deep toner and the hue of the pale toner are different. In addition, FIG. 24 illustrates the case in which the hue of the deep toner and the hue of the pale toner are different, but these toners are overlapped one another in a half tone area much more than other cases.

Figure 24:
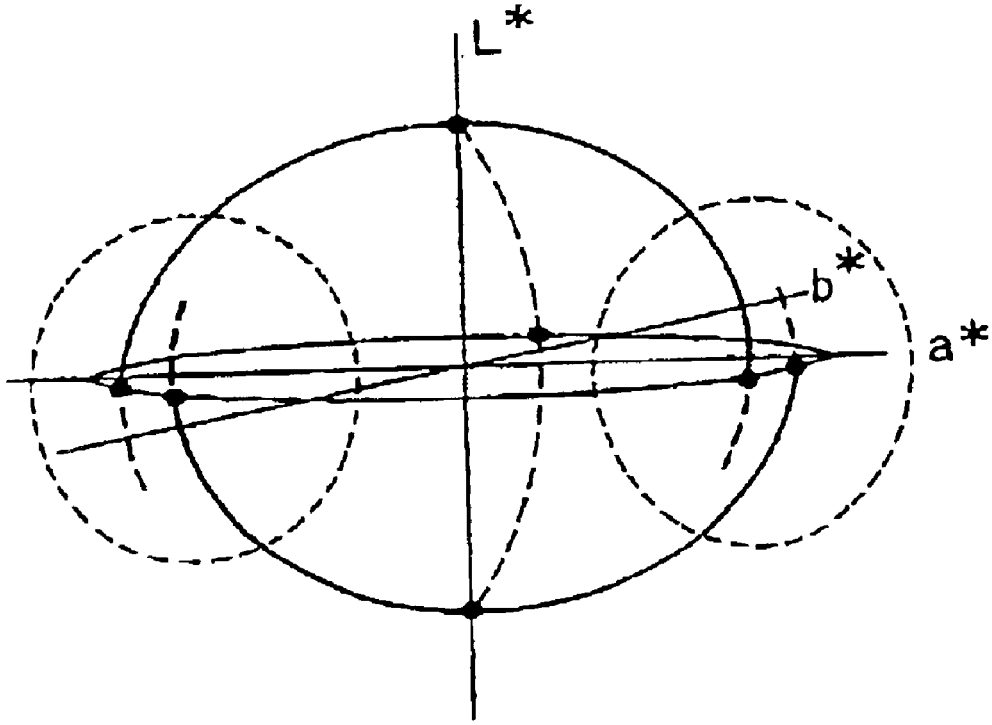
FIG. 24 is a schematic view for illustrating the color reproduction range when the hue of deep toner and the hue of pale toner are different from each other and an area where the deep toner and the pale toner overlap one another is wide in a half tone area.

As is evident from FIGS. 23 and 24, the color reproduction range can be extended by making the difference between the hue of deep toner and the hue of pale toner, compared with the case in which they are equal to each other. Particularly, comparing with the case shown in FIG. 23 in which the deep toner and the pale toner are overlapped a little in a half tone area, we can understand that the color reproduction range extends extensively by increasing the area of overlapping the deep toner and the pale toner one another in a half tone area as shown in FIG. 24 even though their hues are different from each other.

The displacement in the hue angle of each of the deep toner and the pale toner is 30° or less, preferably 20° or less in the a*-b* plane. When the hue angle is larger than 30°, the discontinuity of the color tones may stand out and any problem may be caused in the quality of output image in each of an area only with the pale toner, an area with the light and deep toner in combination, and an area only with the deep toner.

Furthermore, the displacement in the hue angle of each of the deep toner and the pale toner is 3° or more, preferably 5° or more in a*-b* plane. When the hue angle is too small, the effects of extended color reproduction range cannot be obtained.

Moreover, in the case that an area where the gamma of the deep toner and the gamma of the pale toner are overlapped one another is formed while the deep toner and the pale toner are used in combination in an intermediate lightness area, it is preferable to make the displacement of the hue angle 3° or more at a lightness defined by:

$$(Lm-Lp)\times 0.2+Lp$$

where Lp denotes the minimum lightness of the pale toner and Lm denotes the lightness of a sheet of white paper to be printed.

Figure 25:
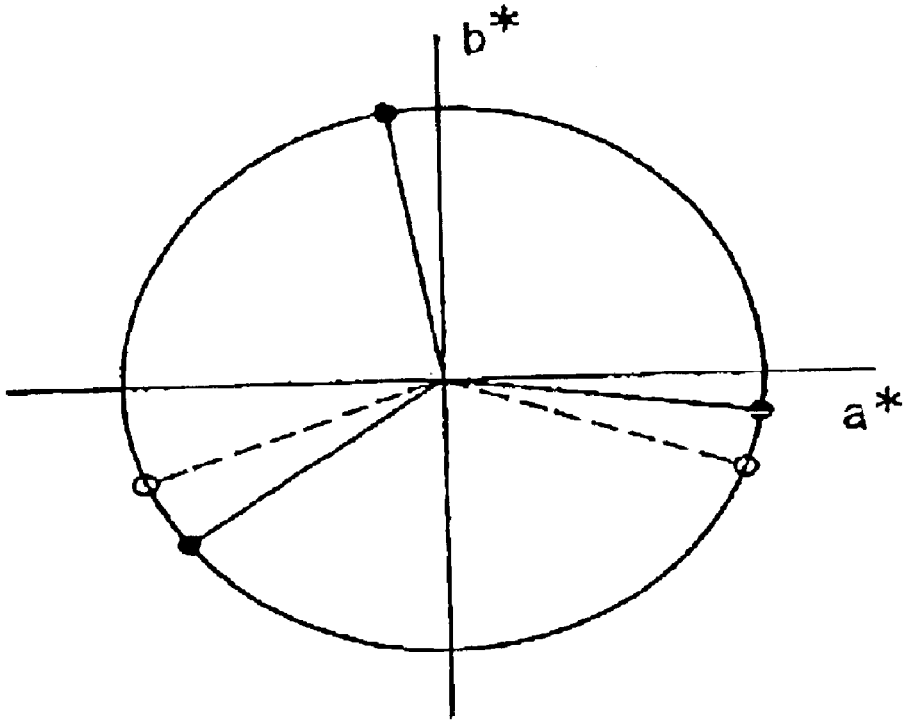
FIG. 25 is a schematic view for illustrating a hue angle of a primary color at a predetermined lightness.

Lines that indicate hue angles of primary colors with the lightness described above can be represented, for example, as shown in FIG. 25. In this figure, solid lines represent the lines of the respective primary colors: cyan, magenta, and yellow, respectively. In addition, broken lines represent the lines of the respective primary colors: pale cyan and pale magenta, respectively. Defining the hue angle of the deep and pale toner as described above allows an appropriate hue angle in the area where the deep toner and the pale toner are used in combination. Therefore, it becomes possible to extend the color reproduction range in the direction of color saturation in the intermediate lightness area (connected by a circle) obtained by connecting among the ends of the respective lines of the deep and pale toners in the figure.

Furthermore, in one of other embodiments, the lightness of the deep toner and the lightness of the pale toner at predetermined color saturation are defined so as to be different from each other. Specifically, the lightness value (L*) of the deep toner and the lightness value (L*) of the pale toner are defined so as to be different from each other at a point where the color saturation $c^*((a^{*2}+b^{*2})^{1/2})$ in the CIELAB color space of the deep toner and that of the pale toner are equal to each other. More preferably, the lightness of the deep toner and the lightness of the pale toner are defined so as to be different from each other in a high lightness area (i.e., an area with a lightness of 60 or more).

Figure 26:
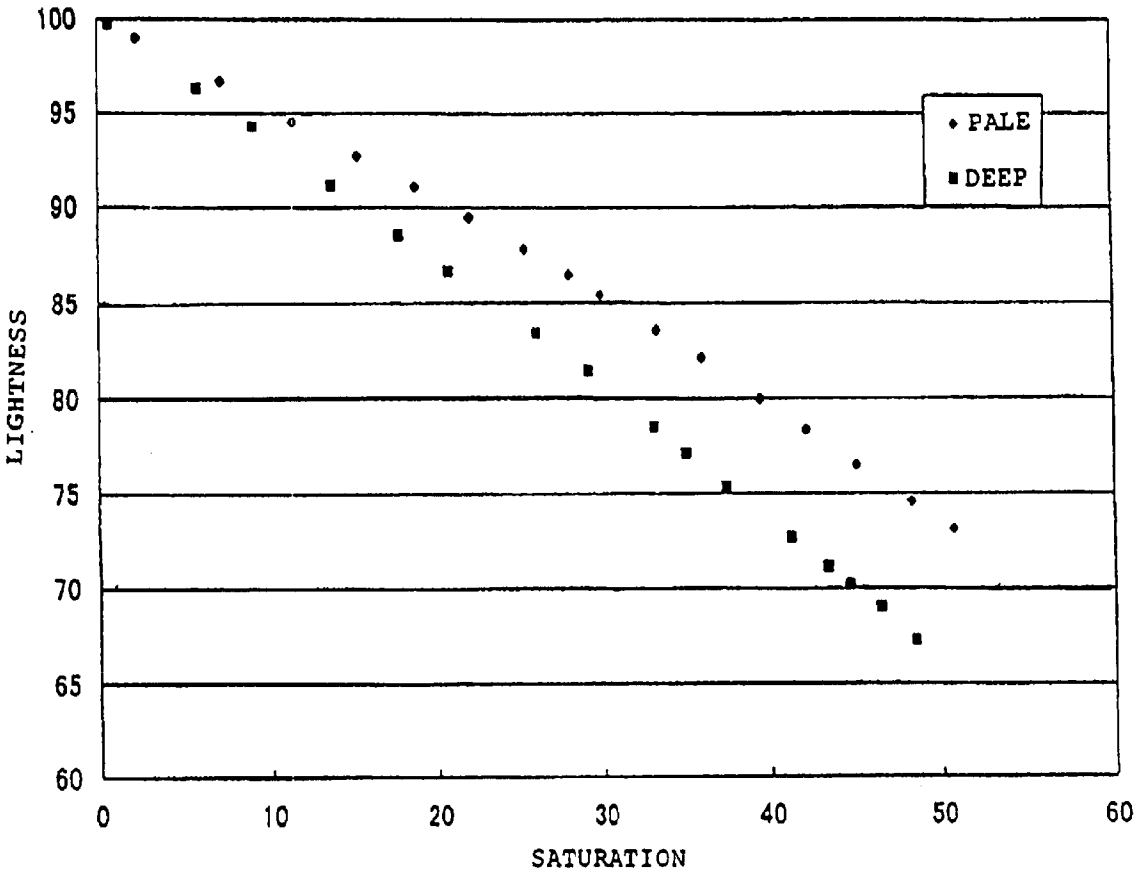
FIG. 26 is a graph that represents a difference between the lightness of deep toner and the lightness of pale toner in a high lightness area.

FIG. 26 shows an example of such a case. In the figure, the horizontal axis represents color saturation (C*) and the vertical axis represents lightness (L*). In this example shown in FIG. 26, the lightness of the pale toner is defined such that it is relatively higher than that of the deep toner with color saturation equal to that of the pale toner in a high lightness area.

Consequently, the color reproduction range mainly from an intermediate lightness area to a high lightness area can be extended by making the lightnesses of two or more kinds of toners having different concentrations different from one to another at the same color saturation.

That is, the extended color reproduction range can be realized by providing the lightness of each of deep and pale toners at the same color saturation with a displacement.

Figure 27:
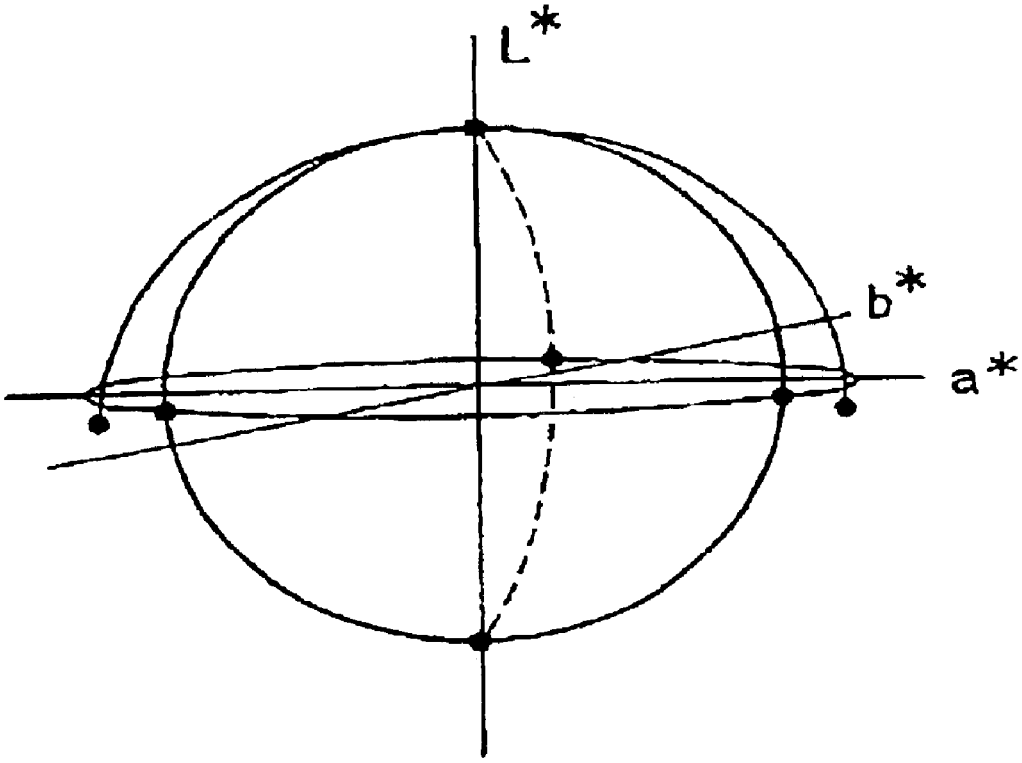
FIG. 27 is a schematic view for illustrating the color reproduction range when the lightness characteristics of deep toner and the lightness characteristics of pale toner are different from each other.
Figure 28:
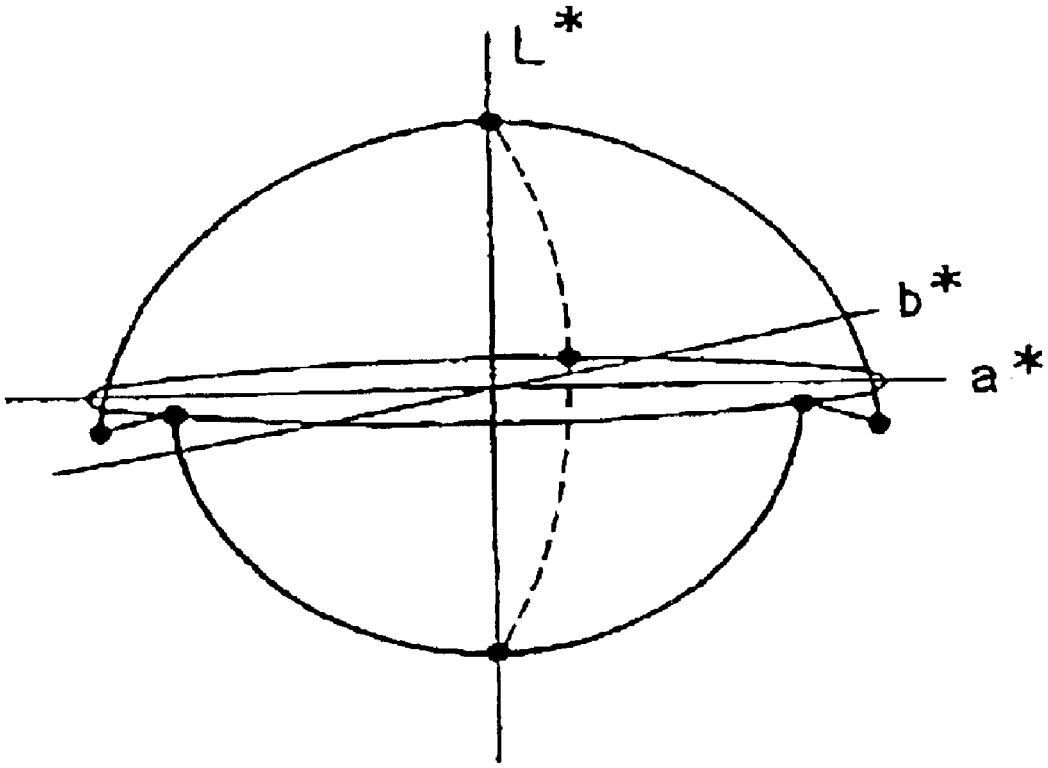
FIG. 28 is a schematic view for illustrating the color reproduction range when the lightness characteristics of deep toner and the lightness characteristics of pale toner are different from each other, and an image formation is performed without using the deep toner and the pale toner in combination in a half tone area.
Figure 29:
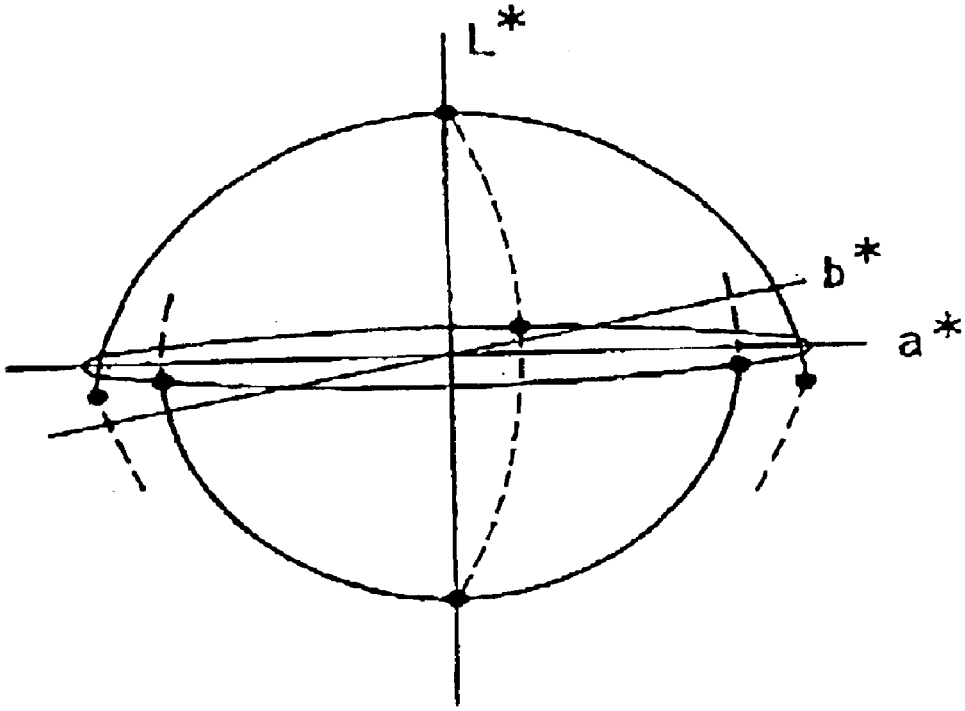
FIG. 29 is a schematic view for illustrating the color reproduction range when the lightness characteristics of deep toner and the lightness characteristics of pale toner are different from each other, and an image formation is performed using the deep toner and the pale toner in combination in a half tone area.

Here, this principle will be described with reference to FIG. 22 and FIGS. 27 to 29. In each of these figures, the color reproduction range of an image forming apparatus using a deep toner and a pale toner is schematically represented in the CIELAB color space. In FIG. 22, the lightness characteristics of the deep toner are equal to those of the pale toner as described above. In FIG. 27, the lightness characteristics of the deep toner are different from those of the pale toner. In FIG. 28, the lightness characteristics of the deep toner are different from those of the pale toner, and an image formation is performed in a half tone area without using the deep toner and the pale toner in combination. In FIG. 29, the lightness characteristics of the deep toner are equal to those of the pale toner, and an image formation is performed in a half tone area using the deep toner and the pale toner in combination.

As is evident from FIG. 27, comparing with the color reproduction range (FIG. 22) obtained by the conventional procedures, the color reproduction range is extended by increasing the lightness of the pale toner more than the lightness of the deep toner at the same color saturation from an intermediate lightness area to a high lightness area. In this case, however, if the deep toner and the pale toner are not used in combination at a half tone area, the color reproduction becomes discontinuous in an area in which color saturation is high at an intermediate lightness as shown in FIG. 28. Therefore, it is difficult to perform a favorable image formation while taking advantage of the color reproduction range extended from an intermediate lightness area to a high lightness area.

Thus, in the high lightness area, an image formation is performed only using the pale toner. In a half tone area, an image formation is performed using both the deep toner and the pale toner in combination. In an intermediate lightness area, therefore, a color reproduction area is smoothly formed without any discontinuous portion as shown in FIG. 29, so that favorable gradation reproducibility and extended color reproduction range can be realized.

The displacement of each of the lightnesses of deep and pale toners at the same color saturation is preferably five or more in the CIELAB color space. When the displacement of the lightness is too small, the effects of the extended color reproduction range cannot be obtained.

As described above, according to the present embodiment, using the deep toner in combination with the pale toner, where the concentration and lightness of one of them are different from those of the other, the color reproduction range from an intermediate lightness area to a high lightness area can be extensively extended. In particular, a vivid color development is attained in the high lightness area, so that it becomes possible to extensively improve a photographic feel of an image like a clear sky, sea, or the like, and also possible to realize a color development of vivid color which is heavily used for drawing designs and trademarks of products and companies, and so on.

It should be noted here that the above technology has completed by paying our attentions mainly on an area extending from an intermediate lightness area to a high lightness area (i.e., an area having a lightness of 60 or more) to extend the color regeneration range in the directions of lightness and color saturation. In other words, the above technology is based on an idea completely different from the conventional technology that extends a dynamic range toward a lower lightness.

In the present invention, furthermore, each of the deep toner and the pale toner may have its own hue and lightness, which are different from those of the other. In this case, it is possible to further extend the color reproduction range in a high lightness area in the direction of color saturation.

Furthermore, a vivid color development is attained in the high lightness area, so that it becomes possible to extensively improve a photographic feel of an image like a clear sky, sea, or the like, and also possible to realize a color development of vivid color which is heavily used for drawing designs and trademarks of products and companies, and so on.

For a preferable image formation, the deep toner and the pale toner are used in the following proportions. That is, only the pale toner is used in high lightness area on the CIELAB color space. In a half tone area, the deep toner and the pale toner are used in combination. In a low lightness area, the deep toner and the pale toner are used in combination or only the deep toner is used.

Figure 30:
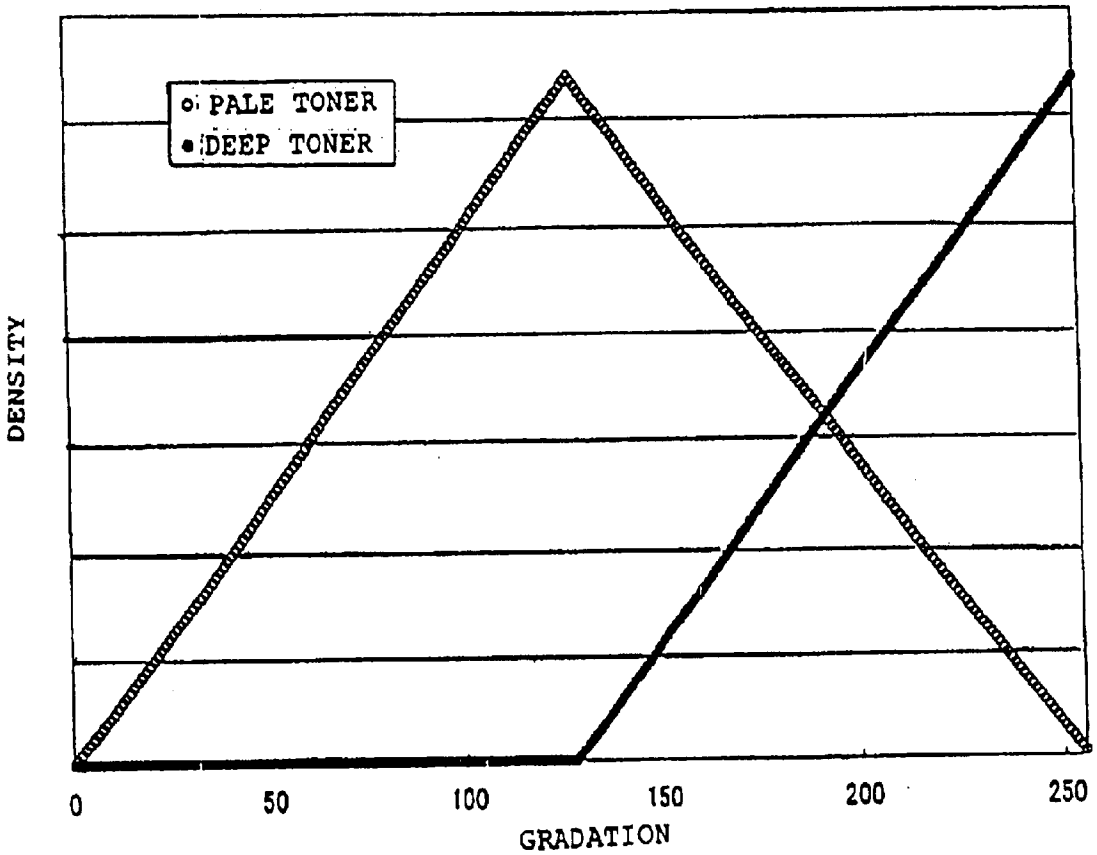
FIG. 30 is a graph that represents an example of each of gradation curves of deep toners and pale toners.

Referring now to FIG. 30, a typified gradation curve of each of deep and pale toners is shown. In this figure, the horizontal axis represents the gradation level of an image before the step of separation into images of the respective deep and pale toners, and the vertical axis represents the gradation level of each of separated images of the respective toners. Here, the separation means that dividing the image data of a certain color (referred to as a plate or a channel) into two image data of deep toner and pale toner, respectively.

In the example shown in FIG. 30, only the pale toner is used for an image formation in a high lightness area (a high light area) having small gradation levels. The gradation of the pale toner increases up to the gradation level 128, and then the gradation thereof falls off of the gradation level 128. On the other hand, in the case of the deep toner, the deep toner becomes increased from the gradation level beyond 128. In other words, an image formation is performed using the pale toner and the deep toner in combination in a half tone area.

Figure 31:
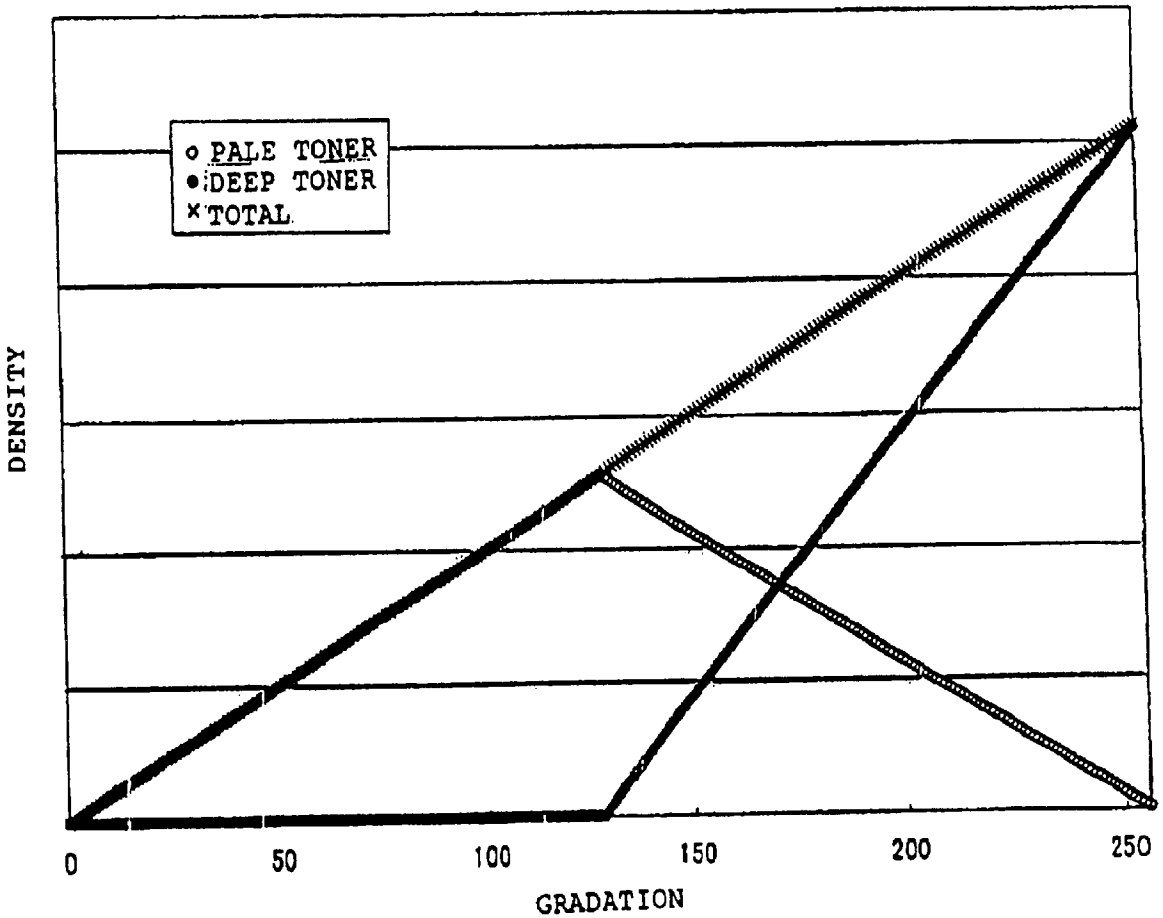
FIG. 31 is a graph that represents a density curve of an image obtained from each of the gradation curves in FIG. 30.

The density curve of the image thus obtained is shown in FIG. 31. In the figure, the horizontal axis represents the gradation levels of the image as well as FIG. 30 and the vertical axis represents the density of the image. As is evident from the graph shown in FIG. 31, excellent gradation reproducibility can be obtained using the deep toner and the pale toner in combination in a half tone area.

The gradation curve of each of the deep toner and the pale toner is not limited to those shown in FIG. 30. Various curves may be applied for these toners in the present invention. Preferably, the area on which an image formation is performed using the deep toner and the pale toner in combination may correspond to at least one fifth of the total gradation levels of the color for realizing an excellent gradation and an extended color reproduction area.

Figure 32:
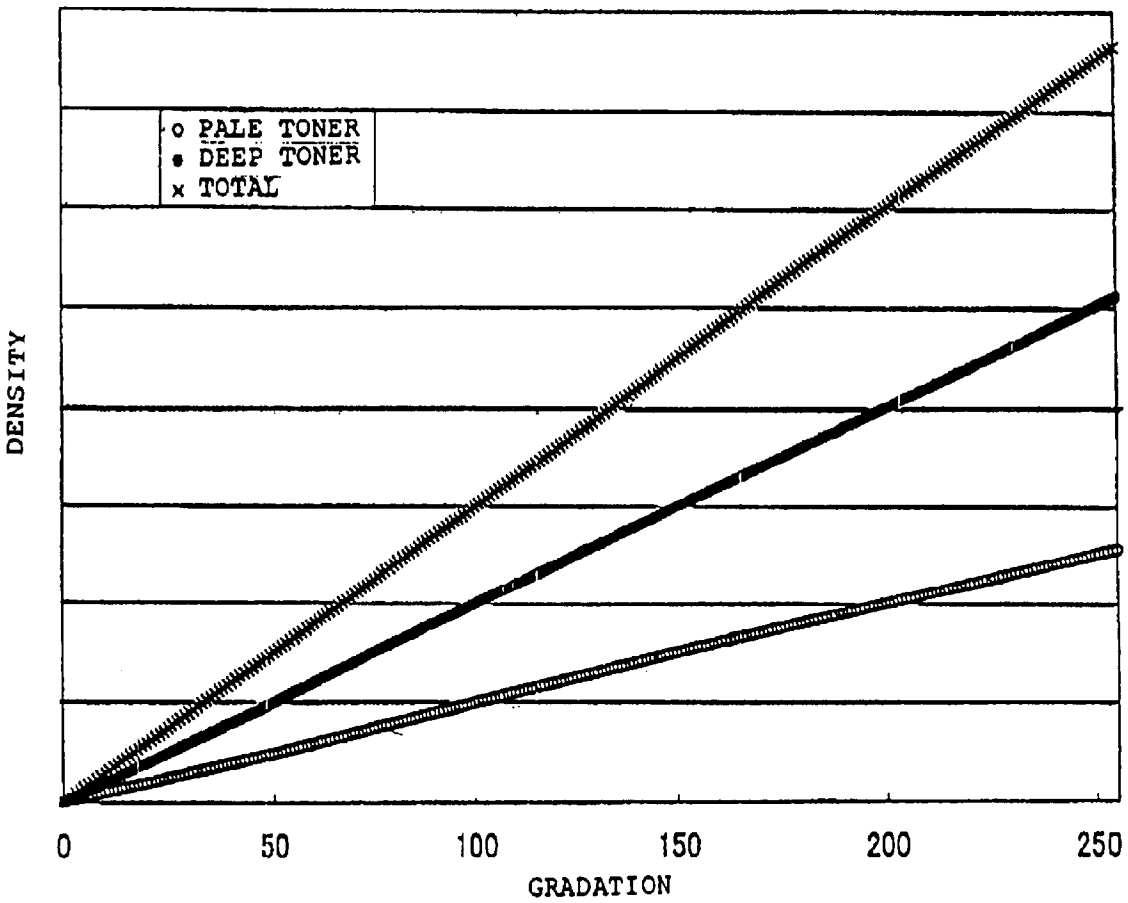
FIG. 32 is a density curve of an image obtained with the gradation curves different from those in FIG. 30.

As shown in FIG. 32, however, the graininess of the high light area tends to be decreased (i.e., the graininess of the toner becomes obvious) when the deep toner and the pale toner are used in combination from the high light area. Therefore, when the gradation is one that allows an image formation with an image density of 0.3 or less, only the pale toner may be used and the usage rate of the deep toner may be 0%.

In addition, the technology mentioned realizes an extended color reproduction range mainly from a half tone area to a high lightness area, which becomes important at the time of generating the output of an actual image of nature. Therefore, it is different from the conventional technology that extends a color reproduction range to a low lightness area results in an increase in the concentration of toner and the amount of toner being mounted.

Here, for the image forming apparatus of the present invention, the values of lightness and density are measured on a fixed image using a spectrodensitometer (MODEL: 528, manufactured by X-Rite, Incorporated). In addition, the L*a*b* values are measured using the spectrodensitometer (MODEL; 528, manufactured by X-Rite, Incorporated) under the measuring conditions of illumination type D50 and standard observer 2°. According to the present invention, the measuring device is not limited to the spectrodensitometer described above. Any appropriate measuring device, such as the SectroScan Transmission (manufactured by GretagMacbeth Co., Ltd.) may be used as far as the same measurement can be performed.

The deep toner and the pale toner are those prepared such that one has its own density level and hue angle different from those of the other by changing the kind of a colorant used in each of them. Alternatively, these toners may use the same colorant, except that the contents of the colorant included in these toners are different from each other, such that they have different density levels and hue angles, respectively. In this case, a preferable density level can be attained when the content of a colorant in the pale toner is one fifth or less of a colorant contained in the deep toner.

Although each of the deep toner and the pale toner may be prepared using any of toner materials well known in the art, it is preferable to use one of toner materials such as those typified in a later description about toners that constitute a toner kit.

Next, we will describe the image forming operation of the image forming apparatus described above.

Here, we will describe the case in which an input image consisting of three colors: red (R), green (G), and blue (B) is formed using six different toners: cyan (DC), pale cyan (PC), magenta (DM), pale magenta (PM), yellow (Y), and black (K), respectively. That is, the output of cyan color is generated using two toners, PC and DC, and the output of magenta color is generated using two toners, PM and DM.

The image forming apparatus reads a color image on a document by a document reader (a scanner unit) and then obtains input image signals by a color separation of the image into RGB colors with charge coupled devices (CCDs). Alternatively, when the image forming apparatus has a printer function, RGB print data (the input image signals) may be obtained from a computer. In this embodiment, the RGB input image is used. In addition, although the input image of RGB is used here, this is only based on the specification of a printer driver installed in the computer or the document reader. As an input image, in stead of the RGB image, an image of CMYK, an image of CMYK+LC+LM, an image of L*a*b*, an image containing a channel for specific color, or the like may be inputted.

In the case of performing an image formation, the inputted RGB color signals should be converted into color signals of CMYK+LC+LM capable of being outputted from an output device for the image formation.

Figure 33:
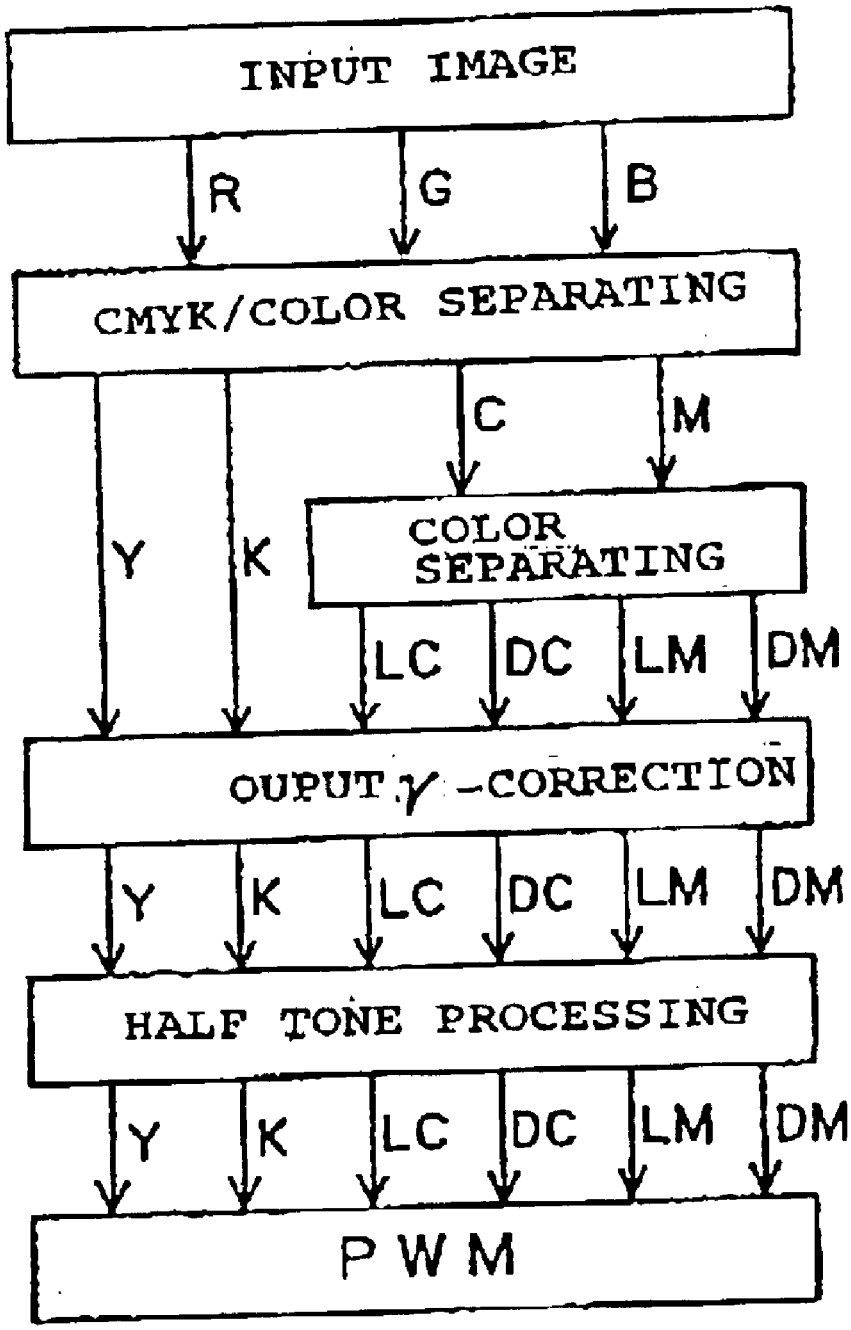
FIG. 33 is a block diagram that illustrates one of techniques to be used for a color conversion method.

In FIG. 33, a method of color conversion is typified.

In this figure, RGB signals of an input signal is separated into four colors of CMYK, followed by separating each of two specific colors (C and M) into two separation data (deep and pale). Finally, color signals corresponding to six colors of Y, K, PC, DC, PM, and DM are obtained, respectively. Subsequently, the color signal for each of six colors is subjected to a predetermined gamma correction and then subjected to a halftone processing, followed by entering into a PWM circuit.

In this kind of the color conversion method, the RGB color signals are converted into primary colors of C and M, followed by separating C and M into pale and deep, for example PC+DC and PM+DM, respectively. Therefore, in a case where the hues of two kinds of toners (i.e., deep and pale toners) are greatly different from each other, the hue becomes uneven in a monochromatic gradation area, a high light area, or the like, so that the outer appearance of the resulting image may cause the sense of incongruity. In this embodiment, however, each of two toners has a hue displacement of 30° or less, preferably 20° or less. Therefore, the quality of an output image can be prevented from being deteriorated, while realizing excellent gradation and graininess and an extended color reproduction.

In the method of color conversion to two separation data. deep and pale, various kinds of combinations can be considered with the density levels of toners, and so on. In FIG. 30, a basic linear gradation conversion method is shown.

As shown in the figure, the pale toner rises at first in a high light area, the deep toner becomes introduced from near a half tone area, the combination of deep and pale toners reproduces the gradation for a while, and then the use of the pale toner is gradually restricted in a high density area. In this case, the combination of deep and pale toners for reproducing the gradation is defined by the relationship between the image qualities such as graininess, gradation, and color gamut, and the amount of toner consumption. In this embodiment, for simplifying the illustration, the linear gradation is shown in the figure. However, in terms of preventing the generation of tone jump in a practical manner, It is preferable to draw a gentle slope at the beginning of the concentration of each of deep and pale toners.

Figure 34:
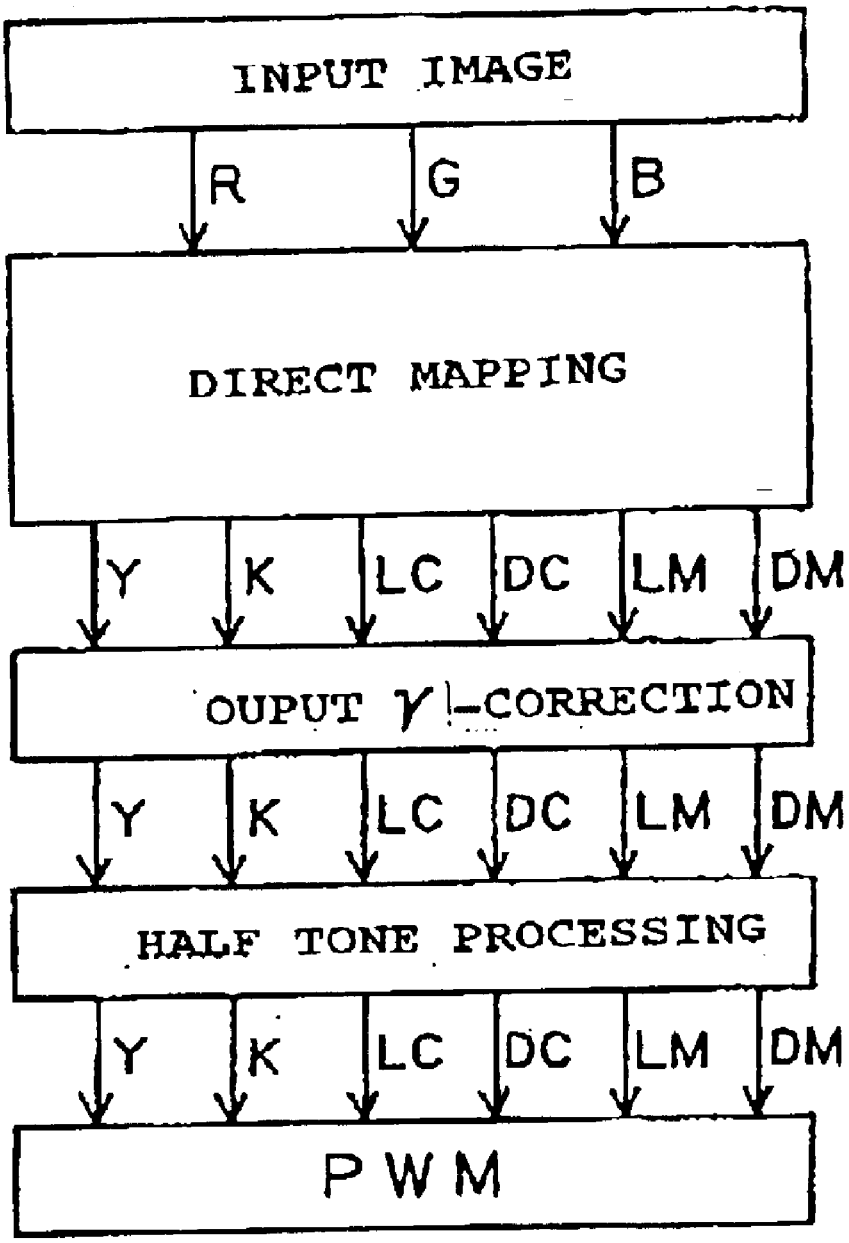
FIG. 34 is a block diagram that illustrates another technique (direct mapping) to be used for the color conversion method.

FIG. 34 shows another example of the color conversion method.

In this case, the RGB signals of an input image are separated directly into six colors of Y, K, PC, DC, PM, and DM by means of a direct mapping.

The term "direct mapping" means a color conversion method by which input signals (color information of an input image) are converted directly into output signals (color information to be used for an image formation) of an output device with reference to a look-up table (LUT). For instance, three input signals such as L*a*b* in the color space or RGB are provided to output signal values in the output color space required for the reproduction of the color in the form of four colors of CMYK or six colors of CMYK+PC+PM.

This kind of the color conversion method does not require a matrix calculation and allows an on linear conversion. Therefore, the flexibility of color conversion, such as a setup of UCR, is increased extensively to permit a desired color reproduction while controlling the load of toner.

According to the direct mapping, color signals of each of the deep toner and the pale toner can be generated directly from RGB signals of an input image. Therefore, the direct mapping does not cause any deterioration, which is being concerned in the method shown in FIG. 33, of the output quality by the difference in hues of deep and pale toners.

As described above, according the image forming apparatus of the present invention, the deep toner and the pale toner, which are different from each other in terms of their concentrations and hues, are used to form an image formation such that only the pale toner is used in a high lightness area and the combination of both toners is used in a half tone area. Therefore, excellent gradation and graininess can be realized, while realizing an extended color reproduction range from the half tone to the high lightness area, which can be important particularly at the time of outputting a natural image or the like. Consequently, an image formation with a high quality becomes possible.

[Toner Kit]

A toner kit of the present invention comprises a pale toner and a deep toner specified in the present invention, which are isolated from each other. The toner kit of the present invention may further comprise other toners in an isolated form in addition to a cyan or magenta toner that comprises the above deep and pale toners. The toner kit of the present invention can be used in a developing device, an image forming apparatus, a process cartridge, or the like, which has two or more independent toner containers. Furthermore, the toner kit of the present invention is a container in which two or more toners or developers to be introduced into the developing device or the like in separated state. Hereinafter, each of toners constituting the toner kit will be described.

At first, we will describe a cyan toner.

Each of the pale cyan toner and the deep cyan toner to be used in the present invention comprises at least a binder resin and a colorant. When a toner image fixed on a sheet of plain paper is expressed by the L*a*b color coordinate system where a* represents the hue in the red-green direction, b* represents the hue in the yellow-blue direction, and L* represents lightness, in a fixed image of the pale cyan toner, the pale cyan toner has the value of a* ($a^*_{C1}$) in a range of −19 to −30 when the value of b* is −20, and the value of a* ($a^*_{C2}$) in a range of −29 to −45 when the value of b* is −30. In addition, in a fixed image of the deep cyan toner, the deep cyan toner has the value of a* ($a^*_{C3}$) in a range of −7 to −18 when the value of b* is −20, and the value of a* ($a^*_{C4}$) in a range of −10 to −28 when the value of b* is 30.

Figure 1:
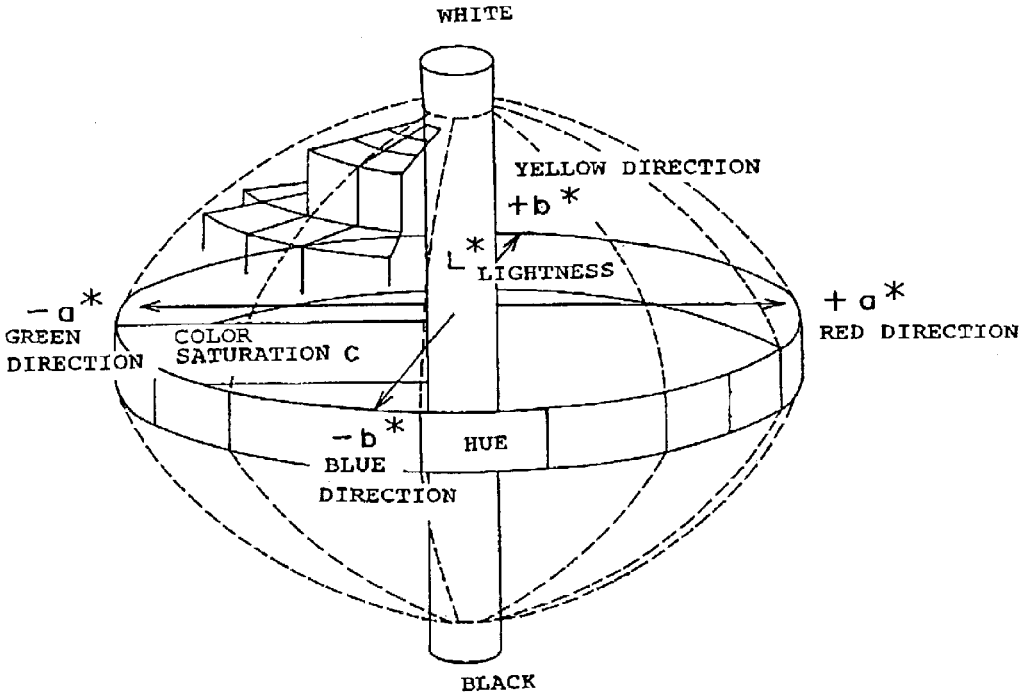
FIG. 1 is a stereoscopic view for illustrating the concepts of an L*a*b* color coordinate system to be used in the present invention.

The L*a*b* color coordinate system has been generally used as a useful means for a numerical expression of color. The conception of the CIE L*a*b* color coordinate system is stereoscopically shown in FIG. 1. In the figure, a* and b* on the horizontal axis represent hues, respectively. The term "hue" is a measure of the tone of a color such as red, yellow, green, blue, or violet. In the present invention, as mentioned above, a* represents the hue in the red-green direction, b* represents the hue in the yellow-blue direction, and L* represents the lightness. The term lightness represents the degree of color lightness, which can be compared with others irrespective of the hue.

In the present invention, the conventional problems described above can be solved and, from a high density area to a low density area, an excellent image having an excellent gradation and an extended color reproduction range without graininess can be obtained using the pale cyan toner having $a^*_{C1}$ in the range of −19 to −30 and $a^*_{C2}$ in the range of −29 to −45 and the deep cyan toner having $a^*_{C3}$ in the range of −7 to −18 and $a^*_{C4}$ in the range of −10 to −28.

Regarding the above point of view, in the present invention, $a^*_{C1}$ may be more preferably in the range of −21 to −26, $a^*_{C2}$ may be more preferably in the range of −30 to −37, $a^*_{C3}$ may be more preferably in the range of −11 to −18, and $a^*_{C4}$ may be more preferably in the range of −20 to −27.

An image formed by the cyan toner includes a color having a high sensitivity to a human and a color having a comparatively low sensitivity to a human. The gradation of an image formed as a color of blue to navy blue can be easily recognized even in a high density area where the change rate of a density of an image is small. Furthermore, in a low density area which is found as a dot or a line in the image is characterized in that the waving of such a dot or line tends to be detected as graininess. The gradation of an image formed as a color of pale green to pale blue is characterized in that certain degree of dot or line disarrangement is hardly detected as graininess. As the hues of deep and pale toners are in the ranges described above, the graininess can be also favorably inhibited in an intermediate density area where the pale cyan toner and the deep cyan toner are present in combination with each other.

When the value of $a^*_{C1}$ is larger than −19 (closer to a positive number) or $a^*_{C2}$ is larger than −29, the graininess tends to be increased in the low density area. On the other hand, when the value of $a^*_{C1}$ is smaller than −30 (increases in negative) or $a^*_{C2}$ is smaller than −45, the graininess may be increased in the intermediate density area. When the value of $a^*_{C3}$ is larger than −7 or $a^*_{C4}$ is larger than −10, the graininess tends to be increased in the intermediate density area. When the value of $a^*_{C3}$ is smaller than −18 or $a^*_{C4}$ is smaller than −28, a sufficient gradation may be not obtained in a high density area. The hue ranges of each of the pale cyan toner and the deep cyan toner are attained by selecting the kinds and concentrations of colorants, adjusting the particle diameters of toners, and so on.

In the present invention, the difference between the above $a^*_{C1}$ and $a^*_{C3}$ (i.e., $a^*_{C1}-a^*_{C3}$) is preferably in a range of −22 to −1, more preferably in the range of −12 to −3. In addition, the difference between the above $a^*_{C2}$ and $a^*_{C4}$ (i.e., $a^*_{2}-a^*_{C4}$) is preferably in a range of −33 to −1, more preferably in the range of −15 to −3. When $(a^*_{C1}-a^*_{C3})$ is larger than −1 or $(a^*_{C2}-a^*_{C4})$ is larger than −1, the extent of gradation which is capable of expressing from a low density area to a high density area may be small. When $(a^*_{C1}-a^*_{C3})$ is smaller than −22 or $(a^*_{C2}-a^*_{C4})$ is smaller than −33, the effects of a decrease in graininess contiguously observed from the low density area to the high density area may be decreased.

In the present invention, $L^*$ ($L^*_{C1}$) of the above pale cyan toner is preferably in a range of 85 to 90 when $c^*$ is 30. In addition, $L^*$ ($L^*_{C2}$) of the above deep cyan toner is preferably in a range of 74 to 84 when $c^*$ is 30. Here, the $c^*$ represents color saturation which indicates the degree of color brightness and can be obtained by the following equation.

$$c^*=\sqrt{a^{*2}+b^{*2}}$$

By keeping the above $L^*_{C1}$ and $L^*C_2$ within the above ranges, the effects of reducing graininess can be held while improving the brightness of an image to allow the extension of a color reproduction range. When $L^*_{C1}$ is less than 85, the effects of reducing graininess may be reduced in the low density area. When $L^*_{C1}$ is larger than 90, the effects of reducing graininess may be reduced in the intermediate density area. When $L^*_{C2}$ is less than 74, the effects of reducing graininess may be reduced in the intermediate density area. When $L^*_{C2}$ is larger than 84, a sufficient gradation may be not obtained in a high density area.

Figure 2:
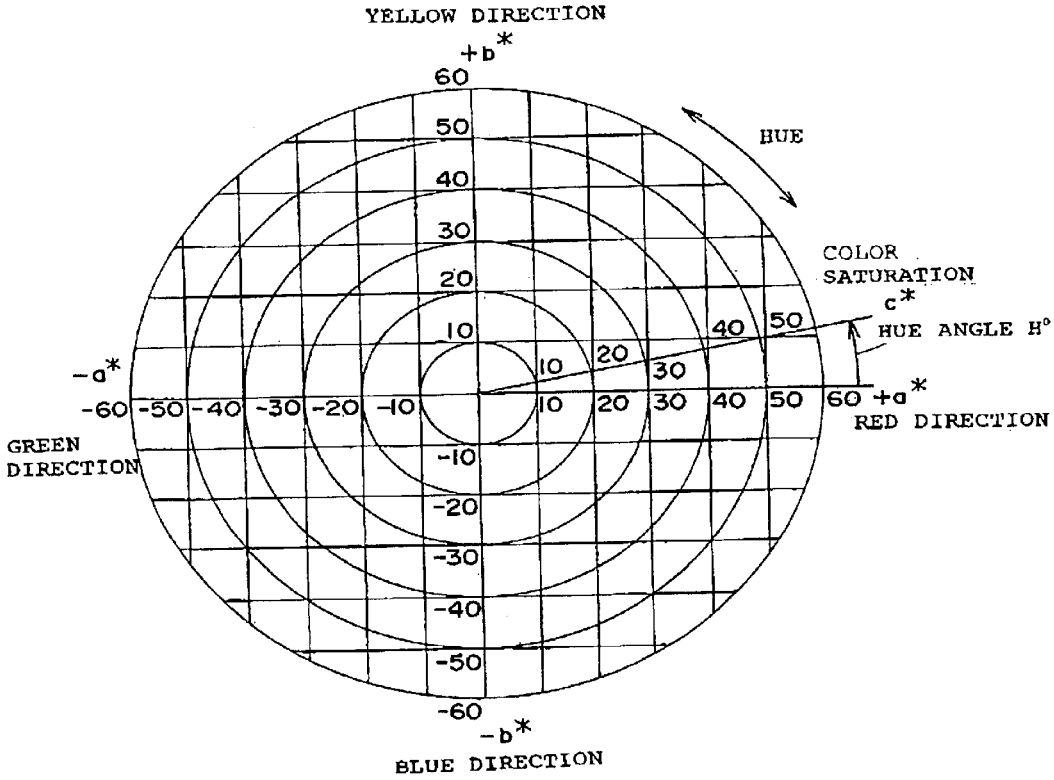
FIG. 2 is a two-dimensional view for illustrating the concepts of a hue, a color saturation, and a hue angle to be used in the present invention.

In the present invention, the hue angle ($H^*_{C1}$) of the pale cyan toner is preferably in a range of 214 to 226°, while the hue angle ($H^*_{C2}$) of the deep cyan toner is preferably in a range of 228 to 260°. As shown in FIG. 2, the above hue angle is an angle of a line connecting between the hue ($a^*$, $b^*$) and an origin; with respect to the positive $a^*$ axis in the $a^*$-$b^*$ coordinate of an image with 0.5 mg/cm$^2$ of toner being adhered on a sheet of paper. In other words, it is an angle between the above straight line and the positive $a^*$ axis in the direction of counterclockwise from the positive $a^*$ axis. The hue angle is able to easily represent a specific hue without relation to the lightness.

When $H^*_{C1}$ exceeds 226°, the effects of reducing graininess may be reduced in the low density area. When $H^*_{C1}$ is less than 214°, the effects of reducing graininess may be reduced in the intermediate density area. When $H^*_{C2}$ exceeds 260°, the effects of reducing graininess may be reduced in the intermediate density area. When $H^*_{C2}$ is less than 228°, a sufficient gradation may be not obtained in the high density area.

Next, we will describe a magenta toner.

According to the pale magenta toner and the deep magenta toner to be used in the present invention, when a toner image fixed on plain paper is expressed by the $L^*a^*b^*$ color coordinate system, in a fixed image of the pale magenta toner, the pale magenta toner has the value of $b^*$ ($b^*_{M1}$) in a range of −18 to 0 when the value of $a^*$ is 20, and the value of $b^*$ ($b^*_{M2}$) in a range of −26 to 0 when the value of $a^*$ is 30. In addition, in a fixed image of the deep magenta toner, the deep magenta toner has the value of $b^*$ ($b^*_{M3}$) in a range of −16 to 2 when the value of $a^*$ is 20, the value of $b^*$ ($b^*_{M4}$) in the range of −24 to +3 when the value of $a^*$ is 30, a difference between the $b^*_{M1}$ and the $b^*_{M3}$ (i.e., $b^*_{M1}-b^*_{M3}$) in the range of −8 to −1, and a difference between the $b^*_{M2}$ and the $b^*_{M4}$ (i.e., $b^*_{M2}-b^*_{M4}$) in the range of −12 to −1.

In the present invention, the conventional problems described above can be solved and, from a high density area to a low density area, an excellent image having an excellent gradation and an extended color reproduction range without graininess can be obtained using the pale magenta toner having $b^*_{M1}$ in the range of −18 to 0 and $b^*_{M2}$ in the range of −26 to 0 and the deep magenta toner having $b^*_{M3}$ in the range of −16 to 2 and $b^*_{M4}$ in a range of −24 to 3.

Regarding the above point of view, in the present invention, $b^*_{M1}$ may be more preferably in the range of −13 to −4, $b^*_{M2}$ may be more preferably in the range of −15 to −5, $b^*_{M3}$ may be more preferably in the range of −12 to 0 (further preferably in the range of −11 to −2), and $b^*_{M4}$ may be more preferably in the range of −15 to 0 (further preferably in the range of −14 to −4).

An image formed by the magenta toner includes a color having a high sensitivity to a human and a color having a comparatively low sensitivity to a human. The gradation of an image formed as a color of magenta close to red can be easily recognized even in a high density area where the change rate of an image density is small. Furthermore, in a low density area which is found as a dot or a line in the image is characterized in that the waving of such a dot or line tends to be detected as graininess. On the other hand, an image formed as a color of magenta close to violet is characterized in that certain degree of dot or line disarrangement is hardly detected as graininess. As the hues of deep and pale toners are in the ranges described above, the graininess can be also favorably inhibited in an intermediate density area where the pale magenta toner and the deep magenta toner are present in combination with each other.

When the value of $b^*_{M1}$ is larger than 0 (becomes a positive number) or $b^*_{M2}$ is larger than 0, the graininess tends to be increased in the low density area. On the other hand, when the value of $b^*_{M1}$ is smaller than −18 (increases in negative) or $b^*_{M2}$ is smaller than −26, the graininess may be increased in the intermediate density area. When the value of $b^*_{M3}$ is larger than 2 or $b^*_{M4}$ is larger than 3, the graininess tends to be increased in the intermediate density area. When the value of $b^*_{M3}$ is smaller than −16 or $b^*_{M4}$ is smaller than −24, a sufficient gradation may be not obtained in a high density area.

Further, the magenta toner of the present invention is characterized in that the difference between the above $b^*_{M1}$ and $b^*_{M3}$ (i.e., $b^*_{M1}-b^*_{M3}$) is in a range of −8 to −1, and the difference between the above $b^*_{M2}$ and $b^*_{M4}$ (i.e., $b^*_{M2}-b^*_{M4}$) is in a range of −12 to −1. The difference between $b^*_{M1}$ and $b^*_{M3}$ (i.e., $b^*_{M1}-b^*_{M3}$) may be more preferably in a range of −7 to −1, furthermore preferably in a range of −7 to 2. The difference between $b^*_{M2}$ and $b^*_{M4}$ (i.e., $b^*_{M2}-b^*_{M4}$) may be more preferably in a range of −11 to −2, further more preferably in a range of −10 to −2. When ($b^*_{M1}-b^*_{M3}$) is larger than −1 or ($b^*_{M2}-b^*_{M4}$) is larger than −1, the extent of gradation which is capable of expressing from a low density area to a high density area may be small. When ($b^*_{M1}-b^*_{M3}$) is smaller than −8 or ($b^*_{M2}-b^*_{M4}$) is smaller than −12, the effects of a decrease in graininess contiguously observed from the low density area to the high density area may be decreased. The hue ranges of each of the pale magenta toner and the deep magenta toner are attained by selecting the kinds and concentrations of colorants, adjusting the particle diameters of toners, and so on.

Furthermore, the above effects become marked particularly when the pale magenta toner and the deep magenta toner have the tribo-electric charge characteristics of the same polarity with respect to each other and the difference of two-component tribo values of both magenta toners is represented by an absolute value of 5 mC/kg or less. Therefore, it becomes possible to obtain a fine image having an excellent gradation without graininess from the low density area to the high density area.

Figure 18:
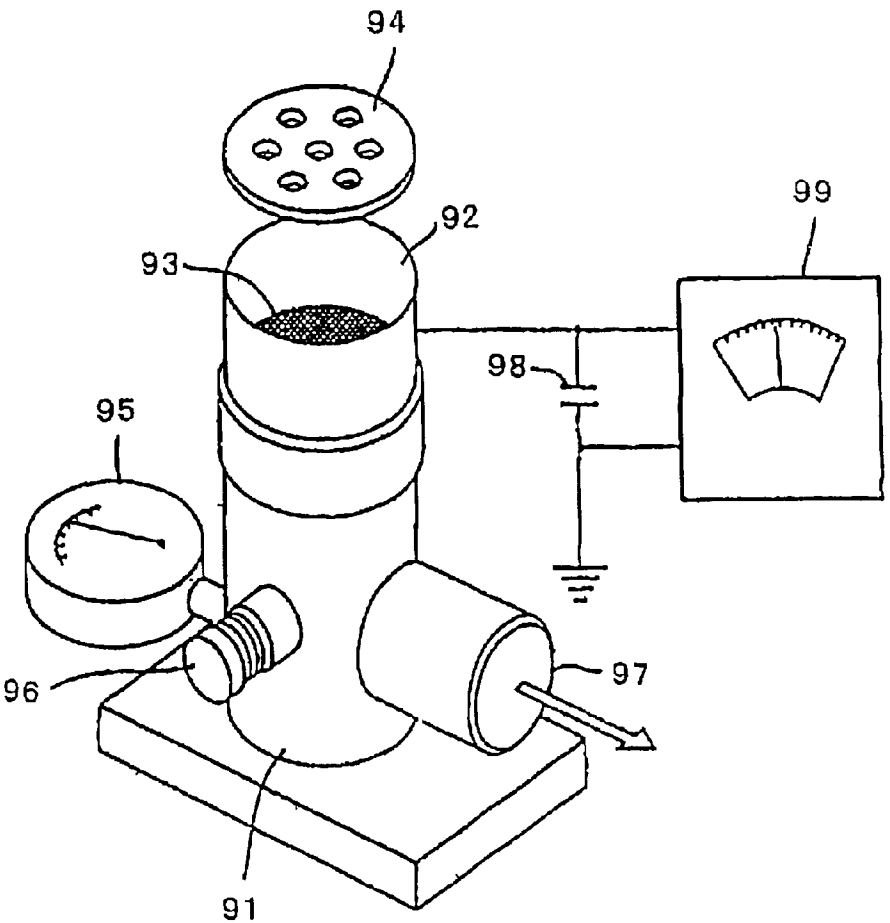
FIG. 18 is a schematic view for illustrating an apparatus used for measuring a triboelectric charge amount.

The two-component tribo value of each toner can be measured by the method well known in the art. In this invention, it is preferable to measure the two-component tribo value by a measuring device shown in FIG. 18. At first, a mixture of a sample to be subjected to the measurement of two-component tribo value and a carrier thereof is placed on a measuring container 92 made of a metal having a 500 mesh screen 93 on the bottom. That is, in the case of measuring the tribo value of toner, the mixture is a combination of toner and carrier at a mass ratio of 1:19. In the case of measuring the tribo value of an external additive, on the other hand, the mixture is a combination of external additive and carrier at a mass ratio of 1:99. The mixture is placed in a polyethylene bottle with a volume of 50 to 100 ml, and is then shaken with a hand for about 10 to 40 seconds, followed by placing about 0.5 to 1.5 g of the mixture (developer) in the container 92 and putting a metal lid 94 thereon. At this time, the total mass of the measuring container 92 is defined as W1 (g). Then, an aspirator 91 (at least a portion contacting with the measuring container 92 is made of an insulating material) aspirates through an aspirating opening 97 while adjusting the suction power with an airflow control valve 96 to make a vacuum gage 95 show the pressure of 250 mmAq. In this state, suction is performed sufficiently, preferably for two minutes to remove the toner. At this time, the potential of an electrometer 99 is defined as V (volts). In FIG. 18, the reference numeral 98 denotes a capacitor, and the capacity thereof is defined as C (mF). In addition, the mass of the whole measuring container after absorption is measured, and the resulting value is defined as W2 (g). The two-component tribo value (mC/kg) can be calculated by the following equation.

Two-component tribo value (mC/kg)=C×V/(W1−W2) (where the measuring conditions are 23° C. and 60% RH).

In the measurement is a coat ferrite carrier having 70 to 90% by mass of carrier particles of 250 mesh pass and 350 mesh on was used as the carrier.

Concretely, a carrier produced as follows was used. In a four-neck flask, 20 parts of toluene, 20 parts of butanol, 20 parts of water and 40 parts of ice were placed and stirred. 2 moles of $CH_3SiCl_3$ and 3 moles of $(CH_3)_2SiCl_2$ were added into the four-neck flask while further stirring, followed to initiating condensation reaction to obtain silicone resin.

| | |
|---|---|
| Silicone resin obtained as above | 100 parts |
| $C_6H_5$—$NHCH_2CH_2CH_2CHSi(OCH_3)_3$ | 2 parts |

A mixture of the above materials was coated to the surface of Cu—Zn—Fe ferrite core to obtain a carrier. As to the silicone resin-coated ferrite carrier, a number ratio (Si/C) of silicon atom to carbon atom on the surface of the carrier particle, which have been obtained by XPS measurement, was 0.6. The total amount of Cu, Zn and Fe atoms as metal atoms contained in the carrier was 0.5% by number. Further, the carrier had a weight average particle diameter of 42 μm, 19% by weight of the particles of 26 μm to 35 μm in particle diameter, and 0% by weight of particles of 70 μm or more in particle diameter. A current of 70 μA was observed when the voltage of 500 V were charged to the carrier.

In the present invention, the value L* ($L^*_{M1}$) of the above pale magenta toner is preferably in a range of 78 to 90 when C* is 30. Also, the value L* ($L^*_{M2}$) of the above deep magenta toner is preferably in a range of 74 to 87 when C* is 30. Furthermore, the difference between $L^*_{M1}$ and $L^*_{M2}$ (i.e., $L^*_{M1}-L^*_{M2}$) is preferably in a range of 0.4 to 12.

As the above $L^*_{M1}$ and $L^*_{M2}$ are in the above ranges, the brightness of an image is improved while keeping the effects of reducing graininess. Therefore, it becomes possible to extend the color reduction range. When the value $L^*_{M1}$ is less than 78, the effects of reduced graininess may be decreased in the low density area. When the value $L^*_{M1}$ exceeds 90, the effects of reducing graininess may be decreased in the intermediate density area. When the value $L^*_{M2}$ is less than 74, the effects of reducing graininess may be decreased in the intermediate density area. When the value $L^*_{M2}$ exceeds 87, a sufficient gradation may be not obtained in a high density area. In addition, when ($L^*_{M1}-L^*_{M2}$) is less than 0.4, the effects of extending the color reproduction range may be decreased. On the other hand, when ($L^*_1-L^*_{M2}$) exceeds 12, the effects of reducing graininess may be decreased.

In the present invention, the hue angle ($H^*_{M1}$) of the pale magenta toner is preferably in the range of 325 to 350°. In addition, the hue angle ($H^*_{M2}$) of the deep magenta toner is preferably in the range of 340 to 10°. Furthermore, the hue angle between $H^*_{M2}$ and $H^*_{M1}$ ($H^*_{M2}-H^*_{M1}$) is preferably in the range of 2 to 30°. The above hue angle can be measured as in the case of the deep and pale cyan toners.

When $H^*_{M1}$ exceeds 350°, the effects of reducing graininess may be decreased in the low density area. When $H^*_{M1}$ is less than 325°, the effects of reducing graininess may be decreased in the intermediate density area. When $H^*_{M2}$ exceeds 10°, the effects of reducing graininess may be decreased in the intermediate density area. When $H^*_{M2}$ is less than 340°, a sufficient gradation may be not obtained in a high density area. In addition, when ($H^*_{M2}-H^*_{M1}$) is less than 2, the effects of extending the color reproduction range may be decreased. On the other hand, when ($H^*_{M2}-H^*_{M1}$) exceeds 30, the effects of reducing graininess may be decreased.

Next, the matters common to the cyan toner and the magenta toner will be described.

The a*, b*, c*, and L* of the respective toners to be used in the present invention are obtained by forming an appropriate toner-fixed image on a sheet of plain paper and measuring the hue and lightness of the image. An image forming apparatus for the formation of such a toner-fixed image may be a plain paper full-color copying machine which is commercially available (e.g., CLC1150, manufactured by Canon Inc.). In addition, for example, the above plain paper may be "TKCLA 4" for a color laser copying machine, manufactured by Canon Inc. The appropriate toner-fixed image is an image obtained by varying the amount of toner on the paper. For instance, an image with 200 lines and a 16-step gradation (an output image with 16-level gradation formed by the line image having 200 lines per inch, which is similar to the image shown in FIG. 7) can be used.

That is, a toner having the values of a*, b*, c*, and L* that satisfy the limitation defined as the present invention, wherein the fixed image is formed by using the general image forming apparatus under a condition that a preferable image forming can achieved, is regarded as being within the scope of the present invention.

The measuring method is not limited to a specific one as far as it is able to measure at least above a*, b*, and L*. For instance, there is a method in which the SpectroScan Transmission (manufactured by Gretag Macbeth) is used as a measuring device. The typified measuring conditions of an observation include illumination type: D50, standard view: 2°, density: DIN NB, white base: Pap, and filter: absence.

Figure 3:
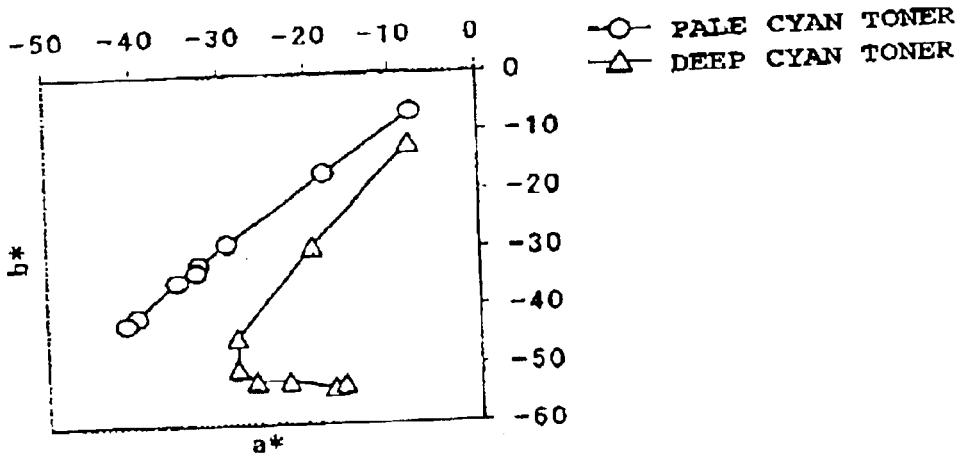
FIG. 3 is a graph that represents an example of the hue curve of a cyan toner to be used in the present invention.
Figure 5:
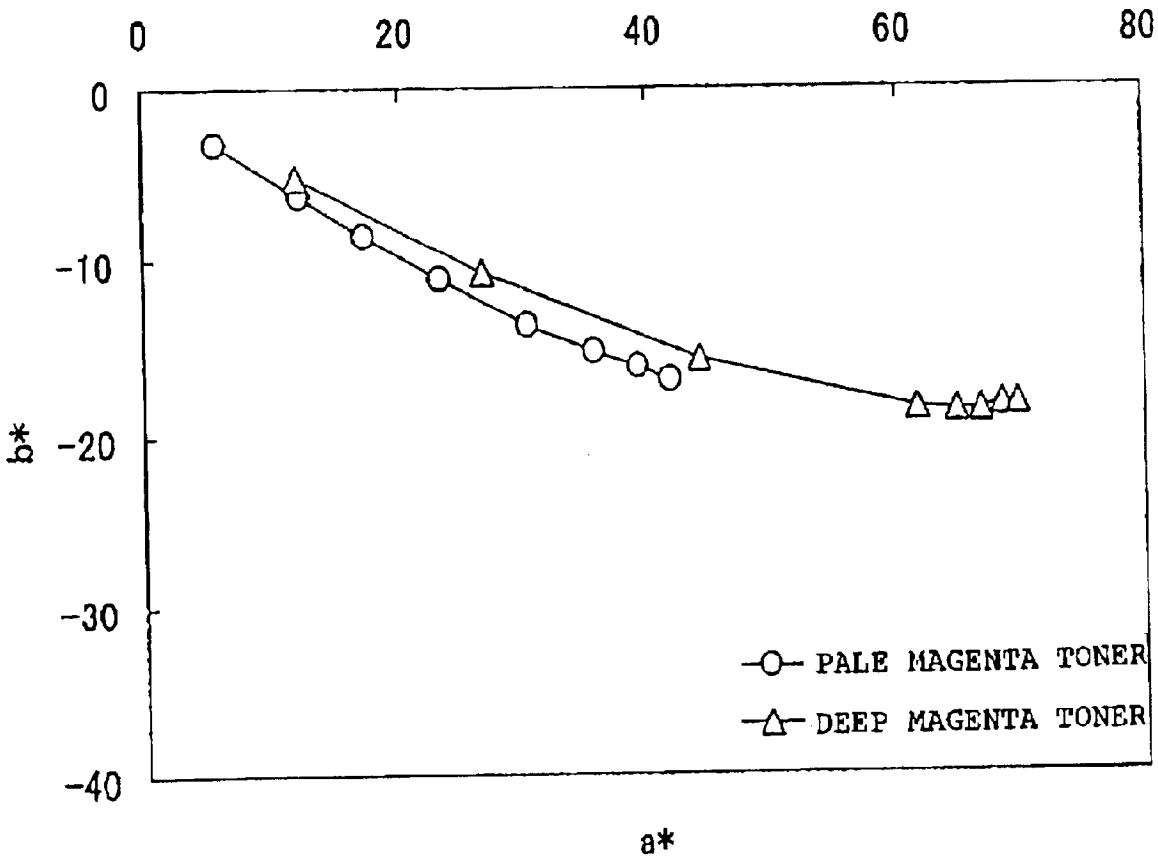
FIG. 5 is a graph that represents an example of the hue curve of a magenta toner to be used in the present invention.

An a*-b* coordination graph is prepared by plotting the values of a* and the values of b* obtained by the measurement on the above toner-fixed image such that a* is on the horizontal axis and b* is on the vertical axis. From the a*-b* coordination graph, the values of a* are obtained when b* is −20 and −30. The typical measuring results are shown in FIG. 3 and FIG. 5, respectively.

Figure 4:
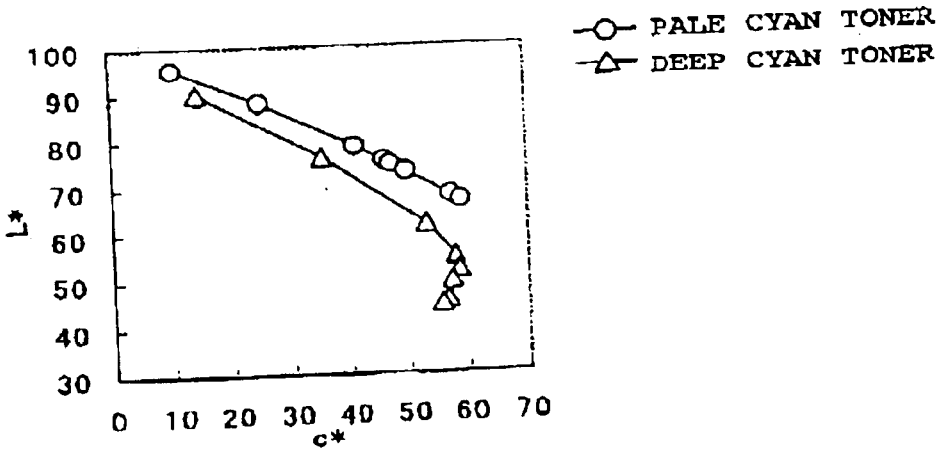
FIG. 4 is a graph that represents an example of the color saturation and lightness curve of a cyan toner to be used in the present invention.
Figure 6:
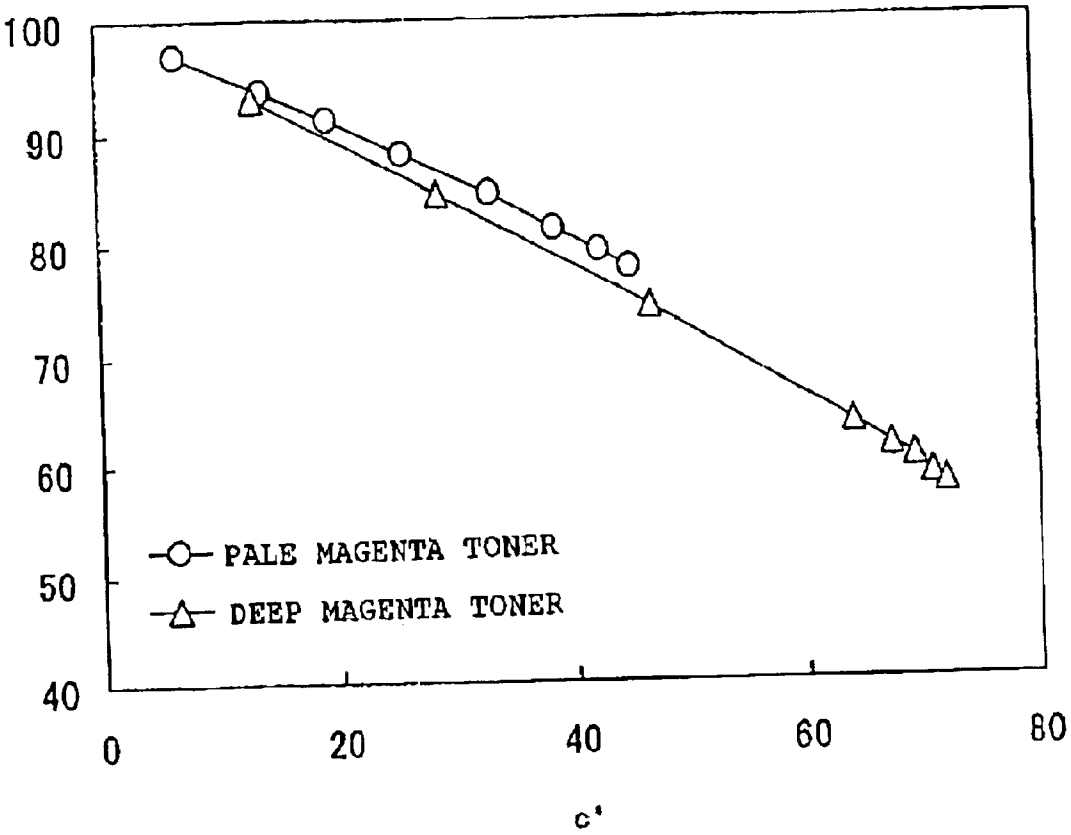
FIG. 6 is a graph that represents an example of the color saturation and lightness curve of a magenta toner to be used in the present invention.

Furthermore, a c*-L* coordination graph is prepared by plotting the values of c* and L* obtained from the above a*-b* coordination graph and the above equation such that c* is on the horizontal axis and L* is on the vertical axis. From the c*-L* coordination graph at this time, the value of L* is obtained when c* is 30. The typical results of the measurement are shown in FIG. 4 and FIG. 6, respectively.

In the present invention, colorants which can be used in pale cyan toner and deep cyan toner include copper phthalocyanine compounds and derivatives thereof, anthraquinone compounds, and base dye lake compounds. In particular, preferable specific colorants include C.I. pigment blue 1, 7, 15, 15:1, 15:2, 15:3, 15:4, 60, 62, and 66. In addition to the colorants mentioned above, colorants, which can be used in pale cyan toner and deep cyan toner, may further include colorants of other colors such as yellow colorants and magenta colorants described later. Mixing these colorants allows the adjustments of a*, b*, c*, and L*, respectively.

In the present invention, colorants, which can be used in pale magenta toner and deep magenta toner, include condensed azo compounds, diketo pyrrolo pyrrol compounds, anthraquinone, quinacridone compounds, base dye lake compounds, naphthol compounds, benzimidazolone compounds, thioindigo compounds, and perylene compounds. In particular, the colorants which can be preferably used include C.I. pigment red 31, 48:1, 48:2, 48;3, 48:4, 57:1, 88, 95, 144, 146, 150, 177, 202, 214, 220, 221, 254, 264, 269, and C.I. pigment violet 19. In addition to the colorants mentioned above, colorants, which can be used in pale magenta toner and deep magenta toner, may further include colorants of other colors such as yellow colorants and cyan colorants described later. Mixing these colorants allows the adjustments of a*, b*, c*, and L*, respectively.

Each of these colorants can be used independently or in combination with one or more other colorants listed above. In addition, it can be also used in a state of solid solution. The colorant is selected in terms of hue angle, color saturation, lightness, weatherability, OHP transparency, and dispersability into toner particles. A preferable colorant of the present invention is a pigment. A preferable amount of a colorant to be added in the toner of the present invention depends on the kind of the colorant to be used, and so on. In each of the pale cyan toner and the pale magenta toner, it is preferably in the range of 0.4 to 1.5% by mass with respect to the total amount of the toner. For each of the deep cyan toner and the deep magenta toner, it is preferably in the range of 2.5 to 8.5% by mass with respect to the total amount of the toner.

In the present invention, for obtaining an image which is superior in gradation without causing graininess from a low density area to a high density area by developing a minute latent image faithfully, the weight average particle diameter (Da) of each the above pale toners (cyan and magenta) is preferably in a range of 3 to 9 μm and the weight average particle diameter (Db) of each the above deep toners (cyan and magenta) is also preferably in the range of 3 to 9 μm. When the particle diameters Da and Db are in the above range, a decrease in transfer efficiency is little and fogs and uneven irregularities on an image to be caused by poor transfer are hardly occurred.

In the present invention, for obtaining a higher definition image which is superior in gradation without causing graininess from a low density area to a high density area, the ratio between the above Da and Db (Da/Db) is preferably in the range of 1.0 to 1.5, more preferably in the range of 1.05 to 1.4. The weight average particle diameters Da and Db can be adjusted by the method of manufacturing toner particles, such as a polymerization method, respectively. In addition, they can be also adjusted by the classification of the obtained toner particles and the mixing of classified products.

The average particle diameter and particle diameter distribution of the toner particles can be measured by the methods well known in the art, respectively. In the present invention, the measurement may preferably be performed using a measuring device such as the Coulter counter TA-II or the Coulter multisizer (manufactured by Coulter, Co., Ltd.).

In such a measuring method, there are used a measuring device such as the Coulter counter TA-II or the Coulter multisizer (both manufactured by Coulter, Co., Ltd.), which is connected to an interface (manufactured by Nikkaki Co, Ltd.) and a personal computer (PC9801, manufactured by Nippon Electric Co., Ltd.) for the outputs of number-based distribution and volume-based distribution in addition to the use of an electrolyte. The electrolyte may be a 1% NaCl aqueous solution prepared using primary sodium chloride, such as ISOTON R-II (manufactured by Coulter Scientific Japan, Co., Ltd.).

Here, the method will be concretely described. At first, 0.1 to 5 ml of a surfactant (preferably, alkyl benzene sulfonate) is added as a dispersant in 100 to 150 ml of the above electrolytic solution, followed by the addition of 2 to 20 mg of a measuring sample. Then, the contents of the electrolytic solution are dispersed for about 1 to 3 minutes using an ultrasonic dispersing device, and are then subjected to the above measuring device. For instance, the Coulter counter TA-II using an aperture of 100 μm is used for the measurement. The volume-based distribution and number-based distribution of toner particles are calculated by measuring the volume and number of the toner particles having particle diameters of 2 μm or more. Subsequently, the weight average particle diameter (D4) and the number average particle diameter (D1) are calculated on the basis of the resulting volume-based distribution and number-based distribution, respectively.

Each of the pale and deep cyan toners and the pale and deep magenta toners comprises well-known toner materials such as a binder resin, a release agent, and a charge control agent in addition to the above colorant.

In the present invention, the charge control agent is used for appropriately adjusting the charging characteristics of each of the pale toners (cyan and magenta) and deep toners (cyan and magenta). Furthermore, the charging characteristics of the pale and deep toners can be also adjusted by selecting the kinds of other toner materials and controlling the frictional electrifications of the toners at the time of an image formation, respectively.

The charge control agent to be used in the present invention may be selected from those well known in the art. In particular, the charge control agent is preferably a transparent charge control agent capable of charging the toner particles at a high speed and reliably retaining a constant amount of electric charge of the toner. Furthermore, in the case of preparing toner particles by means of a polymerization method, it is particularly preferable to use a charge control agent having no inhibitory effect on the polymerization and no component soluble in water system. Applicable charge control agents include negative charge control agents and positive charge control agents.

The negative charge control agents include salicylic acid metal compounds, naphthoic acid metal compounds, dicarboxylic acid metal compounds, highly polymerized compounds having sulfonic acid or carboxylic acid on the side chains thereof, boron compounds, urea compounds, silicon compounds, and calixarene. The positive charge control agents include quaternary ammonium salts, highly polymerized compounds having quaternary ammonium salts on the side chains thereof, guanidine compounds, and imidazol compounds. The content of the charge control agent is preferably in the range of 0.5 to 10 parts by mass with respect to 100 parts by mass of the binder resin.

In the present invention, the above pale toners (cyan and magenta) and the above deep toners (cyan and magenta) preferably comprise the charge control agents, respectively. The ratio (Ca/Cb) between the content of the charge control agent in the pale toner (Ca) and the content of the charge control agent in the deep toner (Cb) is preferably in the range of 0.5 to 1.0, more preferably in a range of 0.60 to 0.95. The charging speed of the deep toner tends to become slow, compared with the charging speed of the pale toner. Therefore, the charge characteristics of both toners are controlled almost the same level by increasing the content of the charge control agent in the deep toner, so that more effects of inhibiting the graininess of the intermediate density area can be obtained. In the present invention, each of the above deep toners (cyan and magenta) provides a preferable optical density of in a range of 1.5 to 2.5 for a solid image having a toner amount of 1 mg/cm$^2$ on a sheet of paper. On the other hand, each of the pale toners (cyan and magenta) provides a preferable optical density of in a range of 0.82 to 1.35 for a solid image having a toner amount of 1 mg/cm$^2$ on a sheet of paper. When the above optical densities are within the respective ranges, an increase in the amount of toner consumption can be prevented and a high quality image can be efficiently obtained. It is possible to adjust the optical density of the toner by controlling the physical properties of the toner from the development to the fixation, such as the coloring power, developing characteristics, and charging characteristics with the selection of toner materials to be used, the method for manufacturing the toner, the process of an image formation, and so on.

In the present invention, from a point of view to improve the transfer efficiency, the pale toners (cyan and magenta) and the deep toners (cyan and magenta) preferably comprises inorganic fine powders selected from the group including titania, alumina, silica, and double oxides thereof. In addition, the ratio (Sa/Sb) between the specific surface area (Sa) of the pale toner and the specific surface area (Sb) of the deep toner, which are measured by the BET method, is preferably in the range of 0.5 to 1.0, more preferably in the range of 0.6 to 0.95. When the value of Sa/Sb is in the above range, the transfer efficiency of the pale toner and the transfer efficiency of the deep toner can be coincident with each other. Consequently, the graininess of the intermediate density area where the toner is present in combination in the image is inhibited more so that a more favorable image can be obtained.

The specific surface area of the toner in the above range can be attained by controlling the specific surface area of toner particles, and the specific surface area, mixing amount, and addition mixing strength of inorganic fine powders to be added in the toner particles. When the addition mixing strength is too strong, the inorganic fine powders are embedded in the toner particles, resulting in a little improvement in transfer efficiency.

The specific surface area of the toner is obtained using a specific surface area measuring device (e.g., Autosorb-1, manufactured by Yuasa Ionics Co., Ltd.) by which nitrogen gas is absorbed on the surface of the sample to the measurement with the BET multiple point method. A 60% pore radius is obtained from a percentage curve of multiplication pore area with respect to the pore radius on the desorption side. In the Autosorb-1, the distribution of pore radius is calculated using the B.J.H method disclosed by Barrett, Joyner, and Harenda (B. J. H).

The binder resins to be used. In the above pale toner and deep toner may be selected from the binder resins well known in the art.

The resin component to be contained in the toner is preferably one having a peak within the molecular weights ranging from 600 to 50,000 in a molecular weight distribution of a tetrahydrofuran (THF) soluble fraction in the gel permeation chromatography (GPC). Preferably, the binder resin contains a low molecular weight component and a high molecular weight component. In the molecular distribution using the gel permeation chromatography (GPC), the peak of low molecular weight component is preferably in the range of 3,000 to 15,000 for controlling the shape of toner particles, which is manufactured by a pulverization method, by heat and mechanical impact. When the peak of low molecular weight component exceeds a molecular weight of 15,000, an improvement in transfer efficiency tends to be insufficient. When the peak of low molecular weight component is less than a molecular weight of 3,000, the toner particles tend to be fused with each other at the time of a surface treatment on the toner particles.

The molecular weight of each component described above is measured using the GPC. As a concrete measuring method using the GPC, for example, there is a method in which the Soxhlet extractor is used for extracting a toner with tetrahydrofuran (THF) for 20 hours in advance, and the obtained extracted solution is used as a sample and is then subjected to the measurement of molecular weight distribution using the calibration curve of a standard polystyrene resin with a column configuration in which A-801, 802, 803, 804, 805, 806, and 807 (manufactured by Showa Denko, Co., Ltd.) are connected with one another.

In the present invention, preferably, the binder resin has a ratio (Mw/Mn) of 2 to 100, where Mw is a mass average molecular weight and Mn is a number average molecular weight.

In the present invention, preferably, each of the pale toners (cyan and magenta) and the deep toners (cyan and magenta) has a grass transition point (Tg) of 50° C. to 75° C., more preferably 52° C. to 70° C. in terms of the fixing ability and the preservative quality.

The measurement of the glass transition point of each toner can be conducted using a differential scanning calorimeter in the type of a high precision input compensation with an internal combustion, such as DSC-7 manufactured by Perkin Elmer Ink. The measuring method is performed based on the ASTM D3418-82. In the present invention, a DSC curve is used. That is, the sample is heated one time to take a previous history, followed by rapid cooling. Then, the sample is heated again from 0° C. to 200° C. at a temperature rate of 10° C./min, allowing the measurement of the DSC curve.

The binder resins to be used in the present invention include; polystyrene; monopolymers of styrene deravatives such as poly-p-chlorostyrene and polyvinyl toluene; styrene copolymers such as styrene-p-chlorostyrene copolymer, styrene-vinyl toluene copolymer, styrene-vinyl naphthalene copolymer, styrene-acrylic ester copolymer, styrene-metacrylic ester copolymer, styrene-α-chloromethacrylic methyl copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; and polyvinyl chloride; phenolic resin; natural denatrured phenolic resin; natural resin denatured maleic acid resin; acrylic resin; methacrylic resin; poly vinyl acetate; silicone resin; polyester resin; polyurethane; polyamide resin; furan resin; epoxy resin; xylene resin; polyvinyl butyral; terpene resin; coumarone-indene resin; and petroleum resin. A cross-linked styrene resin is also included as a preferable binder resin.

Co-monomers for styrene monomers of the styrene copolymers maybe vinylmonomers including; monocarboxylic acids having double bonds and derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having double bonds and derivatives thereof such as maleic acid, butyl maleate, methyl maleate, and dimethyl maleate; vinyl esters such as vinyl chloride, vinyl acetate, and vinyl benzoate; ethylene olefins such as ethylene, propylene, and butylene; vinyl ketones such as vinyl methyl ketone, and vinyl hexyl ketone; and vinyl ethers such as vinyl methyl ether, vinyl ethyl ether, and vinyl isobutyl ether. Each of these monomers can be used independently or in combination with one or more other monomers listed above.

The above binder resin may be cross-linked with a cross-linking agent. The cross-linking agent to be used is a compound having two or more polymerizable double bounds. The cross-linking agents applicable in the present invention include: aromatic divinyl compounds such as divinyl benzene and divinyl naphthalene; carboxylic acid esters having two double bounds per molecule such as ethylene glycol diacrylate, ethylene glycol dimethacrylate, and 1,3-butane diol dimethacrylate; divinyl compounds such as divinyl aniline, divinyl ether, divinyl sulfide, and divinyl sulfone; and compounds having three or more vinyl groups per molecule. Each of these compounds can be used independently or in combination with one or more other compounds listed above.

In the present invention, in terms of improving the ability of releasing from a fixing member at the time of fixation and the fixing ability, waxes (release agents) may be preferably contained in toner particles. Such waxes include paraffin waxes and derivatives thereof, microcrystalline waxes and derivatives thereof, Fischer-Tropsch waxes and derivatives thereof, polyolefin waxes and derivatives thereof, and carnauba waxes and derivatives thereof. These derivatives include oxide, block copolymer with vinyl monomers, and graft modified products.

Furthermore, other waxes applicable in the present invention may include long-chain alcohols, long-chain fatty acids, acid amides, ester wax, ketone, hydrogenated castor oil and derivatives thereof, vegetable waxes, animal waxes, mineral waxes, and petrolatum.

Each of the pale and deep cyan toners and the pale and deep magenta toners can be prepared by the method well known in the art. As such a manufacturing method, for example, there is a pulverizing method in which additives such as a binder resin, a wax, and a colorant such as pigment or dye, and also a charge control agent when required are sufficiently mixed together by a mixer such as a Henschel mixer or a ball mill, followed by dissolving and kneading the resulting mixture by a thermal kneading machine such as a heating roller, a kneader, or an extruder. In addition, in the case of bringing a pigment or the like into the mixture afterward, a material such as a pigment is added in the dissolved mixture as needed. Then, the mixture is cooled and solidified, followed by pulverizing and classifying to form toner particles. In the step of classification, it is preferable to use a multi-fraction classifier in terms of an increase in production efficiency.

Furthermore, methods applicable to the process of manufacturing each of the pale and deep cyan toners and the pale and deep magenta toners include: for example, each of methods disclosed in JP 56-13945 B and so on, in which disks or multi-fluid nozzles are used to atomize a dissolved mixture into the air to form spherical toner particles; and each of methods disclosed in JP 36-10231 B, JP 59-53856 A, and JP 59-61842 A, in which toner particles are directly obtained using a suspension polymerization; dispersion polymerization method in which toner particles are directly obtained using an aqueous organic solvent in which a monomer is soluble but a polymer to be obtained is insoluble, emulsion polymerization methods typified by a method of a soap free polymerization that generates toner particles by means of a direct polymerization in the presence of a water-soluble polar polymerization initiator.

A preferable method of manufacturing each of the pale and deep cyan toners and the pale and deep magenta toners is a suspension polymerization method. Furthermore, another preferable method is a seed polymerization method in which the polymer particles being obtained is further subjected to the step of a polymerization with monomers absorbed on the polymer particles using a polymerization initiator.

Furthermore, it is preferable to provide the toner particles with a polar resin such as a styrene-(meth)acrylate copolymer, styrene-maleate copolymer, or a saturated polyester resin.

The suspension polymerization method comprises: adding additives such as a release agent which is a material having a low softening point, a colorant, a charge control agent, and a polymerization initiator in a polymeric monomer; uniformly dissolving or dispersing the additives by a dispersing device such as a homogenizer or an ultrasonic dispersing device to generate a polymeric monomer composition; dispersing the polymeric monomer composition into an aqueous phase containing a dispersion stabilizing agent by a normal stirrer, a homogenizing mixer, or a homogenizer to generate and polymerize droplet particles of the polymeric monomer composition in the aqueous phase, optionally followed by filtration, washing, drying, classification, and so on.

In the suspension polymerization method described above, a stirring time and a stirring speed are adjusted to pulverize the droplets of the polymeric monomer composition such that the particle diameter of pulverized particles corresponds to the particle diameter of desired toner particles. Thereafter, stirring may be performed to an extent that the particle state is maintained owing to the action of the dispersion stabilizing agent, and the precipitation of particles is prevented. In this case, the polymerization temperature is 40° C. or more, generally in the range of 50 to 90° C.

Each of the pale and deep cyan toners and the pale and deep magenta toners may be a one-component developer or a two-component developer. The one-component developer is prepared by mixing the toner particles obtained as described above and external additives such as inorganic fine powders. A two-component developer includes a mixture of the toner particles generated as described above, external additives such as inorganic fine powders, and a carrier.

The inorganic fine powders to be used in the present invention are those well known in the art. In terms of improving the property of toner, such as charge stability, developing performance, flowability, and storage stability, the inorganic fine powders to be used in the present invention may be preferably selected from silica fine powders, alumina fine powders, titania fine powders, and double oxides thereof. Particularly, silica fine powders are preferable.

The silica may be dry silica or wet silica. The dry silica can be prepared by a vapor phase oxidation of silicon halides or alcoxides and the wet silica can be prepared from alcoxides, water glasses, or the like. Preferably, dry silica contains a small number of silanol groups on the surface thereof or in the inside of silica fine powders and a small amount of manufacturing residue such as $Na_2O$ or $SO_3^{2-}$. The dry silica may be complex fine powders of silica and other metal oxide compounds, which can be obtained using a metal halide such as aluminum chloride or titanium chloride together with a silicon halide.

For obtaining favorable results, the inorganic fine powders to be used in the present invention may have a specific surface area of 30 $m^2/g$ or more, preferably in the range of 50 to 400 $m^2/g$ with nitrogen adsorption measured by the BET method. In addition, the amount of the inorganic powders to be added to the toner is in the range of 0.1 to 8 parts by mass, preferably 0.5 to 5 parts by mass, and more preferably 1.0 to 3.0 parts by mass with respect to 100 parts by mass of the toner particles.

It is preferable that each of the inorganic fine powders to be used in the present invention has a primary particle diameter of 30 nm or less.

It is preferable that the inorganic fine powders to be used in the present invention are treated with one or more kinds of processing agents for obtaining hydrophobic properties, charge-controlling ability, and so on as needed. The processing agents include silicone varnish, various kinds of denatured silicone varnishes, silicone oil, various kinds of denatured silicone oils, a silane coupling agent, a silane coupling agent having a functional group, other organic silicon compounds, and organic titanium compounds. Two or more processing agents may be used in combination.

For attaining a low toner consumption and a high transfer rate while retaining a high amount of charging, it is more preferable that the inorganic fine powders are treated with at least silicone oil.

The inorganic fine powders are preferably treated with a specific coupling agent while hydrolyzing the specific coupling agent in the presence of water. Uniform hydrophobic treatment can be performed in water. There is no aggregation between the particles and the charge repulsion can be caused between the particles as a result of the hydrophobic treatment. In addition, the inorganic fine particles are subjected to a surface treatment while being almost kept in primary particles. Therefore, it is very effective in terms of stabilizing the charge of toner and providing flowability for toner. The preferable inorganic fine powders are silica, titanium oxide, or alumina, for example, which are treated with a specific coupling agent while hydrolyzing the specific coupling agent in the presence of water. Each of such fine powders has an average particle diameter of 0.01 to 0.2 $\mu$m, a hydrophobic degree of 20 to 98%, and an optical transmittance of 40% or more at wavelength of 400 nm.

In the method of treating the surface of the toner particles with a coupling agent while hydrolyzing the coupling agent in the presence of water, there is no need to use another kind of a coupling agent such as one selected from chlorosilane and silazanes, which tends to be gasified since a mechanical force is exerted for dispersing inorganic fine powders into primary particles, while it is possible to allow the parallel use of a high-viscous coupling agent or a silicone oil, which have not been used because of the aggregation of particles.

The coupling agent to be used in the present invention is a silane coupling agent or a titanium coupling agent. In particular, the silane coupling agent is preferably used as a coupling agent and represented by the formula:

$$R_mSiY_n$$

[where R denotes an alkoxy group, m denotes an integer number of 1 to 3, Y denotes a hydrocarbon group such as an alkyl group, a vinyl group, a glycidoxy group, or a methacrylic group, and n denotes an integer number of 1 to 3].

Such a silane coupling agent may be selected from, for example, vinyltrimethoxysilane, vinyltriethoxysilane, γ-methacryloxypropyl trimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyl trimethoxysilane, phenyltrimethoxysilane, n-hexadecyl trimethoxysilane, or n-octadecyl trimethoxysilane.

A more preferable silane coupling agent is one of trialkoxyalkylsilane coupling agents represented by the formula:

$$C_aH_{2a+1}—Si(OC_bH_{2b+1})_3$$

[where a denotes an integer number of 4 to 12 and b denotes an integer number of 1 to 3]

When the "a" is smaller than 4 in the above formula, the hydrophobic treatment becomes easy but the hydrophobic property may be decreased. When the "a" is larger than 12, sufficient hydrophobic property can be obtained while the particles tend to be aggregated together. Furthermore, when the "b" is larger than 3, the reactivity may be decreased. Therefore, the "a" is in the range of 4 to 12, preferably in the range of 4 to 8. In addition, the "b" is in the range of 1 to 3, preferably 1 or 2.

The amount of the above silane coupling agent used in the hydrophobic treatment is in the range of 1 to 50 parts by mass, preferably in the range of 3 to 40 parts by mass with respect to 100 parts by mass of the inorganic fine powders. In this case, the hydrophobic degree is 20 to 98%, preferably 30 to 90%, more preferably 40 to 80%. When the hydrophobic degree is less than 20%, the charging amount tends to be decreased after a long-term leaving under high humidity. When the hydrophobic degree exceeds 98%, the toner tends to be charged up under low humidity.

The particle diameter of the hydrophobic inorganic fine powders obtained by the hydrophobic treatment is preferably in the range of 0.01 to 0.2 $\mu$m in term of an improvement in flowability of toner particles. When the particle diameter is larger than 0.2 $\mu$m, the scattering of toner and fogging tends to be occurred as a result of a decrease in uniformity of toner charging property. When the particle diameter is less than 0.01 $\mu$m, the inorganic fine powders tend to be embedded in the surface of toner particles. As a result, the toner deterioration tends to occur, resulting in a decrease in durability. The particle diameter of the inorganic fine particles means the average particle diameter of toner estimated from the surface electron microscopic observation on the toner particle (for example at a magnification of 20,000 times).

In the present invention, for increasing the transfer ability and the cleaning ability, one of the other preferable embodiments is the addition of inorganic or organic fine particles which are almost spherical, each having a primary particle diameter of more than 30 nm (preferably, a specific surface area of less than 50 $m^2/g$), more preferably 50 nm or more (preferably, a specific surface area of less than 30 $m^2/g$) in addition to the above inorganic fine particles. Such generally spherical fine particles are preferably spherical silica particles, spherical polymethylsilsesquioxane particles, or spherical resin particles.

In the present invention, within the range in which no substantial adverse effect is provided, other additives may be used. Such other additives include: lubricant powders such as fluororesin powders, zinc stearate powders, calcium stearate powders, and polyvinylidene fluoride powders; abrasives such as cerium oxide powders, silicon carbide powders, and strontium titanate powders; flowability-imparting agents such as aluminum oxide powders; caking inhibitors; electroconductivity-imparting agents such as carbon black powders, zinc oxide powders, and tin oxide powders; and organic fine particles and inorganic fine particles having their own polarities opposite to the polarity of toner particles.

The particle diameter of the above additive is preferably of 1/10 or less of the weight average particle diameter of the toner particles in terms of durability when mixed with the toner particles. Here, the term "particle diameter" of the additive means the average particle diameter of toner particles obtained by an electro microscopic observation on the surface of the toner particles (for example, at a magnification of 20,000 times).

The amount of the additive to be used is preferably in the range of 0.01 to 10 parts by mass, more preferably in the range of 0.05 to 5 with respect to 100 parts by mass of toner particles. Such an additive may be used independently or in combination with one or more additives listed above. More preferably, the additive is subjected to a hydrophobic treatment.

An external additive coverage on the surface of toner particles is preferably in the range of 5 to 99%, more preferably in the range of 10 to 99%. The external additive coverage on the surface of toner particles can be obtained using the Field Emission Scanning Electron Microscope (FE-SEM) S-800 (manufactured by Hitachi, Ltd.). That is, 100 images of toner particles (e.g., at a magnification of 20,000 times) are sampled at random. Then, image information on each image is introduced into an image analyzer (Luzex 3, manufactured by Nireco Co., Ltd.) through an interface, followed by analyzing the information to calculate the external additive coverage on the surface of toner particles.

Furthermore, as the carrier described above to be used in the invention, any of the carriers well known in the art can be used. Such carriers include a carrier made of a magnetic material, a carrier in which the surface of a magnetic material is covered with a resin, and a carrier in which a magnetic material is dispersed in resin particles. Furthermore, as the above magnetic material, a well-known magnetic material mainly containing iron oxide can be used. For instance, the above resin may be one of the binder resins described above.

In the method for forming an image for forming an image of the present invention described later, for preparing yellow toner or black toner to be used in the formation of a full-color image, magenta toner to be used in combination with deep and pale cyan toners, or cyan toner to be used in combination with deep and pale magenta toners, the binder resin, the charge control agent, and so on can be used, except the use of a different colorant. In addition, the deep and pale cyan toners and the deep and pale tones may be property used in combination with each other.

The yellow colorants to be used include compounds typified by condensed azo compounds, isoindolinone compounds, anthraquinone compounds, azo metal complexes, methine compounds, and allyl amide compounds. Specifically, C.I. pigment yellow 12, 13, 14, 15, 17, 62, 74, 83, 93, 94, 95, 97, 109, 110, 111, 120, 127, 128, 129, 147, 168, 174, 176, 180, 181, and 191 can be preferably used as a yellow colorant.

The magenta colorants to be used may include C.I. pigment red 2, 3, 5, 6, 7, 23, 81:1, 166, 169, 184, 185, and 206, in addition to the deep and pale magenta toners.

Black colorants include carbon black and colorants toned to black using the above yellow, magenta, and cyan colorants.

Those colorants can be used independently or in combination, or used in the state of a solid solution. An appropriate colorant can be selected from those described above in terms of hue angle, color saturation, lightness, weatherability, OHP transparency, and dispersibility into the toner particles. The amount of the colorant to be added in the toner particles varies depending on the kind of the colorant, but is preferably in the range of 1 to 20 parts by mass with respect to 100 parts by mass of the binder resin.

As the black colorant, any magnetic material well known in the art can be used. Such a magnetic material may be a metal oxide containing an element such as iron, cobalt, nickel, copper, magnesium, manganese, aluminum, or silicon. Of those magnetic materials, a preferable magnetic material mainly includes iron oxide such as triiron tetroxide or $\gamma$-iron oxide. The magnetic material may contain a metal element such as a silicon element or an aluminum element in terms of controlling the electrostatic properties of the toner. The magnetic material has preferably a BET specific surface area of 2 to 30 $m^2/g$, preferably 3 to 28 $m^2/g$ obtained by a nitrogen adsorbing method. In addition, the magnetic material preferably has a Moh's hardness of 5 to 7.

The magnetic material may be in the shape of octahedron hexahedron, spherical, acerous, squamation, and so on.

Among the shapes, for an increase in the image density, the magnetic material is preferable to be shaped into octahedron, hexahedron, or spherical so as to have a little aeolotropy. The average particle diameter of the magnetic material is preferably in the range of 0.05 to 1.0 μm, more preferably in the range of 0.1 to 0.6 μm, and further more preferably in the range of 0.1 to 0.4 μm.

The amount of the magnetic material to be added into the toner is preferably in the range of 30 to 200 parts by mass, more preferably in the range of 40 to 200 parts by mass, and further more preferably in the range of 50 to 150 parts by mass in terms of 100 parts by mass of the binder resin. When the amount of the magnetic material to be added is less than 30 parts by mass, a decrease in transport ability is observed in a developing device that utilizes a magnetic force to transport the toner. In this case, therefore, there is an uneven appearance on a developer layer on a developer carrier, resulting in a tendency of causing unevenness in the resulting image. Furthermore, there is a tendency of causing a decrease in image density as a result of an increase in tribo of the magnetic toner. On the other hand, there is a tendency of causing a problem in fixing ability when the amount of the magnetic material to be added is more than 200 parts by mass.

Next, we will describe the method of manufacturing toner to be used in the present invention.

In the present invention, using the toner in which part of or the whole of toner particles is prepared using a polymerization method is able to enhance the effects of the present invention. In particular, toner particles in which part of the toner particle surface is prepared using the polymerization method can be obtained such that the surface thereof is considerably smoothed.

Using the toner particles in which a shell portion of a core/shell structure is formed by the polymerization allows an increase in blocking resistance without impairing the excellent fixing ability. Comparing with the polymerized toner as the bulk such as that without a core portion, there is an advantage in that the remaining monomer can be easily removed in the post-treatment step after the step of polymerization.

The main component of the core portion is preferably a material having a low softening point (e.g., wax or release agent described above). A preferable compound is one in which a main maximum peak value of the endothermic peak measured on the basis of the ASTM D3418-8 is in the range of 40 to 90° C. When the maximum peak is less than 40° C. self cohesive power of the material having a low softening point becomes weak and as a result the offset resistance at high-temperature is decreased. On the other hand, a fixing temperature increases as the maximum peak exceeds 90° C.

For measuring the temperature of the maximum peak of the material having a low softening point, for instance, the Perkin-Elmer DSC-7 differential scanning calorimeter (manufactured by Perkin-Elmer, Co., Ltd.) is used. The temperature correction of a device detection part utilizes the melting points of indium and zinc, and the calorimetric correction utilizes the melting heat of indium. The measurement is performed at a temperature elevating rate of 10° C./min by placing the sample on an aluminum pan while preparing an empty pan as a comparative example.

The low softening-point materials to be used may be the waxes described above, including paraffin wax, polyolefin wax, Fischer-Tropsch wax, amide wax, higher fatty acid, ester wax, and derivatives thereof or graft/block compounds thereof.

It is preferable to add 5 to 30 parts by mass of the low softening-point material into toner particles with respect to 100 parts by mass of the binder resin. When the amount of the low softening-point material to be added is less than 5 parts by mass, the removal of the remaining monomer descried above becomes strained. When the amount of the low softening-point material to be added is more than 30 parts by mass, the toner particles tend to be aggregated together at the time of pulverization even in the manufacturing process with a polymerization method. Therefore, the particle diameter distribution of toner particles tends to be broadened. In the core/shell structure, an outer shell resin is used as structural component of the shell portion. Such an outer shell resin includes a styrene-(meth)acrylic copolymer, polyester resin, epoxy resin, and styrene-butadiene copolymer. In the method of directly obtaining a toner by polymerization, monomers which can be preferably used include: styrene; styrene monomers such as o- (m-, p-) methyl styrene and m- (p-) ethyl styrene; ester(meth) acrylatemonomers such as methyl(meth)acrylate, ethyl (meth)acrylate, propyl(meth)acrylate, butyl(meth)acrylate, octyl(meth)acrylate, dodecyl(meth)acrylate, stearyl(meth) acrylate, behenyl(meth)acrylate, 2-ethylhexyl(meth) acrylate, dimethylaminoethyl(meth)acrylate, and diethylaminoethyl(meth)acrylate; and en monomers such as butadiene, isoprene, cyclohexene, (meth)acrylonitrile, and amide acrylate.

Those monomers may be used independently or in combination. Alternatively, as described in the publication, "Polymer Handbook" 2nd Ed., III, p139–192 published by John Wiley & Sons, CO., Ltd., one or more monomers are appropriately mixed and used for polymerization such that a theoretical glass transition temperature (Tg) described in such a publication is in the range of 40 to 75° C. When the theoretical glass transition temperature (Tg) is less than 40° C., a problem is caused in terms of the storage stability of toner or the endurable stability of developer. On the other hand, when the theoretical glass transition temperature is more than 75° C., the temperature of fixing point is increased. In particular, the color-mixing properties of each color toner are decreased in the case of toners to be used in a full-color image formation, so that the color reproductivity may be decreased. In this case, furthermore, an extensive reduction in transparency of an OHP image may be occurred.

The molecular weight of the outer shell resin is measured using the gel permeation chromatography (GPC). As a specific measuring method using the GPC, there is a method including: extracting a toner with a toluene solvent in a Soxhlet abstractor for 20 hours, followed by removing the toluene by evaporation using a rotary evaporator; washing a remaining product sufficiently with the addition of an organic solvent, in which the low softening-point material can be dissolved but not the outer shell resin, for example chloroform, followed by dissolving in tetrahydrofuran (THF); filtrating a solution dissolved in the THF through a solvent-resistance membrane filter with 0.3 μm in pore diameter; and subjecting the filtrated sample to the measurement using a measuring device (such as Model 150C manufactured by Waters Co., Ltd.). The column configuration to be used in such a measurement includes A-801, 802, 803, 804, 805, 806, and 807 (manufactured by Showa Denko, Co., Ltd.) connected with one another. The molecular weight distribution of toner can be obtained using the calibration curve of a standard polystyrene resin.

In the present invention, it is preferable that the outer shell resin has a number average molecular weight (Mn) of 5,000 to 1,000,000 and a ratio (Mw/Wn) between the number average molecular weight (Mn) and the weight average molecular weight (Mw) of 2 to 100.

In the case of preparing toner particles each having core/shell structure, it is particularly preferable to add a polar resin in addition to the outer shell resin for favorably incorporating a low softening-point material into the outer shell resin. The polar resin to be used is preferably a copolymer of styrene and (meth)acrylic acid, a maleic copolymer, a saturated polyester resin, or an epoxy resin. In particular, a preferable polar resin does not contain in the molecule an unsaturated group which maybe reacted with an outer shell resin or a monomer thereof. If the polar resin contains an unsaturated group, a cross-linking reaction with a monomer that forms the outer shall resin layer occurs. In this case, particularly for a toner to be used for a full-color image formation, the molecular weight of the resulting toner becomes too high and becomes disadvantage for the mixing of four different color toners, which is not preferable.

The toner to be used in the present intention may be prepared such that an outermost shell resin layer is further formed on the surface of toner particles. In this case, the above polar resin may be used as such an outermost shell resin layer.

It is preferable that the glass transition temperature of the above outermost resin layer is designed so as to be equal to or higher than the glass transition temperature of the above outer shell resin layer for further improving the blocking resistance. Also, the polymer which constitutes the outermost resin layer is preferably cross-linked to the extent that the fixing ability is intact. It is preferable that the outermost shell resin layer contains a polar resin or a charge control agent for improving its charging properties.

The method of providing the toner with the above outermost shell layer is not limited to a specific one. For instance, the examples of such a method include (i) a method including; in the latter half or after the completion of the polymerization reaction, preparing in a reaction system a monomer in which a polar resin, a charge control agent, a cross-linking agent, and so on as needed are dissolved and dispersed, followed by absorbing the monomer in polymerization particles; and adding a polymerization initiating agent to allow the polymerization; (2) a method including: adding emulsified polymerization particles or soap free polymerization particles to a reaction system, where these particles are prepared from a monomer containing a polar resin, a charge control agent, a cross-linking agent, and so on as needed; and fixing these particles on the surface of polymerization particles by agglutination and optionally by heating or the like as needed; and (3) a method including; mechanically fixing emulsified polymerization particles or soap free polymerization particles on the surface of toner particles by the dry process, where these particles are prepared from a monomer containing a polar resin, a charge control agent, a cross-linking agent, and so on as needed.

In the present invention, particularly, a preferable method is a suspension polymerization method under normal pressures or under compression, where toner fine particles each having particle diameters of 4 to 8 $\mu$m with a sharp particle diameter distribution can be obtained comparative easily. In the present invention, a concrete example for incorporating the low softening-point material into outer shell resin is a method in which the polarity of the low softening-point material in an aqueous medium is set to be lower than that of the main monomer, followed by adding a small amount of a resin or a monomer having a larger polarity to the aqueous medium, thereby carrying out polymerization. According to such a method, a toner can be obtained which has the so-called core/shell structure in which the low softening-point material is covered with an outer shell resin.

In the above manufacturing method, the distribution of toner particles and the particle diameter thereof can be adjusted by changing the kind of an inorganic salt which is hardly dissolved in water or the kind of a dispersing agent having a protective colloid action, or changing the addition amount of such a substance. Alternatively, the distribution of toner particles and the particle diameter thereof can be adjusted by changing the mechanical device conditions (e.g., the peripheral speed of a rotor, the number of passes, the shape of a stirring blade, the conditions of agitation, and the shape of a container), or the concentration of a solid fraction in an aqueous solution.

As a concrete method of conducting a desired measurement on the cross sectional structure of toner particles, the process may proceed as follows. That is, the toner particles are sufficiently dispersed in an epoxy resin which can be cured at room temperatures, followed by curing under controlled atmosphere at a temperature of 40° C. for two days. The resulting cured product is stained with ruthenium tetraoxide or in combination with osmium tetraoxide as needed. Subsequently, the stained product is cut into a thin-layered sample by means of a microtome having a diamond blade, and is then subjected to a microscopic observation with TEM to perform a desired measurement on the cross sectional structure of the toner. In the measurement on the above cross section, for making contrast between the materials can be enhanced by means of a slight difference in degrees of crystallization between the low softening-point material and the outer shell resin, it is preferable to use a staining method using ruthenium tetraoxide.

Next, the method for forming an image of the present invention will be described.

The method for forming an image of the present invention is a method in which a toner image is formed by overlapping an image formed by a pale cyan toner and an image formed by a deep cyan toner one on top of the other, and/or by overlapping an image formed by a pale magenta toner and an image formed by a deep magenta toner one on top of the other. Such a method is characterized in using the pale cyan toner, the deep cyan toner, the pale magenta toner, and the deep magenta toner, which are described above.

According to such an method for forming an image, the graininess and the roughness from a low density area to a high density area can be decreased, so that at least a cyan image having a higher quality or a magenta image having a higher quality can be formed. In this case, furthermore, a high quality full-color image can be formed.

The method of forming an image includes: (i) the step of forming an electrostatic charge image, which includes the steps of: forming an electrostatic charge image for cyan to be developed with a cyan toner; forming an electrostatic charge image for magenta to be developed with a magenta image; forming an electrostatic charge image for yellow to be developed with a yellow toner; and forming an electrostatic charge image for black to be developed with a black toner; (ii) the step of forming a toner image, which includes the steps of: forming a cyan toner image by developing the electrostatic charge image for cyan with the cyan toner; forming a magenta toner image by developing the electrostatic charge image for magenta with the magenta toner; forming a yellow toner image by developing the electrostatic charge image for yellow with the yellow toner; and forming a black toner image by developing the electrostatic charge image for black with the black toner; and (iii) the step of transferring which includes the step of forming a full-color toner image on a transfer material by transferring the cyan toner image, the magenta toner image, the yellow toner image, and the black toner image on the transfer material, in which a high quality full-color image can be obtained as a result of a decrease in graininess or roughness to be caused by a cyan image or a magenta image when the step of using the cyan toner and/or the magenta toner is divided into the step of using a pale toner and the step of using a deep toner.

The above step of forming the electrostatic charge image is a step in which electrostatic charge images corresponding to toners to be sued in the method for forming an image are independently formed. Each of the electrostatic charge images corresponding to their respective toners in the full-color image formation can be formed by the method well known in the art.

The step of forming the electrostatic charge image includes the step of forming a first electrostatic charge image to be developed with one of a pale cyan toner and a deep cyan toner and the step of forming a second electrostatic charge image to be developed with the other of these cyan toners. Alternatively, the step of forming the electrostatic charge image includes the step of forming a first electrostatic charge image to be developed with one of a pale magenta toner and a deep magenta toner and the step of forming a second electrostatic charge image to be developed with the other of these magenta toners.

The cyan image in the output image is formed on the basis of output signals obtained as follows. That is, just as in the case with other color images, input signals of image density, lightness, and so on of an input cyan image are appropriately computed and corrected depending on gradation etc in the image formation, followed by being converted into output signals. In the present invention, the output signal strength of the pale cyan toner and the output signal strength of the deep cyan toner are predetermined so as to correspond to strength of the input signals, respectively. Then, on the basis of the predetermined output signal strength of each toner, the strength of each cyan toner in the output signal is determined to form the first electrostatic charge image and the second electrostatic charge image. In the case of using the pale and deep magenta toners, furthermore, the same procedures can be applied.

Figure 15:
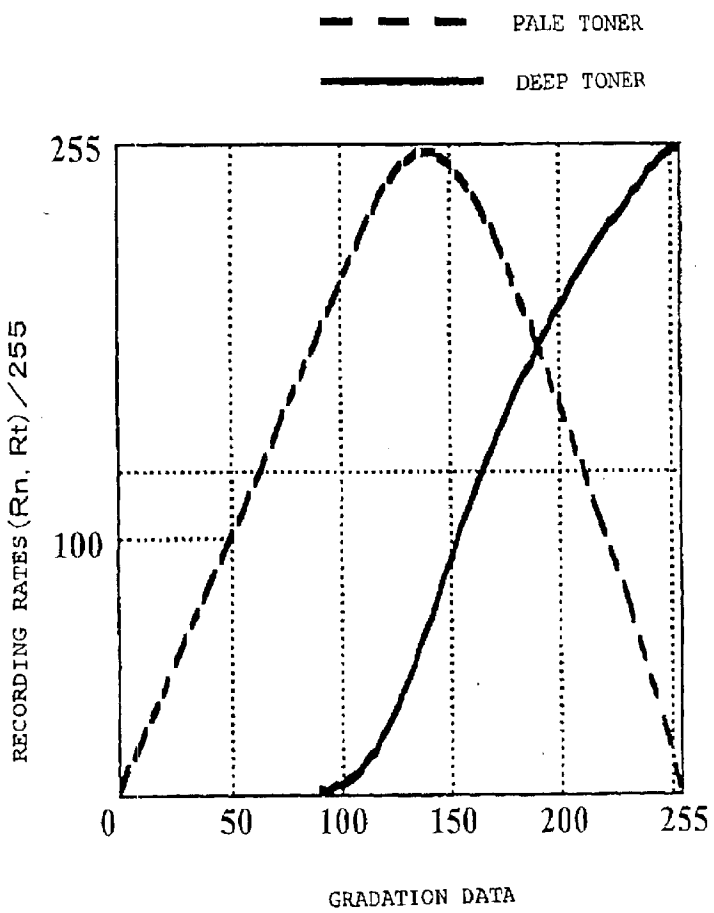
FIG. 15 is a graph that represents the relationship between gradation data and recording rates of a pale cyan toner and a deep cyan toner.

In terms of the setting of the above output signal strength, it is difficult to categorically describe such a setting because of difficulties in simply converting the factors being included, such as visual sense properties of a human, into numerical terms. However, as shown in FIG. 15, it is possible to exemplify the setting such that the output signal strength of the pale cyan toner increases in the area having a small input signal strength and the output signal strength of the deep cyan toner increases as the input signal strength increases.

The above step of forming the toner image is the step of forming a toner image by developing an electrostatic charge image formed on an electrostatic charge image bearing member with a corresponding toner. The step of forming the toner image is performed by the method well known in the art on the basis of the kind of toner to be used or the like using an appropriately selected developing device.

The step of transferring is a step in which each toner image formed on the electrostatic charge image bearing member is transferred from the electrostatic charge image bearing member to a transfer material to forma toner image on the transfer material such that the toner image is in a state where the whole toner images are superimposed together. The transfer of the toner image to the transfer material is not particularly limited. The transfer can be performed by the method well known in the art. The transfer of the toner image to the transfer material may be performed by a method of directly transferring an image from an electrostatic charge image bearing member to a transfer material, or a method of transferring an image from an electrostatic charge image bearing member to a transfer material through an intermediate transfer member. In the method of transferring the image from the electrostatic charge image bearing member to the transfer material through the intermediate transfer member, the transfer step is performed such that a toner image primarily transferred to the intermediate transfer member and a toner image subsequently transferred from the electrostatic charge image bearing member to the intermediate transfer member are overlapped one another.

The toner image on the transfer material is fixed on the transfer material by means of the heat-press fixing device well known in the art. Thus, the step of fixing is preferably the step of heat pressing.

In the present invention, in addition to the above steps, the method may further include the step of cleaning for removing the remaining toner on the electrostatic charge image bearing member therefrom after the transfer, and so on. In the present invention, the method may be a method for forming an image in which an electrostatic charge image corresponding to each toner is formed on one of the electrostatic charge image bearing bodies and the steps of forming and transferring the electrostatic charge image are repeated for each toner. Furthermore, the method may be a method for forming an image in which the steps of forming and transferring the electrostatic charge image are independently performed for each of the electrostatic charge image bearing bodies by using multiple electrostatic charge image bearing bodies corresponding to each toner. Furthermore, in the present invention, the order of toners for performing the steps of: forming an electrostatic charge image; forming a toner image; and transferring the image to a transfer material is not particularly limited.

The electrostatic charge image bearing member to be used in the present invention may have a contact angle of 85° or more (preferably, 90° or more) with respect to water on the surface of the electrostatic charge image bearing member. When the contact angle with respect to water is more than 85°, the transfer rate of the toner image is increased. In this case, the filming of the toner hardly occurs. The contact angle with respect to water on the surface of the electrostatic chare image bearing member can be measured, for example, by using a dropping type contact angle measuring device (manufactured by Kyowa Interface Science, Co., Ltd.).

An example of the preferred aspect of the electrostatic charge image bearing member to be used in the present invention will be now described. As is well known in the art, the electrostatic charge image bearing member to be used in the present invention is composed of a conductive substrate, a photosensitive layer formed on the conductive substrate, and optionally a protective layer (surface layer) In this case, the photosensitive layer may have a layered structure constructed of layers having their respective characteristic functions, such as a charge generation layer and a charge transport layer.

The conductive substrate may be made of a material selected from: metals such as aluminum and stainless steel; plastic materials having coat layers made of alloys such as aluminum alloy and indium oxide-tin oxide alloy; paper and plastic with which conductive particles are impregnated; and plastic having conductive polymers, for example. In addition, the substrate may be shaped like a cylindrical tube or a film. Furthermore, a base layer may be additionally formed on the conductive substrate for improving the adhesion of the photosensitive layer, improving a coating ability, protecting the substrate, covering the defects on the substrate, improving the charge injection from the substrate, protecting the photosensitive layer from electrical destruction.

The base layer is formed of a material such as polyvinyl alcohol, poly-N-vinyl imidazole, polyethylene oxide, ethyl cellulose, methyl cellulose, nitrocellulose, ethylene-acrylic copolymer, polyvinyl butyral, phenolic resin, casein, polyamide, copolymerized nylon, glue, gelatin, polyurethane, or aluminum oxide. The thickness of the base layer is typically in the range of 0.1 to 10 $\mu$m, preferably 0.1 to 3 $\mu$m.

The charge generation layer is prepared by dispersing a charge generation material into an appropriate binder and coating or depositing the binder on the substrate. The charge generation material may be selected from organic materials including azo pigments, phthalocyanine pigments, indigo pigments, perylene pigments, polycyclic quinone pigments, squarium pigments, pyrylium salts, thiopyrylium salts, and triphenyl methane pigments; and inorganic materials such as selenium and amorphous silicon.

The binder resin can be selected from various kinds of binder resins. For instance, such binder resins include polycarbonate resin, polyester resin, polyvinyl butyral resin, polystyrene resin, acrylic resin, methacrylic resin, phenolic resin, silicone resin, epoxy resin, and vinyl acetate resin. The amount of the binder contained in the charge generation layer is 80% by mass or less, preferably 0 to 40% by mass. The charge generation layer preferably has a film thickness of 5 $\mu$m or less, particularly in the range of 0.05 to 2 $\mu$m.

The charge transport layer has functions of receiving charge carriers from the charge generation layer in the presence of an electric field and transporting the charge carriers. The charge transport layer is formed by dissolving a charge transport material and optionally a binder resin as needed in a solvent and coating the entire substrate. The film thickness of the charge transport layer is typically in the range of 5 to 40 $\mu$m.

Charge transport materials applicable to the charge transport layer include: polycyclic aromatic compounds each having structures such as biphenylene, anthracene, pyrene, and phenanthrene on its main chain or side chain; nitrogen-containing cyclic compounds such as indole, carbazole, oxadiazole, and pyrazoline; hydrazone compounds; styryl compounds; and inorganic compounds such as selenium, selenium tellurium, amorphous silicon, and cadmium sulfide.

The binder resins into which these charge transport materials can be dispersed include: resins such as polycarbonate resin, polyester resin, polymethacrylate, polystyrene resin, acrylic resin, and polyamide resin; and organic photoconductive polymers such as poly-N-vinyl carbazole and polyvinyl anthracene.

Furthermore, a protective layer may be formed as a surface layer. Resins to be used as a protective layer include polyester, polycarbonate, acrylic resin, epoxy resin, phenolic resin, or cured products obtained by curing these resins with a curing agent. Each of these compounds may be used independently, or two or more of the resins may be used in combination.

Conductive fine particles may be dispersed in the resin of the protective layer. The examples of the conductive fine particles include fine particles of metals or metal oxides. Preferably, the conductive fine particles include zinc oxide, titanium oxide, tin oxide, antimony oxide, indium oxide, bismuth oxide, titanium oxide coated with tin oxide, indium oxide coated with tin, tin oxide coated with antimony, and zirconium oxide. Each of these compounds may be used independently, or two or more of the compounds may be used in combination.

Typically, for preventing the scattering of incident light by conductive fine particles in the case of dispersing conductive fine particles into the protective layer, it is preferable that the particle diameter of each of conductive fine particles is smaller than the wavelength of the incident light. The particle diameter of each of conductive fine particles to be dispersed in the protective layer is preferably 0.5 $\mu$m or less. The content of conductive fine particles in the protective layer is preferably in the range of 2 to 90% by mass, more preferably in the range of 5 to 80% by mass with respect to the total mass of the protective layer. The film thickness of the protective layer is preferably in the range of 0.1 to 10 $\mu$m, more preferably 1 to 7 $\mu$m.

The coating of the surface layer can be performed by spray coating, beam coating, or dip coating of a resin dispersion.

In the case of using a one-component developing method in the present invention, for attaining a high image quality, it is preferable that the toner be developed by the developing step in which the toner with a layer thickness smaller than the most contiguous distance (between S and D) of toner carrier—electrostatic charge image bearing member is coated on the toner carrier, followed by applying an alternating electric field thereon, thereby performing development.

The surface roughness of the toner carrier to be used in the present invention is preferably in the range of 0.2 to 3.5 $\mu$m in terms of the JIS center line average height (Ra). When the Ra is less than 0.2 $\mu$m, the amount of charges on the toner carrier tends to be increased. Therefore, the developing performance can be easily deteriorated. When the Ra exceeds 3.5 $\mu$m, unevenness tends to be caused on the toner coat layer of the toner carrier. The above surface roughness is more preferably in the range of 0.5 to 3.0 $\mu$m.

Furthermore, it is preferable to provide the toner to be used in the present invention with a high charging ability by adjusting the total charging amount of toner at the time of developing. The surface of the toner carrier is preferably coated with a resin layer in which conductive fine particles and a lubricant are dispersed.

As the conductive fine particles to be contained in the resin layer that covers the surface of the toner carrier, a conductive metal oxide such as carbon black, graphite, or conductive zinc oxide, or a double metal oxide is used. These oxides are used independently, or two or more of the oxides are used in combination. The resins in which the conductive fine particles can be dispersed include phenolic resin, epoxy resin, polyamide resin, polyester resin, polycarbonate resin, polyolefin resin, silicone resin, fluoro resin, styrene resin, and acrylic resin. In particular, thermosetting or photo curing resins are preferable.

For uniformly charging the toner, it is preferable to provide a member for restricting the toner on the toner carrier. In other words, it is preferable to restrict the toner by means of an elastic member to be brought into contact with the toner carrier through the toner. The toner charging member and the transfer member are more preferably brought into contact with electrostatic charge carrier so as to prevent the generation of ozone for environmental conservation.

Figure 10:
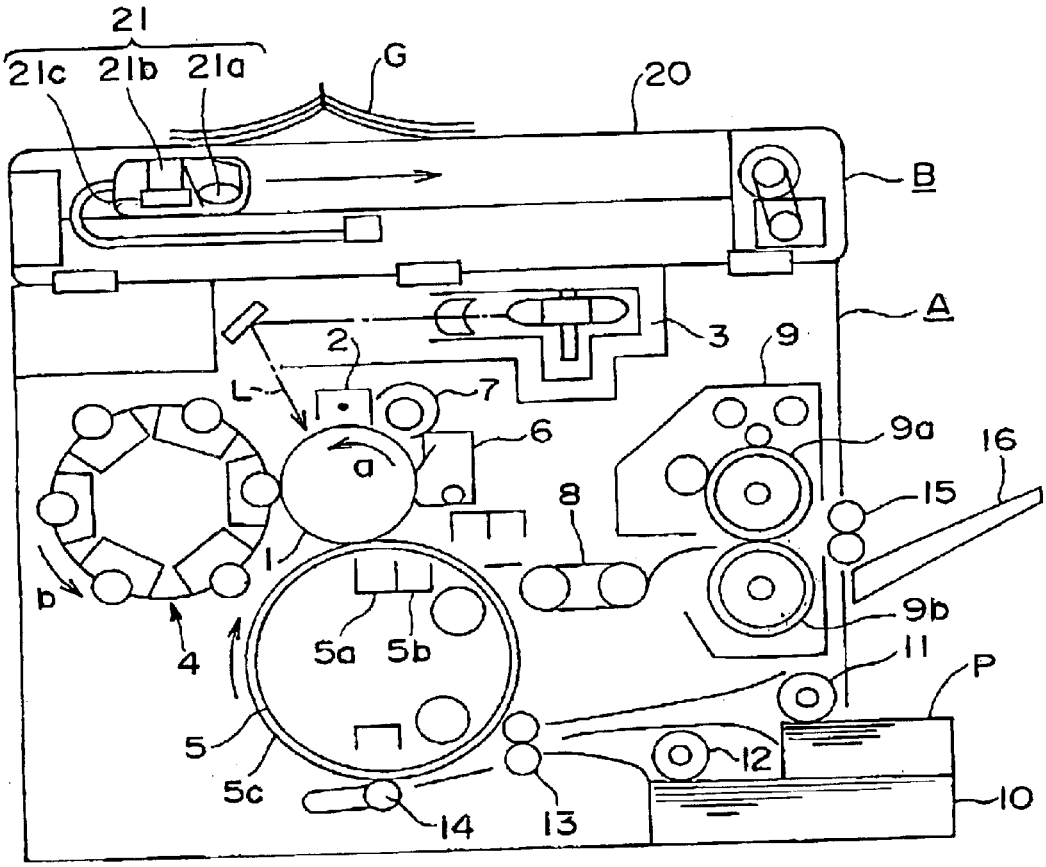
FIG. 10 is a vertical cross sectional view for illustrating an example of a full-color image forming apparatus to be used in the present invention.

Referring now to FIG. 10, the method for forming an image of the present invention is described in a more concrete manner. In FIG. 10, reference symbol "A" denotes a printer part and "B" denotes an image reader part (an image scanner) mounted on the printer part A.

In the image reader part B, reference numeral 20 denotes a document base plate glass being fixed in place. A document G can be placed on the top of the document base plate glass 20 such that the surface of the document to be copied is placed face down, followed by placing a document plate (not shown) thereon. The reference numeral 21 denotes an image reader unit that includes a lamp 21*a* for irradiating the document, a short-focus lens array 21*b*, and a CCD sensor 21*c*.

The image reader unit 21 is able to move forward under the document base plate glass 20 from a home position on the left side of the document base plate glass 20 to the right side thereof along the bottom surface of the glass when a copy button (not shown) is pushed down. After reaching to the predetermined terminal point of the reciprocating movement, the image reader unit 21 moves backward to return to the initial home position.

During the reciprocating movement of the image reader unit 21, the image surface of the document G facing downward placed on the document base plate glass 20 is sequentially illuminated and scanned from the left side to the right side with light irradiated from the lamp 21*a* for irradiating the document. The illuminating and scanning light incident on the image surface of the document is reflected from the image surface. Subsequently, the reflected light is incident on the CCD sensor 21*c* by passing through the short-focus lens array 21*b* to form an image.

The CCD sensor 21*c* is composed of a light receiving portion, a light transmitter, and an output device (not shown). The light receiving portion converts light signals into charge signals, followed by transmitting the charge signals into the output device in sync with clock pulses. In the output device, the charge signals are converted into voltage signals, and are then amplified and modified into those having lower impedance to generate output analog signals. The analog signals thus obtained are converted into digital signals by subjecting the analog signals to the well-known image processing, and are then outputted to the printer part A. In other words, the image information on the document G is read out as electric digital image signals (image signals) by the image reader part B in chronological order in an optoelectronic manner.

Figure 12:
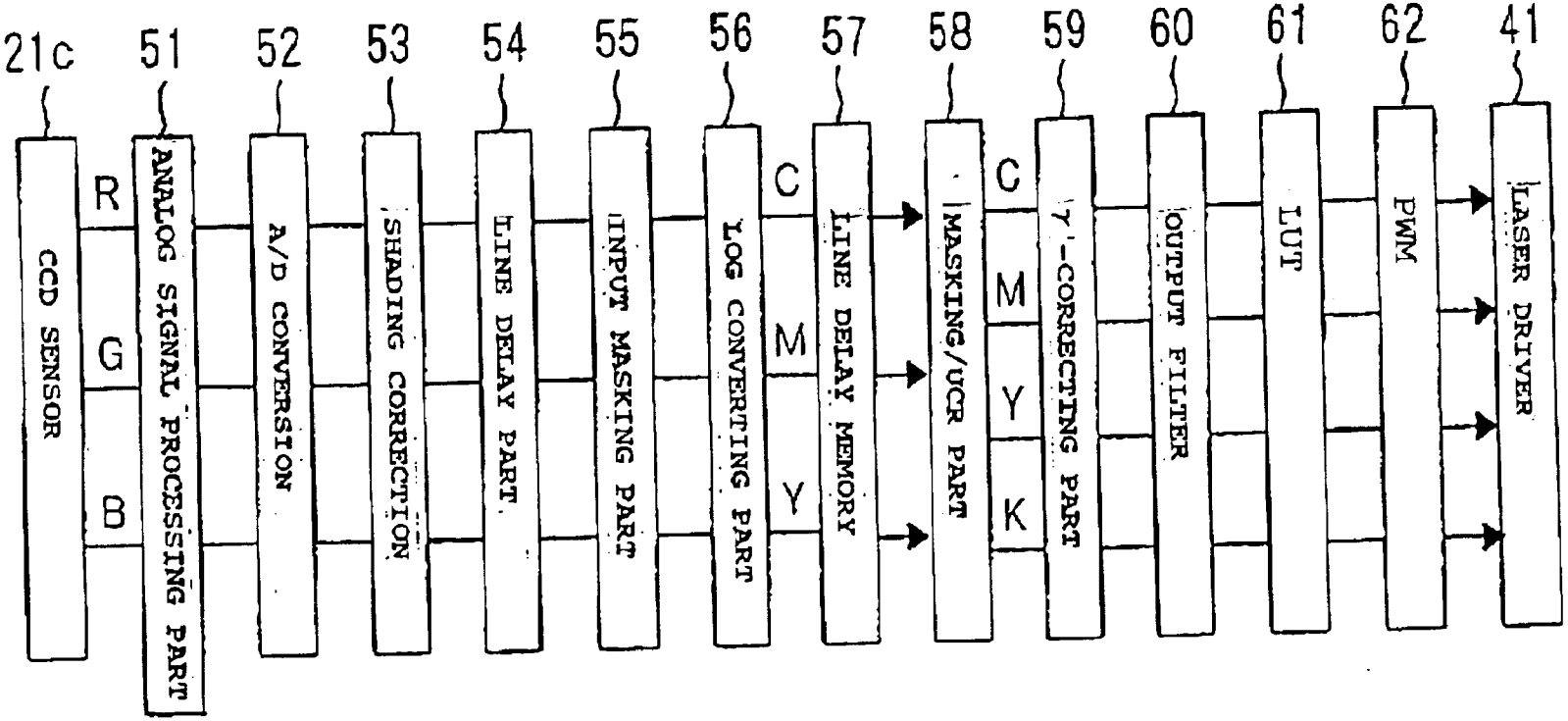
FIG. 12 is a block diagram for illustrating an example of the process of image processing.

Referring now to FIG. 12, there is shown a block diagram that illustrates the steps of image processing. The image signals outputted from the CCD sensor 21*c* are introduced into the analog signal processing part 51, in which the gain and offset of the signal are adjusted. Then, the analog signals are converted into the respective colors. That is, for example, they are converted into RGB digital signals of 8 bits (0 to 255 levels: 256-level gradation) in an A/D converting part 52. In a shading correction part 53, for removing the variations in sensitivities of the respective sensors in the sensor cell group of the CCD sensor aligned in series, the well-known shading correction for optimizing the gain so as to correspond to each of the CCD sensor cells is performed using a signal which is obtained by reading reference white color plate (not shown) for the respective colors.

A line delay part 54 corrects a spatial deviation included in the image signals outputted from the shading correction part 53. This spatial deviation is caused as a result of the arrangement of the respective line sensors of the CCD sensor 21*c* in which the line sensors are arranged with a given distance between the adjacent sensors in the sub-scanning direction. Concretely, the correction of the spatial deviation is performed such that the line delay of each of R (red) and G (green) color component signals is caused in the sub-scanning direction on the basis of the B (blue) color component signal to synchronize the phases of the three color component signals with each other.

An input masking part 55 converts the color space of image signals outputted from the line delay part 54 into the standard color space of NTSC by means of a matrix calculation represented by the following matrix equation. In other words, the color space of each color component signal outputted from the CCD sensor 21*c* is defined by the spectral characteristics of a filter for the corresponding color component. The input masking part 55 converts the color space into a standard color space of NTSC.

$$\begin{bmatrix} R_0 \\ G_0 \\ B_0 \end{bmatrix} = \begin{bmatrix} a_{11} & a_{12} & a_{13} \\ a_{21} & a_{23} & a_{23} \\ a_{31} & a_{32} & a_{33} \end{bmatrix} \begin{bmatrix} R_i \\ G_i \\ B_i \end{bmatrix}$$

(where $R_0$, $G_0$, and $B_0$ denote the respective output image signals, and $R_i$, $G_i$, and $B_i$ denote the respective input image signals) A LOG converting part 56 includes, for example, a look-up table (LUT) constructed of a ROM etc. The LOG converting part 56 coverts RGB luminance signals outputted from the input masking part 55 into CMY density signals, respectively A line delay memory 57 delays the image signals outputted from the LOG converting part 56 by a period equal to the period (line delay) during which control signals UCR, FILTER, SEN, and the like are generated from the outputs of the input masking part 55 by a black character determining part (not shown).

A masking/UCR part 58 extracts black component signals K from image signals outputted from the line delay memory 57. Furthermore, the masking/UCR part 58 conducts the matrix computation for correcting the color turbidity of a recording color material of the printer part on the Y, M, C, and K signals, thereby outputting color component image signals (e.g., 8 bits) in the order of M, C, Y, and K every time the reader part performs a reading operation. It should be noted, the matrix coefficient to be used in the matrix computation is defined by the CPU (not shown).

Next, on the basis of the obtained 8-bit color component image signals (Data), the processing of determining the recording rates Rn, Rt of the respective deep and pale dots is performed with reference to FIG. 15. For instance, when the input gradation data (Data) is 100/255, the recording rate Rt of the pale dot is defined as 250/255 and the recording rate Rn of the deep dot is defined as 40/255. Here, the recording rate is represented by an absolute value such that 255 corresponds to 100%.

A γ-correcting part 59 performs a density correction on image signals outputted from the masking/UCR part 58 so as to match the image signals with which ideal gradation characteristics of the printer part can be obtained. An output filter (a space filter processing part) 60 performs both an edge emphasis and a smoothing processing on the image signals outputted from the γ-correcting part 59 in accordance with the control signals from the CPU.

An LUT 61 is provided for making the density of an original image conform with the density of an output image. For instance, the LUT 61 includes a RM etc. A translation table of the LUT 61 is set by the CPU. A pulse width modulator (PWM) 62 generates a pulse signal having a pulse width corresponding to the level of an input image signal. The pulse signal is inputted into a laser driver 41 that actuates a semiconductor laser (laser source).

Here, a pattern generator (not shown) is mounted on the image forming apparatus, where a gradation pattern is registered so that the signals can be directly passed to the pulse width modulator 62.

Figure 13:
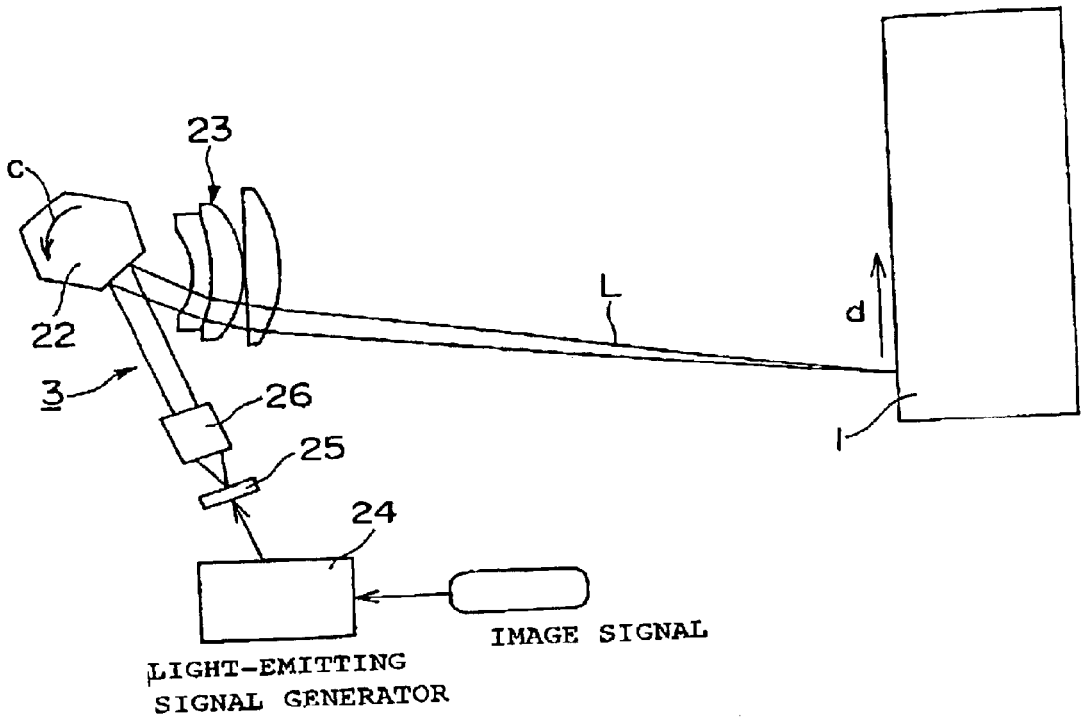
FIG. 13 is a schematic view for illustrating an example of a laser-exposure optical system to be used in the present invention.

FIG. 13 is a schematic view for illustrating an exposure optical device 3. The exposure optical device 3 forms an electrostatic charge image by conducting a laser scanning exposure L on the surface of the electrostatic charge image bearing member 1 on the basis of image signals inputted from the image reader unit 21. When the laser scanning exposure L is performed on the surface of the electrostatic charge image bearing member 1 by the exposure optical device 3, a solid laser element 25 is caused to blink (switched on and off) at a predetermined timing by a light-emitting signal generator 24 on the basis of image signals inputted from the image reader unit 21. Then, laser beams provided as optical signals irradiated from a solid laser element 25 are converted into light flux substantially in parallel by a collimator lens system 26. Furthermore, the electrostatic charge image bearing member 1 is scanned in the direction of the arrow d (longitudinal direction) by a polygonal rotating mirror 22 rotated at a high speed in the direction of the arrow c, such that a laser spot is formed on the surface of the electrostatic charge image bearing member 1 by having the light flux pass through a $f_{\Theta}$ lens group 23 and a reflective mirror (see FIG. 10). Consequently, such a laser scanning movement forms an exposure distribution corresponding to the scanning movement on the surface of the electrostatic charge image bearing member 1. Furthermore, for each of the scanning, an exposure distribution based on the image signals can be formed on the surface of the electrostatic charge image bearing member 1 by vertically scrolling only a predetermined distance for each scanning movement on the surface of the electrostatic charge image bearing member 1.

In other words, the uniform charge surface (for example, being charged to −700 V) of the electrostatic charge image bearing member 1 is scanned by the polygonal rotating mirror 22 which is rotated at a high speed using light emitted from the solid laser element 25, which emits light by being turned on and off based on the image signals. Accordingly, electrostatic charge images of the respective colors corresponding to the scanning exposure patterns are formed on the surface of the electrostatic charge image bearing member 1.

Figure 14:
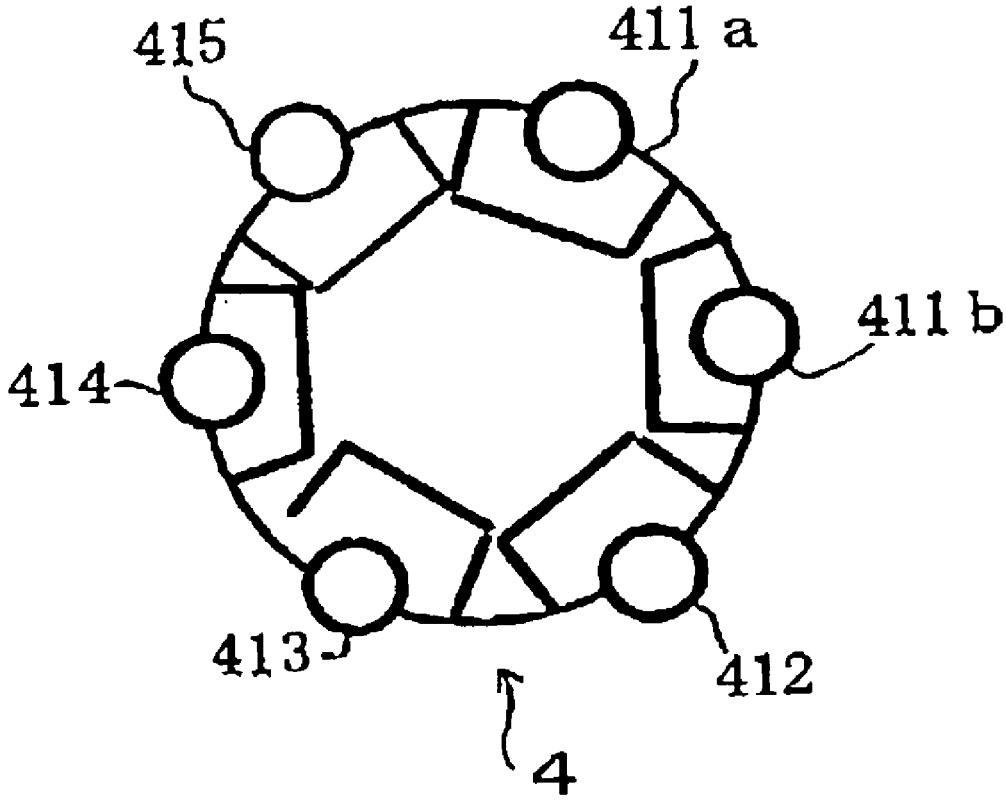
FIG. 14 is a schematic view for illustrating a developing apparatus in the full-color image forming apparatus shown in FIG. 10.

As shown in FIG. 14, the developing apparatus 4 includes developing devices 411*a*, 411*b*, 412, 413, 414, and 415. These developing devices contain a developer having a pale cyan toner, a developer having a deep cyan toner, a developer having a pale magenta toner, a developer having a deep magenta toner, a developer having a yellow toner, and a developer having a black toner, respectively. Each of the developers containing the respective toners develops an electrostatic charge image formed on the electrostatic charge image bearing member 1 by a magnetic blush development system, so that each toner image can be formed on the electrostatic charge image bearing member 1. In the present invention, the deep and pale cyan toners and the deep and pale magenta toners may be used in combination, or only a single magenta toner or a single cyan toner may be used. In the case of using five different kinds of the developers, these developers may be introduced in any developing device selected from six different developing devices described above. In addition, the remaining developing device may have an additional developer for another pale color toner, a specific color toner such as green, orange, or white, a colorless toner without containing any colorant, or the like. Furthermore, the order of colors to be introduced into the respective developing devices is not considered. As these developing devices, a two-component developing device shown in FIG. 11 is one of preferable examples.

Figure 11:
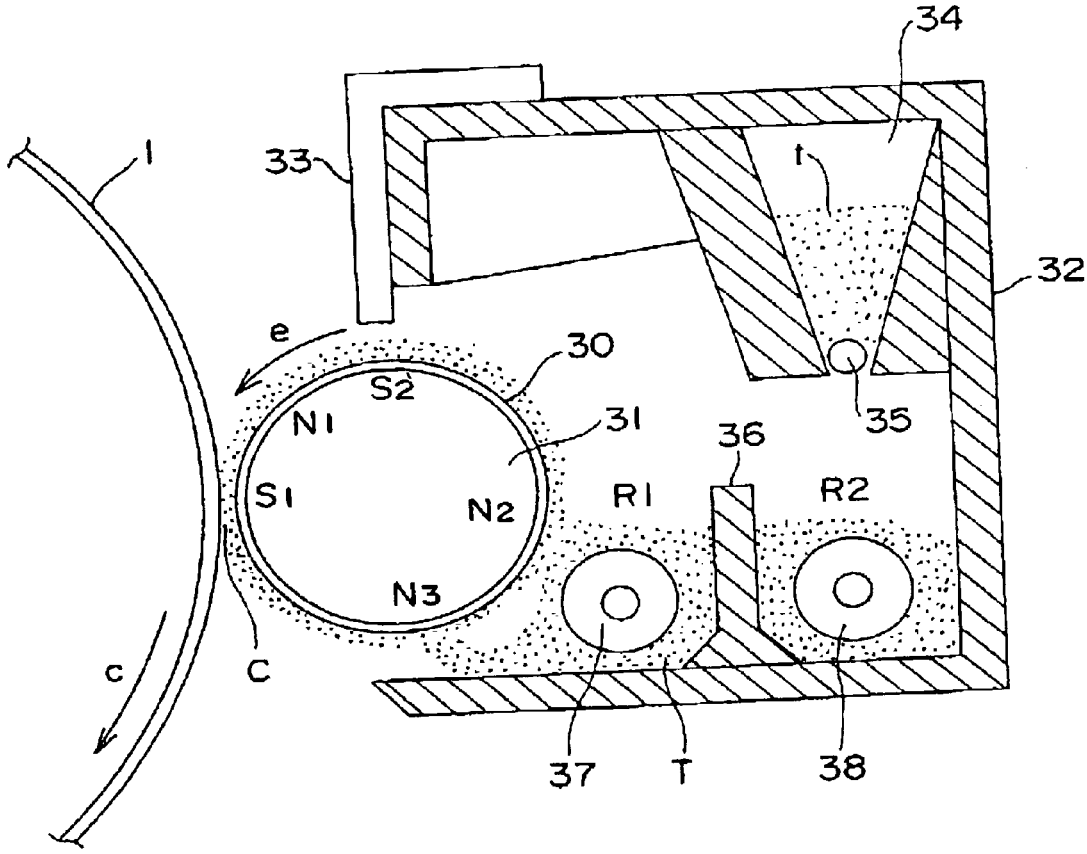
FIG. 11 is a vertical cross sectional view for illustrating an example of the configuration of two-component developing device.

In FIG. 11, the two-component developing device includes a developing sleeve 30 which can be driven to rotate in the direction of the arrow e. In the developing sleeve 30, a magnetic roller 31 is fixed in place. In a developing container 32, a restricting blade 33 is provided for forming a thin layer of a developer T on the surface of the developing sleeve 30.

Furthermore, the inside of the developing container 32 is partitioned into a developing chamber (a first chamber) R1 and a stirring chamber (a second chamber) R2 by a partition wall 36. A toner hopper 34 is arranged above the stirring chamber R2. Transfer screws 37, 38 are arranged in the developing chamber R1 and the stirring chamber R2, respectively. Furthermore, a supply port 35 is formed in the toner hopper 34, so that a toner t can be dropped and supplied into the stirring chamber R2 through the supply port 35 at the time of supplying the toner t.

On the other hand, in the developing chamber R1 and the stirring chamber R2, a developer T in which a mixture of the above toner particles and a magnetic carrier particles is accommodated.

Furthermore, the developer T in the developing chamber R1 is transferred in the longitudinal direction of the developing sleeve 30 by a rotary movement of the transfer screw 37. The developer T in the stirring chamber R2 is transferred in the longitudinal direction of the developing sleeve 30 by a rotary movement of the transfer screw 38. Furthermore, the direction in which the developer is carried by the transfer screw 38 is opposite to that by the transfer screw 37.

The partition wall 36 has openings (not shown) on the near side and the back side extending in the direction perpendicular to the plane of the figure. The developer T transferred by the transfer screw 37 is transferred from one of the openings to the transfer screw 38, while the developer T transferred by the transfer screw 38 is transferred from the other of the openings to the transfer screw 37, consequently, the toner particles are charged and polarized by friction with the magnetic particles for allowing the development of a latent image.

The developing sleeve 30 made of a non-magnetic material such as aluminum or non-magnetic stainless steel is placed in the opening formed in a portion near the electrostatic charge image bearing member 1 of the developing container 32. The developing sleeve 30 rotates in the direction of the arrow e (counterclockwise) to carry the developer T containing the toner and the carrier to the developing part C. A magnetic brush for the developer T supported by the developing sleeve 30 is brought into contact with the electrostatic charge image bearing member 1 being rotated in the direction of the arrow c (clockwise) in the developing part C and the electrostatic charge image is developed in the developing part C.

An oscillation bias potential where a direct voltage is superimposed on an alternating voltage is applied on the developing sleeve 30 from a power source (not shown). A dark potential (the potential of the non-exposed portion) and a light potential (the potential of the exposed portion) of the latent image are positioned between the maximum value and the minimum value of the above oscillation bias potential. Consequently, an alternating electric field alternately changing its direction is formed in the developing part C. In the alternating electric field, the toner and the carrier vibrate violently enough to allow the toner to throw off the electrostatic constraint to the developing sleeve 30 and the carrier. Consequently, the toner adheres to the light portion of the surface of the electrostatic charge image bearing member 1 corresponding to the latent image.

The difference (peak-to-peak voltage) between the maximum and the minimum values of the above oscillation bias voltage is preferably in the range of 1 to 5 kV (e.g., a rectangular wave of 2 kV) In addition, the frequency is preferably in the range of 1 to 10 kHz (e.g., 2 kHz). Furthermore, the waveform of the oscillation bias voltage is not limited to a rectangular wave. A sine waveform or a triangular waveform may be also used.

Furthermore, the value of the above direct voltage component is a value between the dark potential and the light potential of the electrostatic charge image. Preferably, for preventing the adhesion of toner that causes fogging to the dark potential area, such a value may be nearer the value of the dark potential than the value of the light potential which is the minimum when expressed by the absolute value. For the concrete values of the developing bias and the potential of the electrostatic charge image, for example, a dark potential is −700 V, a light potential is −200 V, and a direct current component of the developing bias is −500 V. In addition, it is preferable that a minimum space (the minimum space position is located in the developing portion C) between the developing sleeve 30 and the electrostatic charge image bearing member 1 is in the range of 0.2 to 1 mm (e.g., 0.5 mm).

In addition, the amount of the developer T to be transferred to the developing part C by being restricted by the restricting blade 33 is preferably defined such that the height of the magnetic blush of the developer T on the surface of the developing sleeve 30, which is formed due to the magnetic field in the developing part C, becomes 1.2 to 3 folds of the minimum space between the developing sleeve 30 and the electrostatic charge image bearing member 1 under the condition in which the electrostatic charge image bearing member 1 is removed (e.g., 700 $\mu$m in minimum space exemplified above).

A developing magnetic pole S1 of the magnetic roller 31 is arranged at a position opposite to the developing portion C. The developing magnetic pole S1 forms a developing magnetic field in the developing part C to allow the formation of a magnetic brush of the developer T. Then, the magnetic brush is brought into contact with the electrostatic charge image bearing member 1 to develop a dot-distributed electrostatic charge image. At this time, the toner adhered on the ears (brush) of the magnetic carrier and the toner adhered on the surface of the sleeve instead of the ears are transferred to the exposure portion of the electrostatic charge image to develop the electrostatic charge image.

A strength of the developing magnetic field formed by the developing magnetic pole S1 on the surface of the developing sleeve 30 (a magnetic flux density in the direction perpendicular to the surface of the developing sleeve 30) preferably has a peak value in the range of $5\times10^{-2}$ (T) to $2\times10^{-1}$ (T). In addition, the magnetic roller 31 includes N1, N2, N3, and S2 poles in addition to the above developing magnetic pole S1.

Here, the developing step for actualizing the electrostatic charge image on the electrostatic charge image bearing member 1 by a two-component magnetic brush using a developing device 32 and a circulating system of the developer T will be described below.

The developer T being drawn by a rotary motion of the developing sleeve 30 at the N2 pole is transferred from the S2 pole to the N1 pole. In the middle of the transfer, the restricting blade 33 restricts the layer thickness of the developer to form a thin-layered developer. Then, the brushed developer T in the magnetic field of the developing magnetic pole S1 develops the electrostatic charge image on the electrostatic charge image bearing member 1. Subsequently, the developer T on the developing sleeve 30 is dropped in the developing chamber R1 by the repulsive magnetic field between the N3 pole and the N2 pole. The developer T being dropped in the developing chamber R1 is stirred and carried by the transfer screw 37.

Next, the image forming operation of the image forming apparatus described above will be mentioned with reference to FIG. 10.

The electrostatic charge image bearing member 1 is rotationally driven around a center shaft at a predetermined peripheral velocity (process speed) in the direction of the arrow a (counterclockwise). During the rotation, the electrostatic charge image bearing member 1 receives a uniform charging treatment with a negative polarity in the present embodiment by a primary electric charger 2.

Subsequently, a scanning exposure light L with a laser beam being modified on the basis of image signals to be outputted from the image reader part B to the printer part A is outputted from an exposure optical device (a laser scanning device) 3 to the uniformly charged surface of the electric image bearing member 1 to sequentially form electrostatic charge images of each color corresponding to the image information on the document G read out by the image reader part B photoelectrically. The electrostatic charge image formed on the electrostatic charge image bearing member 1 is visualized by the developing device 4 with the above two-component magnetic brush. At first, the electrostatic charge image is subjected to a reversal development with the developing device containing a first color toner to visualize it as a first color toner image.

On the other hand, in sync with the formation of the above toner image on the electrostatic charge image bearing member 1, a transfer material P such as a sheet of paper being stored in a feeder cassette 10 is fed one by one with a feed roller 11 or 12, followed by feeding to a transfer member 5 by a resist roller 13 at a predetermined timing. Subsequently, the transfer material P is electrostatically adsorbed on the transfer member 5 by an adsorption roller 14. The transfer material P being electrostatically adsorbed on the transfer member 5 is shifted to a position facing the electrostatic charge image bearing member 1 by a rotary motion of the transfer member 5 in the direction of the arrow (clockwise). Then, a transfer charger 5a provides the back side of the transfer material P with charges having polarity opposite to the above toner, transferring a toner image from the electrostatic charge image bearing member 1 to the front side of the transfer material P.

The above transfer member 5 has a transfer sheet 5*c* being stretched over the surface thereof. The transfer sheet 5*c* is made of a polyethylene terephthalate (PET) resin film or the like. Also, the transfer sheet 5*c* is disposed so as to be capable of being brought into contact with and separated from the electrostatic charge image bearing member 1 adjustably. The transfer member 5 is rotationally driven in the direction of the arrow (clockwise) In the transfer member 5, the transfer charger 5*a*, a separation electric charger 5*b*, and the like are installed.

The remaining toner on the electrostatic charge image bearing member 1 after the transfer is removed by a cleaning device 6. Then, the electrostatic charge image bearing member 1 is used for the subsequent toner image formation.

Hereinafter, in the same manner as described above, the electrostatic charge image on the electrostatic charge image bearing member 1 is developed, and each of color toner images formed on the electrostatic charge image bearing member 1 is transferred and overlapped on the transfer material P on the transfer member 5 by the transfer charger 5*a* to form a full-color image. Then, the transfer material P is separated from the transfer member 5 by the separation electric charger 5*b*, followed by carrying the separated transfer material P to a fixing device 9 via a transfer belt 8. The transfer material P being carried to the fixing device 9 is heated and pressurized between a fixing roller 9*a* and a pressurizing roller 9*b* to fix a full-color image on the surface of the transfer material P. Subsequently, the transfer material P is discharged on a tray 16 by a discharge roller 15.

Furthermore, the remaining toner on the surface of the electrostatic charge image bearing member 1 is removed by the cleaning device 6. In addition, the surface of the electrostatic charge image bearing member 1 is diselectrified by a pre-exposure lamp 7, and is then used in the subsequent image formation.

Figure 16:
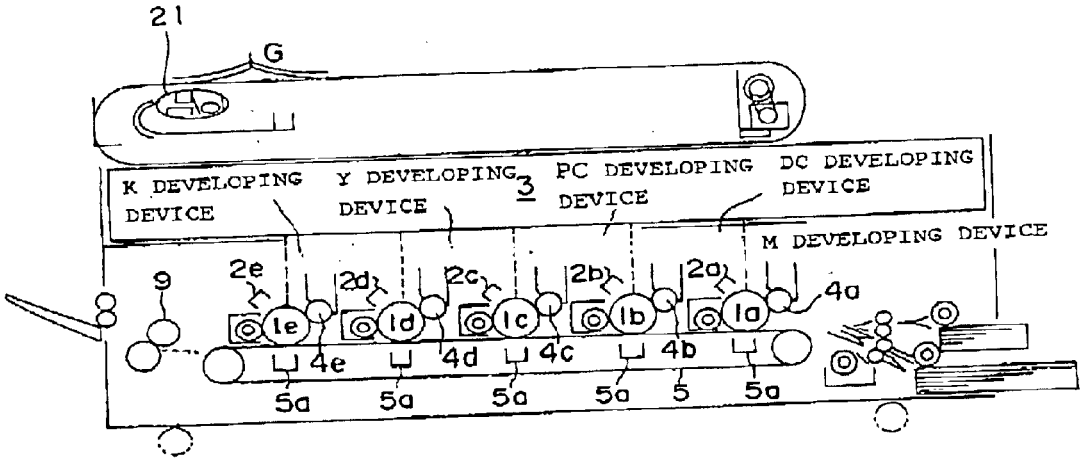
FIG. 16 is a vertical cross sectional view for illustrating an example of a tandem type image forming apparatus to be used in the present invention.

Furthermore, the present invention is also applicable to a tandem type full-color image forming apparatus or the like as shown in FIG. 16.

Here, the configuration of the tandem type image forming apparatus shown in FIG. 16 will be described, briefly. The image forming apparatus includes 5 image-forming units. These units include photosensitive drums (electrostatic charge image bearing bodies) 1*a*, 1*b*, 1*c*, 1*d*, and 1*e*, primary electric chargers 2*a*, 2*b*, 2*c*, 2*d*, and 2*e*, developing devices 4*a*, 4*b*, 4*c*, 4*d*, and 4*e*, and the like, respectively. Furthermore, the developing devices 4*a*, 4*b*, 4*c*, 4*d*, and 4*e* comprise toners of magenta, deep cyan, pale cyan, yellow, and black, respectively. In FIG. 16, the deep cyan toner and the pale cyan toner are used. However, the present invention is not limited to such a configuration. Alternatively, the deep magenta toner and the pale magenta toner may be used, or both the deep and pale cyan toners and the deep and pale magenta toners may be used in combination by additionally providing a developing device.

Furthermore, at the time of an image formation, at first, each photosensitive drum is charged by each primary electric charger. A laser beam being modulated on the basis of the image signals outputted from the image reader part B to the printer part A is outputted from the exposure optical device (the laser scanning device) 3, followed by an scanning exposure on each photosensitive drum with the laser beam. Therefore, electrostatic charge images corresponding to magenta, deep cyan, pale cyan, yellow, and black on the basis of the image information of the document G being photoelectrically read out by the image reader unit 21 are formed on the respective photosensitive drums.

The electrostatic charge images formed on the respective photosensitive drum are visualized as toner images by being developed with the respective developing devices using toners of magenta, deep cyan, pale cyan, yellow, and black.

Then, in sync with the formation of toner images of the respective colors on the corresponding photosensitive drums, each of color toners (magenta, deep cyan, pale cyan, yellow, and black) on the respective photosensitive drums are subsequently transferred and superimposed on the transfer material P such as a sheet of paper to be fed by being electrostatically adsorbed on a transfer belt 5 to form a full-color image.

The transfer material on which the full-color image is formed is heated and pressurized in the fixing device 9, so that the full-color image can be fixed on the transfer material. Subsequently, the transfer material is discharged to the outside.

EXAMPLES

Hereinafter, the present invention will be described concretely in accordance with the manufacturing examples and the examples. However, the present invention is not limited to these examples.

Example 1

An image forming apparatus that performs a full-color image formation using six kinds of color toners: cyan, pale cyan, magenta, pale magenta, yellow, and black was constructed. In this case, two types of toners having different concentrations were used for each of cyan and magenta among the colors of CMKY.

Here, deep and pale toners were prepared using different kinds of colorants, for example, a pigment colorant was used for a deep toner and a dye colorant was used for a pale color, and the toners were made to differ from each other in terms of concentration, hue angle, and lightness. More specifically, each toner was prepared using the following colorant.

<Cyan>

Phthalocyanine pigment (3 parts by mass)

<Pale Cyan>

Anthraquinone dye (0.6 parts by mass)

<Magenta>

Quinacridone pigment (3 parts by mass)

<Pale Magenta>

Anthraquinone dye (0.6 parts by mass)

For the components except the colorant in each of the toners, 100 parts by mass of a polyester resin was used as a binder resin, and 2.5 parts by mass of an aluminum compound of alkylsalicylic acid was used as a charge control agent.

The raw materials of the respective color toners were preliminary mixed with each other using a Henschel mixer, and dissolved and kneaded by a biaxial extrusion type kneader. After cooling, the mixture was roughly pulverized into powders of about 1 to 2 mm in particle diameter by a hammer mill. Subsequently, the powders were further subjected to a fine pulverization with an air-jet type fine pulverizing apparatus. The resulting fine pulverized products were classified. After the classification, 1.8 parts by mass of silica were externally added to 100 parts by mass of particles to obtain toner particles having a weight average particle diameter of 5.6 $\mu$m for each of cyan, pale cyan, magenta, and pale magenta toners.

The displacement of the hue angle of each of the monochromatic image of cyan toner and the monochromatic image of pale cyan toner was 3° at the lightness L which is obtained from the following equation:

$$L=(Lm-Lp)\times 0.2+Lp$$

where Lp denotes the minimum lightness of the pale toner in the CIELAB color space, and Lm denotes the lightness of a sheet on which an image formation is performed. Similarly, the displacement of the hue angle of each of the monochromatic image of magenta toner and the monochromatic image of pale magenta toner was also 3°. Furthermore, a comparison of lightnesses between the pale and deep toners for each of cyan and magenta was conducted at the same color saturation. For both cyan and magenta, it was revealed that the pale toner had higher lightness, compared with the deep toner.

Figure 35:
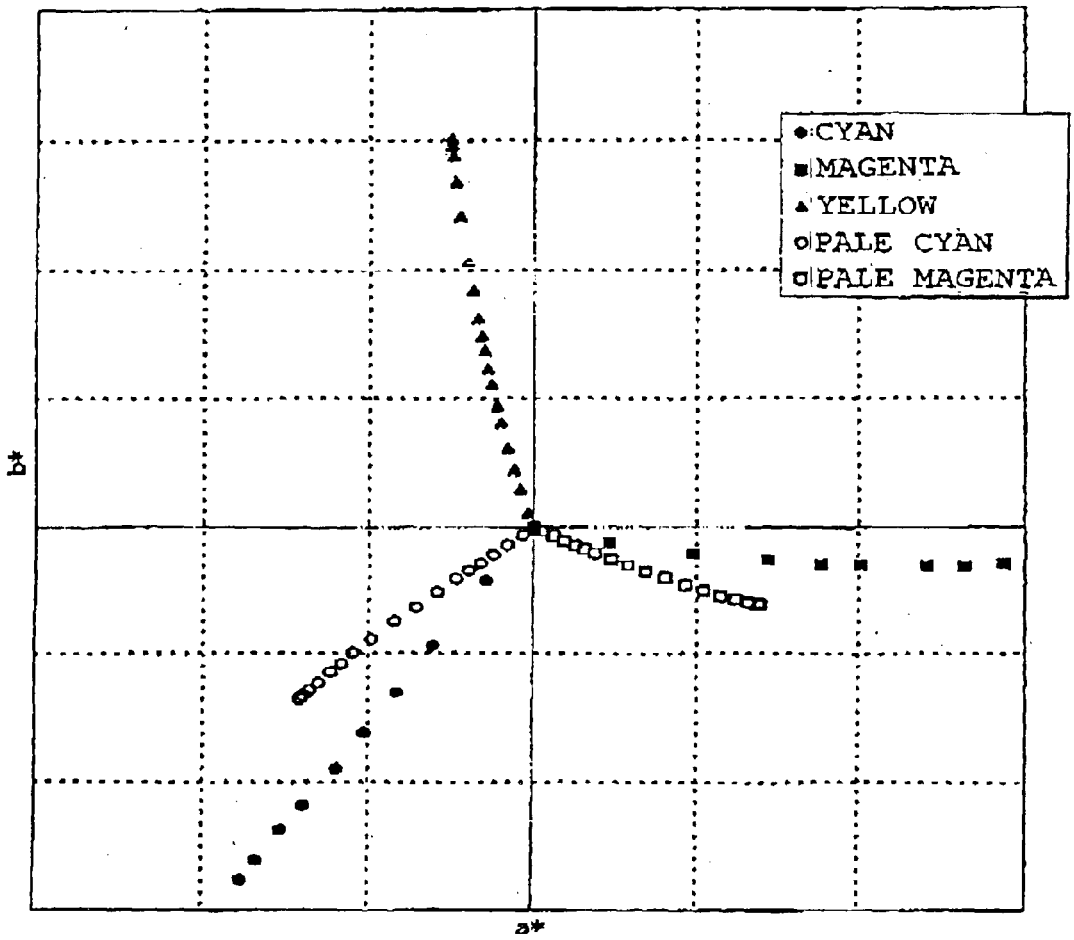
FIG. 35 is a view of a*-b* plane representing the characteristics of toner according to Example 1.
Figure 36:
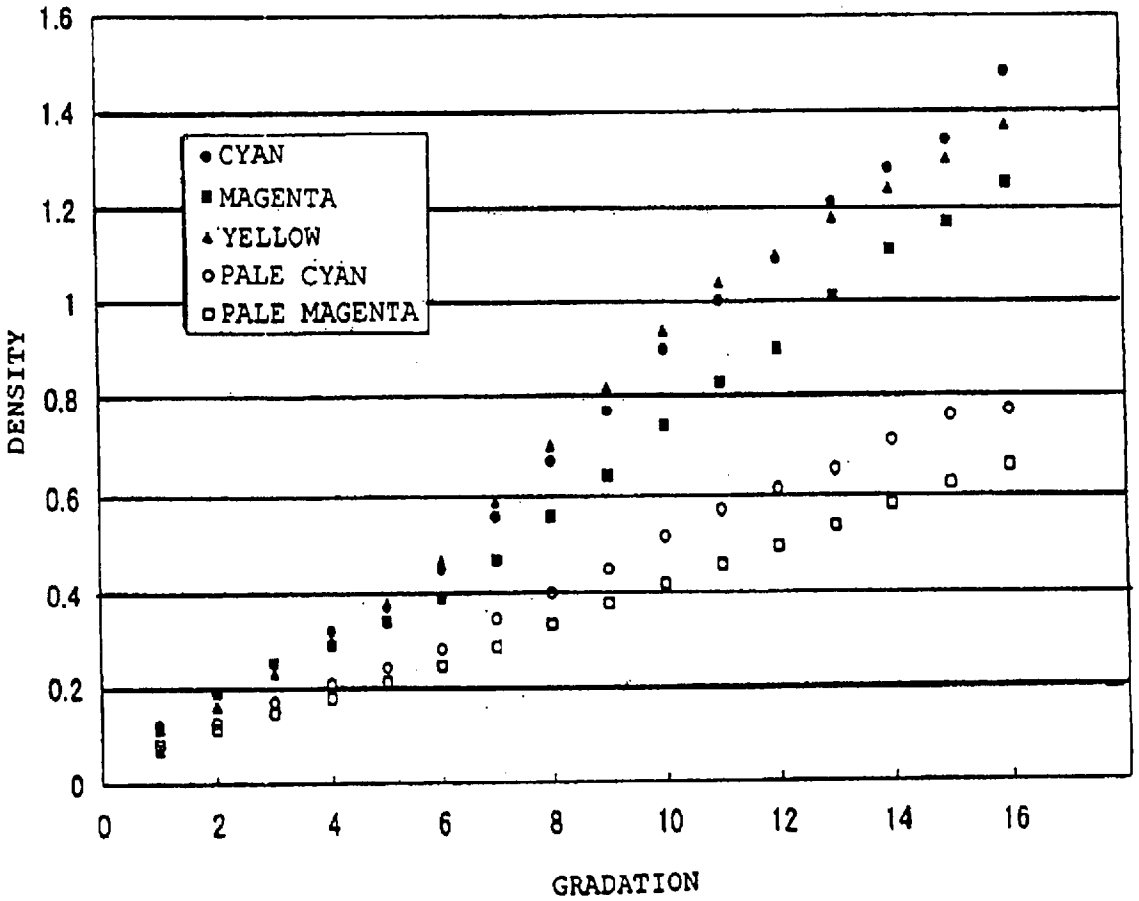
FIG. 36 is a graph that represents the gradation of toner according to Example 1.

Furthermore, the resulting toner characteristics are shown in the a*-b* plane view in FIG. 35. In addition, the gradation of each toner is shown in FIG. 36. From FIG. 35, it is found that the hue of the deep toner and the hue of the pale toner are different from each other. The pale cyan toner is displaced toward green, compared with the cyan toner. The pale magenta toner is displaced toward violet, compared with the magenta toner. In addition, as shown in FIG. 36, it is found the concentration of the deep toner and the concentration of the pale toner are different from each other.

Furthermore, the difference between the characteristics of the obtained cyan toner and the characteristics of the obtained pale cyan toner in the direction of L* will be described with reference to FIG. 37 and FIG. 38.

Figure 37:
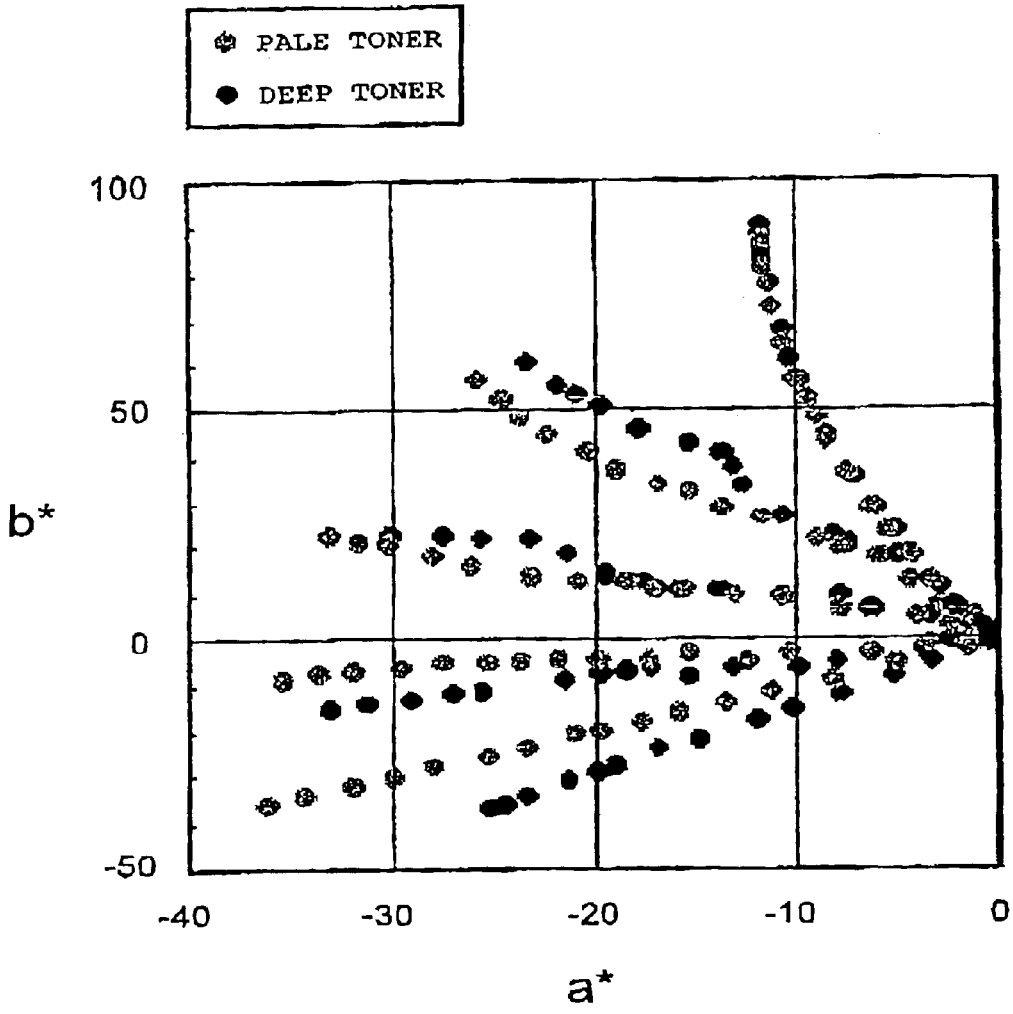
FIG. 37 is a view of a*-b* plane representing the characteristics of cyan toner and the characteristics of pale cyan toner according to Example 1.

As shown in FIG. 37, with respect to a combination of the cyan toner and the yellow toner and a combination of the pale cyan toner and the yellow toner which are used in this case, five different hues were prepared from 100% cyan toner (or pale cyan toner) to 100% yellow toner by mixing these color toners so as to overlap substantially one another (to have substantially the same hue) on the a*-b* plane.

Figure 38:
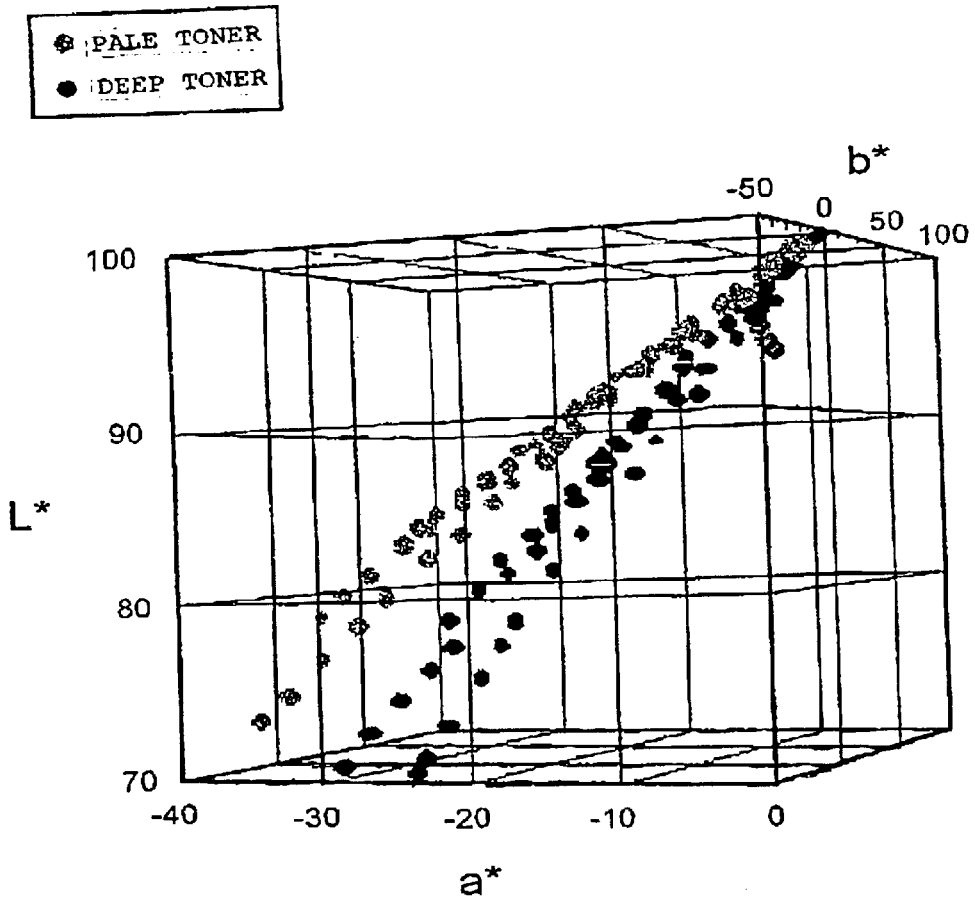
FIG. 38 is a stereoscopic view of the CIELAB color space that represents the characteristics of cyan toner and the characteristics of pale cyan toner according to Example 1.

At this time, by making a comparison between the lightness components at the same hue and the same color saturation, as shown in FIG. 38, it is found that an image formed using the pale cyan toner shows an extremely higher lightness, compared with an image formed using the cyan toner. In addition, it is also found that there is the extended color reproduction range in each of the direction of color saturation and the direction of lightness.

Likewise, the magenta toner and the pale magenta toner are evaluated, and it is found that an image formed using the pale magenta toner shows an extremely higher lightness, compared with an image formed using the magenta toner.

A full-color image formation was performed using the above toners and the results are shown in Table 1. An extended color reproduction range close to the image quality of a photograph was realized as the color reproduction area was increased by about 30% compared with a comparative example.

Example 2

Deep and pale cyan toners and deep and pale magenta toners were prepared by the same way as that of Example 1, except that the contents of the respective colorants in the toners used in Example 1 were changed.

The displacement of the hue angle of each of the deep and pale toners was 2° for each of cyan and magenta at the lightness L obtained from the equation: $L=(Lm-Lp)\times 0.2+Lp$. Furthermore, a comparison of lightnesses between the pale and deep toners for each of cyan and magenta was conducted under the same color saturation. It revealed that the pale toner had higher lightness for each of cyan and magenta.

Furthermore, an image formation was performed with the deep or pale toner and the yellow toner in combination. Then, the lightnesses at the same hue and the same color saturation were compared in the CIELAB color space of the resulting image. The image formed using the pale cyan toner or the pale magenta toner showed higher lightness, compared with the image formed using the cyan toner or the magenta toner.

A full-color image formation was performed using the above toners and the results are shown in Table 1. The color reproduction area was increased by about 10% compared with the comparative example.

Example 3

Deep and pale cyan toners and deep and pale magenta toners were prepared by the same way as that of Example 1, except that the contents of the respective colorants in the toners used in Example 1 were changed.

Image formation was performed by controlling fixing conditions so that the displacement of the hue angle of each of the deep and pale toners becomes 0° for both the cyan and magenta toners at the lightness L obtained from the equation: $L=(Lm-Lp)\times 0.2+Lp$. Furthermore, a comparison of lightnesses between the pale and deep toners for each of cyan and magenta was conducted at the same color saturation. It revealed that the pale toner had higher lightness for each of cyan and magenta.

An image formation was performed under the above fixing conditions with the deep or pale toner and the yellow toner in combination. Then, the lightnesses at the same hue and the same color saturation were compared in the CIELAB color space of the resulting image. The image formed using the pale cyan toner or the pale magenta toner showed higher lightness, compared with the image formed using the cyan toner or the magenta toner.

A full-color image formation was performed using the above toners and the results are shown in Table 1. The color reproduction area was increased by about 20% compared with the comparative example.

Comparative Example 1

Using four different color toners of cyan, magenta, yellow, and black, a full-color image formation was performed by a color laser copying machine CLC1100 (manufactured by Canon Inc.). The evaluation results are shown in Table 1.

Furthermore, the comparison among the extents of the respective color reproduction areas of Examples 1 to 3 and Comparative Example 1 were evaluated with relative values when the volume of the color reproduction area of Comparative Example 1 was defined as 100.

TABLE 1

| | Type of toner used | Color gamut volume (Relative value) |
|---|---|---|
| Example 1 | C, PC, M, PM, Y, K (With displacement of hue angle, with lightness difference) | 130 |
| Example 2 | C, PC, M, PM, Y, K (A slight displacement of hue angle, with lightness difference) | 110 |
| Example 3 | C, PC, M, PM, Y, K (No displacement of hue angle, with no lightness difference) | 120 |
| Comparative Example 1 | C, M, Y, K | 100 |

Example 4

An image forming apparatus that performs a full-color image formation using six kinds of color toners: cyan, pale cyan, magenta, pale magenta, yellow, and black was constructed. In this case, two types of toners having different concentrations were used for each of cyan and magenta among the colors of CMKY.

Here, deep and pale toners were prepared using the same pigment colorant, and the contents of the colorant included in these toners were differentiated from-each other. Thus, the deep toner and the pale toner were made to differ from each other in terms of concentration, hue angle, and lightness. Concretely, each toner was prepared using the following colorant.

<Cyan>

Phthalocyanine pigment (4 parts by mass)

<Pale Cyan>

Phthalocyanine pigment (0.7 parts by mass)

<Magenta>

Quinacridone pigment (5 parts by mass)

<Pale Magenta>

Quinacridone pigment (1 part by mass)

For the components except the colorant in each of the toners, 100 parts by mass of a polyester resin was used as a binder resin, and 2.5 parts by mass of an aluminum compound of alkylsalicylic acid was used as a charge control agent.

The raw materials were preliminary mixed with each other using a Henschel mixer, and dissolved and kneaded by a biaxial extrusion type kneader. After cooling, the mixture was roughly pulverized into powders of about 1 to 2 mm in particle diameter by a hammer mill. Subsequently, the powders were further subjected to a fine pulverization with an air-jet type fine pulverizing apparatus. The resulting fine pulverized products were classified. After the classification, 1.5 parts by mass of silica was externally added to 100 parts by mass of particles to obtain particles having a weight average particle diameter of 5.6 $\mu$m for each of cyan, pale cyan, magenta, and pale magenta toners.

The displacement of the hue angle of each of the deep toner and the pale toner was 30 for each of cyan and magenta at the lightness L which is obtained from the following equation:

$$L=(Lm-Lp)\times 0.2+Lp$$

where Lp denotes the minimum lightness of the pale toner in the CIELAB color space, and Lm denotes the lightness of a sheet on which an image formation is performed. Furthermore, a comparison of lightnesses between the pale and deep toners for each of cyan and magenta was conducted at the same color saturation. For both cyan and magenta, it was revealed that the pale toner had higher lightness, compared with the deep toner.

Furthermore, an image formation was performed with the deep or pale toner and the yellow toner in combination. Then, the lightnesses at the same hue and the same color saturation were compared in the CIELAB color space of the resulting image. The image formed using the pale cyan toner or the pale magenta toner showed higher lightness, compared with the image formed using the cyan toner or the magenta toner.

A full-color image formation was performed using the above toners and the results are shown in Table 2. An extended color reproduction range close to the image quality of a photograph was realized as the color reproduction area was increased by about 30% compared with a comparative example.

Example 5

Deep and pale cyan toners and deep and pale magenta toners were prepared by the same way as that of Example 4, except that the contents of the respective colorants in the toners used in Example 4 were changed.

The displacement of the hue angle of each of the deep and pale toners was 2° for each of cyan and magenta at the lightness L obtained from the equation: L=(Lm−Lp)×0.2+Lp. Furthermore, a comparison of lightnesses between the pale and deep toners for each of cyan and magenta was conducted at the same color saturation. It revealed that the pale toner had higher lightness for each of cyan and magenta.

Furthermore, an image formation was performed with the deep or pale toner and the yellow toner in combination. Then, the lightnesses at the same hue and the same color saturation were compared in the CIELAB color space of the resulting image. The image formed using the pale cyan toner or the pale magenta toner showed higher lightness, compared with the image formed using the cyan toner or the magenta toner.

A full-color image formation was performed using the above toners and the results are shown in Table 2. The color reproduction area was increased by about 10% compared with the comparative example.

Example 6

Deep and pale cyan toners and deep and pale magenta toners were prepared by the same way as that of Example 1, except that the contents of the respective colorants in the toners used in Example 1 were changed.

The displacement of the hue angle of each of the deep and pale toners was 3° for each of cyan and magenta at the lightness L obtained from the equation: L=(Lm−Lp)×0.2+Lp. Furthermore, a comparison of lightnesses between the pale and deep toners for each of cyan and magenta was conducted at the same color saturation. It revealed that the pale and deep toners had the lightness of almost the same level for each of cyan and magenta.

A full-color image formation was performed using the above toners and the results are shown in Table 2. The color reproduction area was increased by about 20% compared with the comparative example.

Comparative Example 2

Using four different color toners of cyan, magenta, yellow, and black, a full-color image formation was performed by a color laser copying machine CLC1100 (manufactured by Canon Inc.). The evaluation results are shown in Table 2.

Furthermore, the comparison among the extents of the respective color reproduction areas of Examples 4 to 6 and Comparative Example 2 were evaluated with relative values when the volume of the color reproduction area of Comparative Example 2 was defined as 100.

TABLE 2

| | Type of toner used | Color gamut volume (Relative value) |
|---|---|---|
| Example 4 | C, PC, M, PM, Y, K (With displacement of hue angle, with lightness difference) | 130 |
| Example 5 | C, PC, M, PM, Y, K (A slight displacement of hue angle, with lightness difference) | 110 |
| Example 6 | C, PC, M, PM, Y, K (No displacement of hue angle, with no lightness difference) | 120 |
| Comparative Example 2 | C, M, Y, K | 100 |

Manufacturing Example 1 of Cyan Toner

| | |
|---|---|
| Polyester resin (acid value of 7 mg KOH/g) prepared by a condensation polymerization of polyoxypropylene (2,2)-2,2-bis (4-hydroxyphenyl)propane, fumaric acid, and 1,2,5-hexatricarboxylic acid | 100 parts by mass |
| C.I. pigment blue 15:3 | 5 parts by mass |
| An aluminum compound of di-tertiary-butyl salicylic acid | 3.5 parts by mass |

The above raw materials were preliminary mixed with each other using a Henschel mixer, and dissolved and kneaded by a biaxial extrusion type kneader. After cooling, the mixture was roughly pulverized into powders of about 1 to 2 mm in particle diameter by a hammer mill. Subsequently, the powders were further subjected to a fine pulverization with an air-jet type fine pulverizing apparatus. The resulting fine pulverized products were classified, thereby obtaining cyan toner particles having a weight average particle diameter of 6.4 $\mu$m.

A cyan toner 1 was obtained by externally adding 2.5 parts by mass of dry silica (120 $m^2/g$ in BET in specific surface area) having a primary particle diameter of 12 nm being treated with silicone oil and hexamethyldisilazane to 100 parts by mass of the obtained cyan particles. The physical properties of the cyan toner 1 are shown in Table 3-1, 3-2, and Table 4.

Manufacturing Examples 2 to 5 of Cyan Toner

Cyan toners 2 to 5 were obtained by the same way as that of Manufacturing Example 1 of the cyan toner, except that the type and addition amounts of the colorant, the charge control agent, and the external agent were changed to those listed in Table 3-1. The physical properties thereof are listed in Table 3-2 and Table 4.

Manufacturing Example 6 of Cyan Toner

In a four-neck flask (2 liters) equipped with a high-speed stirrer TK-homo mixer, 350 parts by mass of ion-exchange water and 225 parts by mass of a 0.1 mol/l $Na_3PO_4$ aqueous solution were added. Then, the revolving speed of the homo mixer was adjusted to 12,000 rpm, and the aqueous solution was heated at 65° C. Subsequently, 34 parts by mass of an 1.0 mol/l $CaCl_2$ aqueous solution was gradually added. Consequently, a water dispersing medium containing a minute water-Insoluble dispersant $Ca_3(PO_4)_2$ was prepared.

| | |
|---|---|
| Styrene | 83 parts by mass |
| n-butyl acrylate | 17 parts by mass |
| Divinyl benzene | 0.2 parts by mass |
| C.I. pigment blue 15:1 | 4 parts by mass |
| Saturated polyester resin (terephthalic acid - propylene oxide denatured bisphenol A copolymer, acid value = 15 mg KOH/g) | 5 parts by mass |
| An aluminum compound of di-tertiary-butyl salicylic acid | 2.5 parts by mass |
| Ester wax (melting point 76° C.) | 13 parts by mass |

Using an attritor, the above materials were dispersed for 3 hours to prepare a polymeric monomer composition. After that, 4 parts by mass of 2,2'-azobis (2,4-dimethylvaleronitrile), which was a polymerization initiator, was added in the polymeric monomer composition. Then, the polymeric monomer composition was introduced into the above water dispersing medium and was pulverized by stirring for 15 minutes while keeping a revolving number of 12,000 rpm. Subsequently, the stirring device was changed from the high-speed stirring device to a typical propeller stirring device, and the inside temperature of the flask was increased to 80° C. while keeping a revolving number of 150 rpm to conduct a polymerization for 10 hours. After the polymerization, the water dispersing medium was cooled and added with dilute hydrochloric acid to dissolve the water-insoluble dispersant, followed by washing and drying. Consequently, cyan toner particles having a weight average particle diameter of 5.5 $\mu$m were obtained.

A cyan toner 6 was obtained by externally adding 2.5 parts by mass of dry silica (120 $m^2/g$ in BET in specific surface area) having a primary particle diameter of 12 nm being treated with silicone oil and hexamethyldisilazane to 100 parts by mass of the obtained cyan particles. The physical properties of the cyan toner 6 were obtained in the same manner as in the case of the cyan toner 1 and are shown in Table 3-1, 3-2, and Table 4.

Manufacturing Examples 7 to 10 of Cyan Toner

Cyan toners 7 to 10 were obtained by the same way as that of Manufacturing Example 6 of Cyan Toner, except that addition amounts of the colorant, the charge control agent, and the external agent were changed to those listed in Table 3-1. The physical properties of the cyan toners 7 to 10 were obtained in the same manner as in the case of the cyan toner 1 and were listed in Table 3-2 and Table 4.

TABLE 3-1

| Manufacturing Examples of toner | Toner | Developer | Colorant | Addition amounts of colorant (parts by mass) | Addition amounts of charge control agent (parts by mass) | Addition amounts of external agent (parts by mass) |
|---|---|---|---|---|---|---|
| 1 | Cyan toner 1 | Developer 1 | Pigment Blue 15:3 | 5 | 3.5 | 2.5 |
| 2 | Cyan toner 2 | Developer 2 | Pigment Blue 15:3 | 3 | 3 | 2 |
| 3 | Cyan toner 3 | Developer 3 | Pigment Blue 15:3 | 0.6 | 2 | 1.6 |
| 4 | Cyan toner 4 | Developer 4 | Pigment Blue 15:3 | 0.4 | 2 | 1.3 |
| | | | Pigment Green 7 | 0.1 | | |
| 5 | Cyan toner 5 | Developer 5 | Pigment Blue 15:3 | 0.1 | 2 | 1.3 |
| | | | Pigment Green 7 | 0.4 | | |
| 6 | Cyan toner 6 | Developer 6 | Pigment Blue 15:1 | 4 | 2.5 | 2.5 |
| 7 | Cyan toner 7 | Developer 7 | Pigment Blue 15:3 | 4 | 2.5 | 2.5 |
| 8 | Cyan toner 8 | Developer 8 | Pigment Blue 15:3 | 0.5 | 1.8 | 1.5 |
| | | | Pigment Green 7 | 0.1 | | |
| 9 | Cyan toner 9 | Developer 9 | Pigment Blue 15:1 | 0.2 | 2 | 1 |
| | | | Pigment Violet 37 | 0.4 | | |
| 10 | Cyan toner 10 | Developer 10 | Pigment Blue 60 | 10 | 1.5 | 1 |

TABLE 3-2

| Manufacturing Examples of toner | Toner | Developer | BET in specific surface area ($m^2/g$) | Weight average particle diameter ($\mu m$) | Number average particle diameter ($\mu m$) | Peak of molecular weight distribution | Tg (° C.) |
|---|---|---|---|---|---|---|---|
| 1 | Cyan toner 1 | Developer 1 | 4.8 | 6.4 | 5.3 | 11800 | 61 |
| 2 | Cyan toner 2 | Developer 2 | 3.5 | 6.3 | 5.2 | 11400 | 61 |
| 3 | Cyan toner 3 | Developer 3 | 3.1 | 7.6 | 6.5 | 11100 | 61 |
| 4 | Cyan toner 4 | Developer 4 | 2.6 | 7.5 | 6.8 | 11300 | 61 |
| 5 | Cyan toner 5 | Developer 5 | 2.6 | 7.6 | 6.8 | 12100 | 61 |
| 6 | Cyan toner 6 | Developer 6 | 4.4 | 5.6 | 4.7 | 13600 | 58 |
| 7 | Cyan toner 7 | Developer 7 | 4.4 | 5.6 | 4.9 | 13700 | 58 |
| 8 | Cyan toner 8 | Developer 8 | 2.8 | 6.1 | 5.5 | 12100 | 57 |
| 9 | Cyan toner 9 | Developer 9 | 1.9 | 5.6 | 4.9 | 14600 | 58 |
| 10 | Cyan toner 10 | Developer 10 | 2.1 | 5.3 | 4.7 | 14300 | 58 |

TABLE 4

| Manufacturing Examples of toner | Toner | Developer | Value of a* when b* = −20 | Value of a* when b* = −30 | Value of L* when c* = 30 | Hue angle (0.5 $mg/cm^2$) | Image density (0.5 $mg/cm^2$) | Image density (1 $mg/cm^2$) |
|---|---|---|---|---|---|---|---|---|
| 1 | Cyan toner 1 | Developer 1 | −13.4 | −19.6 | 79.9 | 242.0' | 1.48 | 2.01 |
| 2 | Cyan toner 2 | Developer 2 | −17.5 | −26.3 | 83.4 | 230.2' | 1.37 | 1.86 |
| 3 | Cyan toner 3 | Developer 3 | −21.7 | −30.6 | 86.3 | 223.4' | 0.48 | 0.88 |
| 4 | Cyan toner 4 | Developer 4 | −28.5 | −42.7 | 85.4 | 215.1' | 0.42 | 0.83 |
| 5 | Cyan toner 5 | Developer 5 | −34.6 | −58.3 | 84.2 | 207.3' | 0.35 | 0.68 |
| 6 | Cyan toner 6 | Developer 6 | −10.8 | −16.1 | 75.2 | 249.7' | 1.43 | 1.94 |
| 7 | Cyan toner 7 | Developer 7 | −15.6 | −23.1 | 81.6 | 237.6' | 1.42 | 1.93 |
| 8 | Cyan toner 8 | Developer 8 | −25.1 | −36.5 | 85.3 | 218.5' | 0.44 | 0.85 |
| 9 | Cyan toner 9 | Developer 9 | −16.8 | −24.7 | 82.6 | 230.5' | 0.46 | 0.86 |
| 10 | Cyan toner 10 | Developer 10 | −5.4 | −8.1 | 72.9 | 261.3' | 1.74 | 2.13 |

Example A-1

The cyan toner 1 and the ferrite carrier (42 $\mu$m in average particle diameter) surface-coated with a silicone resin were mixed together such that the concentration of the toner became 6% by mass to prepare a two-component developer 1 (for deep color). At the same way, the cyan toner 3 and the ferrite carrier (42 $\mu$m in average particle diameter) surface-coated with a silicone resin were mixed together such that the concentration of the toner became 6% by mass to prepare a two-component developer 3 (for pale color).

The two-component developer 1 and the two-component developer 3 were joined together to provide a cyan toner kit 1.

Figure 9:
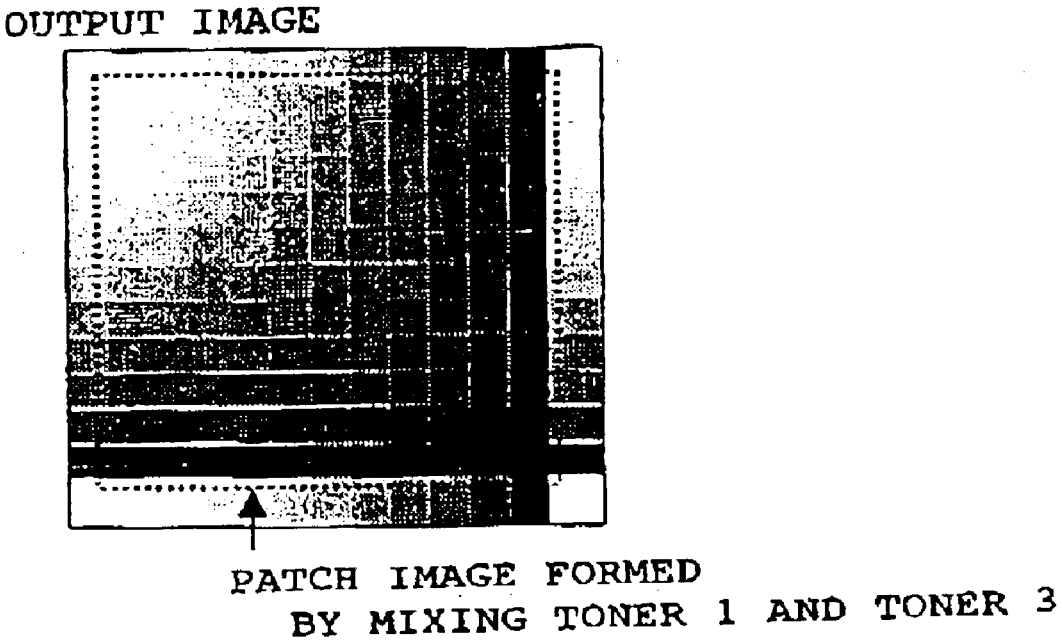
FIG. 9 is a graph that represents a patch image formed by a combination of the output images shown in FIGS. 7 and 8.

In a commercially available ordinary paper full-color copying machine (e.g., CLC1150 manufactured by Canon Inc.), the two-component developer 1 was placed in a cyan developing device and the two-component developer 3 in a magenta developing device. A patch image was formed on an ordinary paper ("TKCLA 4" for a color laser copying machine, manufactured by Canon Inc.) by overlapping, in a printer mode, an image of the pale cyan toner with a 12-level gray scale and an image of the deep cyan toner with 12-level gray scale one another while crossing each other at right angles. An example of the output image is shown in FIGS. 9.

Figure 7:
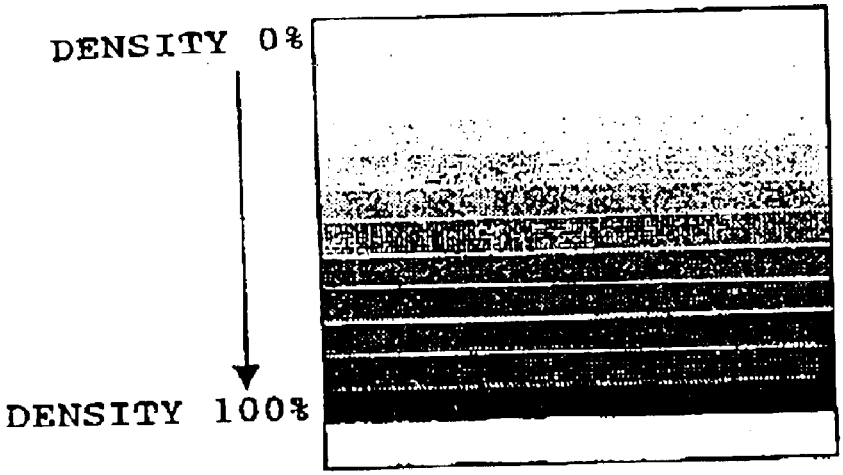
FIG. 7 is a graph that represents an output image with 12-level gray scale formed by a two-component developer 1 in examples of the present invention.
Figure 8:
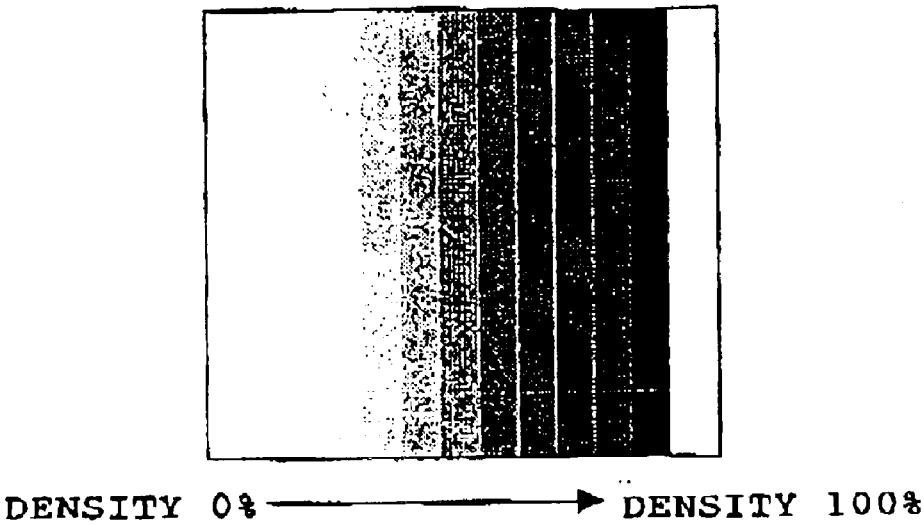
FIG. 8 is a graph that represents an output image with 12-level gray scale formed by a two-component developer 3 in examples of the present invention.

Further, FIG. 7 shows an image formed with the two-component developer 1. FIG. 8 shows an image formed with the two-component developer 3. The image shown in FIG. 9 is formed by forming these images shown in FIG. 7 and FIG. 8 on a piece of paper.

Subsequently, the values L*, a*, and b* of each patch were measured using the SpectroScan Transmission (manufactured by GretagMacbeth Co., Ltd.) In addition, the value c* was obtained from the values a* and b*. Then, the c*-L* graph was formed by plotting the values of each patch such that the horizontal axis represents the value of c* and the vertical axis represents the value L*. The area of a region, which was surrounded by the line of L*=60, the line of c*=0, and the measurement values, was obtained, and sizes of the reproducible color spaces were compared. When the value L* was less than 60, the area of a region, which was surrounded by the line passing through a point that indicated the minimum of L* and in parallel with the c* axis, the line of L*=0, and the measurement values, was measured. The evaluation results are shown in Table 5-1 and 5-2.

Furthermore, a patch image of a low density area where L* was in the range of 85 or more and less than 100, and a patch image of an intermediate density area where L* was in the range of 70 or more and less than 85 were extracted, respectively. Then, the graininess of each image was evaluated by visual observation on the basis of the following evaluation criteria. The evaluation results are shown in Table 5-1 and 5-2.

A: Graininess and roughness are very good.

B: Graininess and roughness are good.

C: Normal graininess and roughness are observed.

D: Graininess or roughness stands out a little but within the bounds of practical use.

E: Graininess or roughness stands out.

Examples A-2 to A-5, Comparative Examples A-1 and A-2, and Reference Examples A-1 to A-3

Toner kits were prepared and the evaluation of an image was performed by the same way as those of Example A-1, except that each of the toner kits is constructed as shown in Table 5-1. In addition, the results are shown in Table 5-1 and 5-2.

TABLE 5-1

| | Toner kit | | | | | | | | | | | | | |
|---|---|---|---|---|---|---|---|---|---|---|---|---|---|---|
| | Developer having pale cyan toner | Developer having deep cyan toner | $a^*_1$ | $a^*_2$ | $a^*_3$ | $a^*_4$ | $a^*_1-a^*_3$ | $a^*_2-a^*_4$ | $L^*_1$ | $L^*_2$ | $L^*_1-L^*_2$ | $H^*_1$ | $H^*_2$ | $H^*_2-H^*_1$ |
| Example A-1 | 3 | 1 | −21.7 | −30.6 | −13.4 | −19.6 | −8.3 | −11 | 86.3 | 79.9 | 6.4 | 223.4 | 242 | 18.6 |
| Example A-2 | 3 | 2 | −21.7 | −30.6 | −17.5 | −26.3 | −4.2 | −4.3 | 86.3 | 83.4 | 2.9 | 223.4 | 230.2 | 6.8 |
| Example A-3 | 8 | 6 | −25.1 | −36.5 | −10.8 | −16.1 | −14.3 | −20.4 | 85.3 | 75.2 | 10.1 | 218.5 | 249.7 | 31.2 |
| Example A-4 | 8 | 7 | −25.1 | −36.5 | −15.6 | −23.1 | −9.5 | −13.4 | 85.3 | 81.6 | 3.7 | 218.5 | 237.6 | 19.1 |
| Example A-5 | 4 | 1 | −28.5 | −42.7 | −13.4 | −19.6 | −15.1 | −23.1 | 85.4 | 79.9 | 5.5 | 215.1 | 242 | 26.9 |
| Comparative Example A-1 | — | 1 | −21.3 | −30.5 | −21.3 | −30.5 | 0 | 0 | 79.9 | 79.9 | 0 | 242 | 242 | 0 |
| Comparative Example A-2 | 3 | — | −21.7 | −30.6 | −21.7 | −30.6 | 0 | 0 | 86.3 | 86.3 | 0 | 223.4 | 223.4 | 0 |
| Reference Example A-1 | 9 | 6 | −16.8 | −24.7 | −10.8 | −16.1 | −6 | −8.6 | 82.6 | 75.2 | 7.4 | 230.5 | 249.7 | 19.2 |
| Reference Example A-2 | 5 | 1 | −34.6 | −58.3 | −13.4 | −19.6 | −21.2 | −38.7 | 84.2 | 79.9 | 4.3 | 207.3 | 242 | 34.7 |
| Reference Example A-3 | 5 | 10 | −34.6 | −58.3 | −5.4 | −8.1 | −29.2 | −50.2 | 84.2 | 72.9 | 11.3 | 207.3 | 261.3 | 64 |

TABLE 5-2

| | Toner kit | | Graininess | | |
|---|---|---|---|---|---|
| | Developer having pale cyan toner | Developer having deep cyan toner | Low density area | Intermediate density area | Color space area |
| Example A-1 | 3 | 1 | A | B | 105.9 |
| Example A-2 | 3 | 2 | A | A | 109.8 |
| Example A-3 | 8 | 6 | A | B | 105.7 |
| Example A-4 | 8 | 7 | A | A | 111.4 |
| Example A-5 | 4 | 1 | A | B | 106.6 |
| Comparative Example A-1 | — | 1 | C | B | 103.4 |
| Comparative Example A-2 | 3 | — | A | A | 87.8 |
| Reference Example A-1 | 9 | 6 | C | C | 98.1 |
| Reference Example A-2 | 5 | 1 | B | D | 104.4 |
| Reference Example A-3 | 5 | 10 | B | D | 96.2 |

Example A-6

The two-component developer 2 and the two-component developer 3 were joined together to provide a cyan toner kit.

In a commercially available ordinary paper full-color copying machine (e.g., CLC1150 manufactured by Canon Inc.), the two-component developer 2 was placed in a cyan developing device and the two-component developer 3 in a magenta developing device. Using an ordinary paper ("TKCLA4" for a color laser copying machine, manufactured by Canon Inc.), the graininess and roughness of the image outputted according to FIG. 15 was evaluated by visual observation on the basis of the following evaluation criteria by the same way as that of Example A-1. The evaluation results are shown in Table 6-1 and 6-2.

A: Graininess and roughness are very good.

B: Graininess and roughness are good.

C: Normal graininess and roughness are observed

D: Graininess or roughness stands out a little but within the bounds of practical use.

E: Graininess or roughness stands out.

Furthermore, the gradation of each image was evaluated by visual observation on the basis of the following evaluation criteria. The evaluation results are shown in Table 6-1 and 6-2.

A: Gradation is very good.

B: Gradation is good.

C: Normal gradation is observed.

D: Insufficient gradation was observed, or unreasonable.

Just as in the case of Example A-1, the c*-L* graph was formed. The area of a region, which was surrounded by the line of L*=60, the line of c*=0, and measurement values, was obtained, sizes of the reproducible color spaces were compared. When the value L* was less than 60, the area of a region, which was surrounded by the line passing through a point that indicated the minimum of L* and in parallel with the c* axis, the line of L*=0, and the measurement values, was measured. The evaluation results are shown in Table 6-1 and 6-2.

Comparative Examples A-3 and A-4

Figure 17:
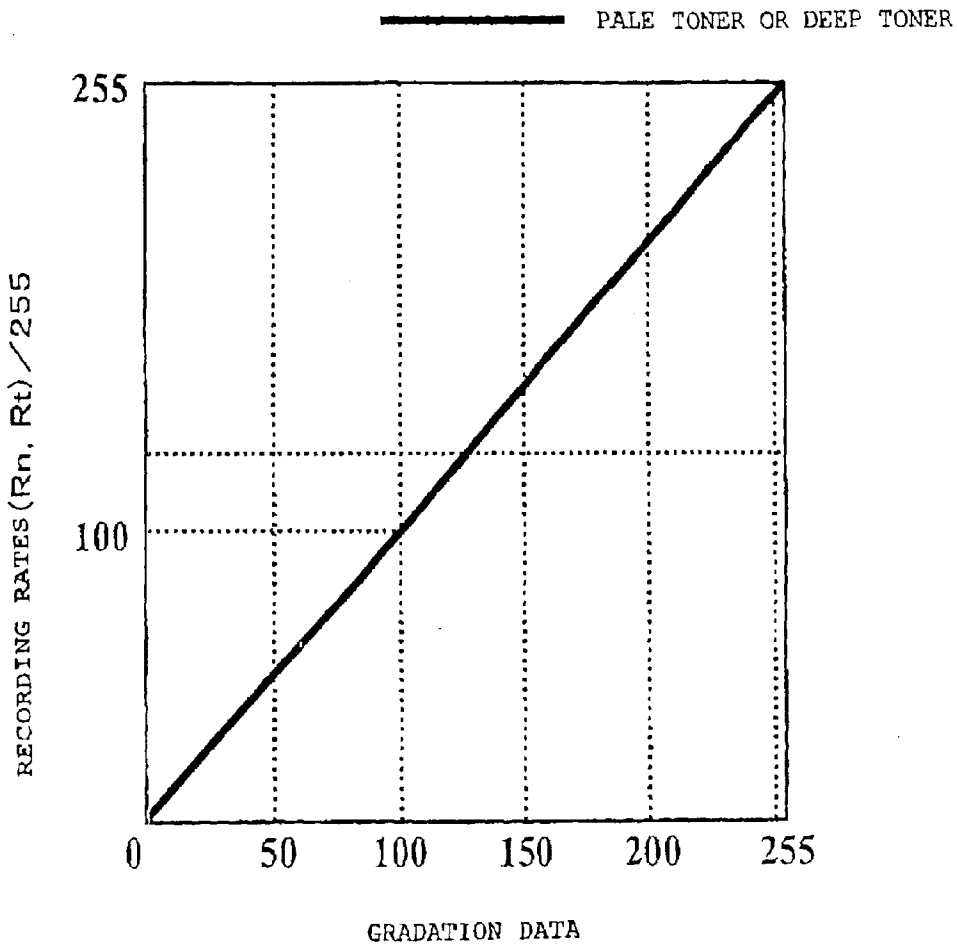
FIG. 17 is a graph that represents the relationship between gradation data and recording rates of a pale cyan toner and a deep cyan toner in an image formation according to comparative example.

A two-component developer shown in Table 6-1 was placed in the cyan developing devices while the magenta developing device was not used. The evaluation of an image was performed by the same way as that of Example A-6, except that the output was performed according to FIG. 17. The results are shown in Table 6-1 and 6-2.

Examples A-7 and A-8, Reference Examples A-4 and A-5

Toner kits were prepared and the evaluation of an image was performed by the same way as those of Example A-6, except that each of the toner kits is constructed as shown in Table 6-1. The results are shown in Table 6-1 and 6-2.

TABLE 6-1

| | Toner kit | | | | | | | | | | | | | |
|---|---|---|---|---|---|---|---|---|---|---|---|---|---|---|
| | Developer having pale cyan toner | Developer having deep cyan toner | $a^*_1$ | $a^*_2$ | $a^*_3$ | $a^*_4$ | $a^*_1$–$a^*_3$ | $a^*_2$–$a^*_4$ | $L^*_1$ | $L^*_2$ | $L^*_1$–$L^*_2$ | $H^*_1$ | $H^*_2$ | $H^*_2$–$H^*_1$ |
| Example A-6 | 3 | 2 | −21.7 | −30.6 | −17.5 | −26.3 | −4.2 | −4.3 | 86.3 | 83.4 | 2.9 | 223.4 | 230.2 | 6.8 |
| Example A-7 | 8 | 7 | −21.3 | −30.5 | −15.6 | −23.1 | −5.7 | −7.4 | 85.3 | 81.6 | 3.7 | 218.5 | 237.6 | 19.1 |
| Example A-8 | 4 | 1 | −28.5 | −42.7 | −13.4 | −19.6 | −15.1 | −23.1 | 85.4 | 79.9 | 5.5 | 215.1 | 242 | 26.9 |
| Comparative Example A-3 | — | 1 | — | — | −21.3 | −30.5 | — | — | — | 79.9 | — | — | 242 | — |
| Comparative Exeaple A-4 | 3 | — | −21.7 | −30.6 | — | — | — | — | 86.3 | — | — | 223.4 | — | — |
| Reference Example A-4 | 9 | 6 | −16.8 | −24.7 | −10.8 | −16.1 | −6 | −8.6 | 82.6 | 75.2 | 7.4 | 230.5 | 249.7 | 19.2 |
| Reference Example A-5 | 5 | 10 | −34.6 | −58.3 | −5.4 | −8.1 | −29.2 | −50.2 | 84.2 | 72.9 | 11.3 | 207.3 | 261.3 | 54 |

TABLE 6-2

| | Toner kit | | Graininess | | | |
|---|---|---|---|---|---|---|
| | Developer having pale cyan toner | Developer having deep cyan toner | Low density area | Intermediate density area | Gradation | Color space area |
| Example A-6 | 3 | 2 | A | A | A | 110.2 |
| Example A-7 | 8 | 7 | A | A | A | 111.5 |
| Example A-8 | 4 | 1 | A | B | B | 106.8 |
| Comparative Example A-3 | — | 1 | C | B | C | 101.6 |
| Comparative Example A-4 | 3 | — | A | A | D | 61.4 |
| Reference Example A-4 | 9 | 6 | C | C | C | 98.3 |
| Reference Example A-5 | 5 | 10 | B | D | C | 96.5 |

Manufacturing Examples of Black Toner, Yellow Toner, and Magenta Toner

A black toner, a yellow toner, and a magenta toner were prepared by the same way as that of Manufacturing Example 1 of the cyan toner, except that the addition amount of each of the colorant, charge control agent, and external additive was changed to one listed in Table 7-1. The physical properties of these toners are shown in Table 7-2. Each of these toners and a ferrite carrier (42 μm in average particle diameter) surface-coated with a silicone resin were mixed together such that the concentration of the toner became 6% by mass. Consequently, a black developer, a yellow developer, and a magenta developer were observed.

TABLE 7-1

| Toner | Developer | Colorant | Addition amounts of the colorant (parts by mass) | Addition amounts of the charge control agent (parts by mass) | Addition amounts of the external agent (parts by mass) |
|---|---|---|---|---|---|
| Black toner | Black developer | Carbon black | 6 | 3 | 2 |
| Yellow toner | Yellow developer | Pigment Yellow 17 | 5 | 3 | 2 |
| Magenta toner | Magenta developer | Pigment Red 122 | 5 | 3 | 2 |

TABLE 7-2

| Toner | Developer | BET in specific surface area ($m^2/g$) | Weight average particle diameter (μm) | Number average particle diameter (μm) | Peak of molecular weight distribution | Tg (° C.) |
|---|---|---|---|---|---|---|
| Black toner | Black developer | 3.6 | 6.3 | 5.3 | 11600 | 61 |
| Yellow toner | Yellow developer | 3.5 | 6.5 | 5.5 | 11700 | 61 |
| Magenta toner | Magenta developer | 3.6 | 6.4 | 6.4 | 11600 | 61 |

Example A-9

A toner kit was constructed as follows and was then subjected to an image formation using an electrophotographic apparatus shown in FIG. 10. A significant difference of each combination was examined.

(a):

The deep cyan developer (The cyan developer 1 used in Comparative Example A-3) in the developing device 411*a*

The above magenta developer in the developing device 412

The above yellow developer in the developing device 413

The above black developer in the developing device 414

(b):

The deep cyan developer (The cyan developer 2 used in Example A-6) in the developing device 411*a*

The pale cyan developer (The cyan developer 3 used in Example A-6) in the developing device 411*b*

The above magenta developer in the developing device 412

The above yellow developer in the developing device 413

The above black developer in the developing device 414

(c):

The pale cyan developer (The cyan developer 3 used in Comparative Example A-4) in the developing device 411*b*

The above magenta developer in the developing device 412

The above yellow developer in the developing device 413

The above black developer in the developing device 414

(d):

The deep cyan developer (The cyan developer 10 used in Reference Example A-5) in the developing device 411*a*

The pale cyan developer (The cyan developer 5 used in Reference Example A-5) in the developing device 411*b*

The above magenta developer in the developing device 412

The above yellow developer in the developing device 413

The above black developer in the developing device 414

As a result, comparing with the combination (a), the combination (b) was capable of inhibiting the graininess and the roughness over the whole area from the low density area to the high density area even in secondary colors from green to violet, and also a favorable image having the extended color reproduction range was obtained.

On the other hand, in the case of the combination (c), the representable hue range was decreased, while a decrease in graininess was observed in the low density area. In the case of the combination (d), a decrease in graininess of the low concentration part for the secondary colors was observed, compared with the combination (a), while an image inferior in terms of the graininess of the intermediate area was observed. In addition, there was no increase in the representable color space, and the color space was smaller than that of the combination (a). In other words, the effects of the present invention were sufficiently exerted in a full-color electrophotographic apparatus of the present example by using the deep cyan toner and the pale cyan toner having the hue range defined in the present invention like in the combination (b).

Example A-10

Using the following combinations, the respective toner kits were prepared and evaluated by the same way as that of Example A-6, except that a commercially available full-color one-component image forming apparatus (the Creative Processor 660, manufactured by Canon Inc.) was used.

(a):

Deep cyan toner (Cyan toner 7 was used as a deep cyan one-component developer) in a cyan developing device (b):

Pale cyan toner (Cyan toner 8 was used as a pale cyan one-component developer) in a cyan developing device (c):

Deep cyan toner (Cyan toner 7 was used as a deep cyan one-component developer) in a cyan developing device Pale cyan toner (Cyan toner 8 was used as a pale cyan one-component developer) in a magenta developing device (d):

Cyan toner (Cyan toner 10 was used as a deep cyan one-component developer) in a cyan developing device Cyan toner (Cyan toner 9 was used as a pale cyan one-component developer) in a magenta developing device.

As a result, the combination (c) was the best in inhibiting the graininess and the roughness, and also a favorable image having the extended color reproduction range was obtained. Consequently, it was confirmed that the effects of the present invention was sufficiently exerted even in the one-component developing device.

Manufacturing Example 1 of Magenta Toner

| | |
|---|---|
| Polyester resin (acid value of 7 mg KOH/g) prepared by a condensation polymerization of polyoxypropylene (2,2)-2,2-bis (4-hydroxyphenyl)propane, fumaric acid, and 1,2,5-hexatricarboxylic acid | 100 parts by mass |
| C.I. pigment red 31 | 4.5 parts by mass |
| An aluminum compound of di-tertiary-butyl salicylic acid | 4 parts by mass |

The above raw materials were preliminary mixed with each other using a Henschel mixer, and dissolved and kneaded by a biaxial extrusion type kneader. After cooling, the mixture was roughly pulverized into powders of about 1 to 2 mm in particle diameter by a hammer mill. Subsequently, the powders were further subjected to a fine pulverization with an air-jet type fine pulverizing apparatus. The resulting fine pulverized products were classified, thereby obtaining magenta toner particles having a weight average particle diameter of 6.1 $\mu$m.

A deep magenta toner 1 was obtained by externally adding 2.4 parts by mass of dry silica (120 $m^2/g$ in BET in specific surface area) having a primary particle diameter of 12 nm being treated with silicone oil and hexamethyldisilazane to 100 parts by mass of the obtained magenta particles. The physical properties of the deep magenta toner 1 are shown in Table 8-1, 8-2, and Table 9.

Manufacturing Examples 2 to 6 of Magenta Toner

A deep magenta toner 2 and pale magenta toners 1 to 4 were obtained by the same way as that of Manufacturing Example 1 of the magenta toner, except that the type and addition amount of the colorant, the addition amounts of the charge control agent and the external agent were changed to those listed in Table 8-1. The physical properties of the deep magenta toner 2 and the pale magenta toners 1 to 4 were listed in Table 8-1, 8-2, and Table 9.

Manufacturing Example 7 of Magenta Toner

In a four-neck flask (2 liters) equipped with a high-speed stirrer TK-homo mixer, 350 parts by mass of ion-exchange water and 225 parts by mass of a 0.1 mol/l $Na_3PO_4$ aqueous solution were added. Then, the revolving speed of the homo mixer was adjusted to 12,000 rpm, and the aqueous solution was heated at 65° C. Subsequently, 34 parts by mass of an 10 mol/l $CaCl_2$ aqueous solution was gradually added. Consequently, a water dispersing medium containing a minute water-insoluble dispersant $Ca_3(PO_4)_2$ was prepared.

| | |
|---|---|
| Styrene | 83 parts by mass |
| n-butyl acrylate | 17 parts by mass |
| Divinyl benzene | 0.2 parts by mass |
| C.I. pigment red 122 | 6 parts by mass |
| Saturated polyester resin (terephthalic acid - propylene oxide denatured bisphenol A copolymer, acid value = 15 mg KOH/g) | 5 parts by mass |
| An aluminum compound of di-tertiary-butyl salicylic acid | 3 parts by mass |
| Ester wax (melting point 76° C.) | 13 parts by mass |

Using an attritor, the above materials were dispersed for 3 hours to prepare a polymeric monomer composition. After that, 4 parts by mass of 2,2'-azobis (2,4-dimethylvaleronitrile), which was a polymerization initiator, was added in the polymeric monomer composition. Then, the polymeric monomer composition was introduced into the above water dispersing medium and was pulverized by stirring for 15 minutes while keeping a revolving number of 12,000 rpm. Subsequently, the stirring device was changed from the high-speed stirring device to a typical propeller stirring device, and the inside temperature of the flask was increased to 80° C. while keeping a revolving number of 150 rpm to conduct a polymerization for 10 hours. After the polymerization, the water dispersing medium was cooled and added with dilute hydrochloric acid to dissolve the water-insoluble dispersant, followed by washing and drying. Consequently, magenta toner particles having a weight average particle diameter of 5.3 μm were obtained.

A deep magenta toner 3 was obtained by externally adding 2.2 parts by mass of dry silica (120 $m^2/g$ in BET in specific surface area) having a primary particle diameter of 12 nm being treated with silicone oil and hexamethyldisilazane to 100 parts by mass of the obtained magenta particles. The physical properties of the deep magenta toner 3 were obtained in the same manner as in the case of the deep magenta toner 1 and are shown in Table 8-1, 8-2, and Table 9.

Manufacturing Examples 8 to 11 of Magenta Toner

A deep magenta toner 4 and pale magenta toners 5 to 7 were obtained by the same way as that of Manufacturing Example 7 of the magenta toner, except that the addition amounts of the colorant, the charge control agent, and the external agent were changed to those listed in Table 8-1. The physical properties of the deep magenta toner 4 and the pale magenta toners 5 to 7 obtained in the same manner as in the case of the deep magenta toner 1 were listed in Table 8-1, 8-2, and Table 9.

TABLE 8-1

| Manufacturing Examples of toner | Toner | Colorant | Addition amounts of colorant (parts by mass) | Addition amounts of charge control agent (parts by mass) | Addition amounts of external agent (parts by mass) |
|---|---|---|---|---|---|
| 1 | Deep magenta toner 1 | Pigment Red 31 | 4.5 | 4 | 2.4 |
| 2 | Deep magenta toner 2 | Pigment Red 269 | 7 | 3.5 | 2.5 |
| 3 | Pale magenta toner 1 | Pigment Red 31 | 0.6 | 2.5 | 2 |
| 4 | Pale magenta toner 2 | Pigment Red 269 | 1.2 | 2 | 2 |
| 5 | Pale magenta toner 3 | Pigment Red 122<br>Pigment Violet 23 | 0.3<br>0.3 | 4 | 2.5 |
| 6 | Pale magenta toner 4 | Solvent Red 23 | 0.7 | 4 | 2.8 |
| 7 | Deep magenta toner 3 | Pigment Red 122 | 6 | 3 | 2.2 |
| 8 | Deep magenta toner 4 | Pigment Red 150 | 6 | 4 | 2.5 |
| 9 | Pale magenta toner 5 | Pigment Red 122 | 1 | 2 | 1.8 |
| 10 | Pale magenta toner 6 | Pigment Red 150 | 1 | 2.5 | 2.1 |
| 11 | Pale magenta toner 7 | Solvet Red 24 | 0.4 | 3 | 2 |

TABLE 8-2

| Manufacturing Examples of toner | Toner | BET in specific surface area ($m^2/g$) | Weight average particle diameter (μm) | Number average particle diameter (μm) | Peak of molecular weight distribution | Tg (° C.) |
|---|---|---|---|---|---|---|
| 1 | Deep magenta toner 1 | 4.7 | 6.1 | 5.2 | 11800 | 62 |
| 2 | Deep magenta toner 2 | 4.8 | 6.7 | 5.8 | 11700 | 62 |
| 3 | Pale magenta | 3.4 | 7.2 | 6.3 | 11600 | 61 |

TABLE 8-2-continued

| Manufacturing Examples of toner | Toner | BET in specific surface area ($m^2/g$) | Weight average particle diameter ($\mu m$) | Number average particle diameter ($\mu m$) | Peak of molecular weight distribution | Tg (° C.) |
|---|---|---|---|---|---|---|
| | toner 1 | | | | | |
| 4 | Pale magenta toner 2 | 3.6 | 6.7 | 5.8 | 11500 | 61 |
| 5 | Pale magenta toner 3 | 4.9 | 5.7 | 4.8 | 11500 | 61 |
| 6 | Pale magenta toner 4 | 5.2 | 6.4 | 5.5 | 12100 | 61 |
| 7 | Deep magenta toner 3 | 4.3 | 5.2 | 4.6 | 18600 | 57 |
| 8 | Deep magenta toner 4 | 4.4 | 5.5 | 4.9 | 22400 | 58 |
| 9 | Pale magenta toner 5 | 3.1 | 5.8 | 5.1 | 17800 | 57 |
| 10 | Pale magenta toner 6 | 3.2 | 6.7 | 5.8 | 20700 | 57 |
| 11 | Pale magenta toner 7 | 3.3 | 5.4 | 4.8 | 22800 | 58 |

TABLE 9

| Manufacturing Examples of toner | Toner | Tribo (mC/kg) | Hue angle at toner amount of 0.5 $mg/cm^2$ | Value of L* when c* = 30 | Value of b* when a* = −20 | Value of b* when a* = −30 | Image density (0.5 $mg/cm^2$) | Image density (1 $mg/cm^2$) |
|---|---|---|---|---|---|---|---|---|
| 1 | Deep magenta toner 1 | −32.4 | 346.1 | 77.3 | −7.6 | −9.8 | 1.08 | 1.46 |
| 2 | Deep magenta toner 2 | −31.5 | 352.7 | 79.6 | −5.3 | −7.2 | 1.38 | 1.73 |
| 3 | Pale magenta toner 1 | −30.1 | 332.5 | 80.5 | −12 | −15.9 | 0.28 | 0.54 |
| 4 | Pale magenta toner 2 | −31.8 | 341.9 | 84.1 | −10.4 | −13.1 | 0.53 | 0.87 |
| 5 | Pale magenta toner 3 | −35.3 | 312.8 | 78.1 | −24.1 | −32.5 | 0.29 | 0.56 |
| 6 | Pale magenta toner 4 | −34.7 | 16.4 | 78.6 | 6.1 | 8.7 | 0.41 | 0.78 |
| 7 | Deep magenta toner 3 | −34.1 | 342.4 | 82.6 | −7.9 | −11.7 | 1.15 | 1.54 |
| 8 | Deep magenta toner 4 | −33.2 | 359.2 | 81.8 | −3.6 | −3.8 | 1.09 | 1.58 |
| 9 | Pale magenta toner 5 | −34.1 | 334.8 | 85.1 | −9.9 | −13.8 | 0.48 | 0.84 |
| 10 | Pale magenta toner 6 | −32.7 | 342.6 | 84.3 | −7.8 | −9.9 | 0.45 | 0.83 |
| 11 | Pale magenta toner 7 | −35.3 | 11.3 | 87.4 | 4.1 | 5.9 | 0.23 | 0.41 |

Example B-1

The pale magenta toner 1 and the ferrite carrier (42 $\mu m$ in average particle diameter) surface-coated with a silicone resin were mixed together such that the concentration of the toner became 6% by mass to prepare a pale magenta two-component developer. In addition, the deep magenta toner 1 and the ferrite carrier (42 $\mu m$ in average particle diameter) surface-coated with a silicone resin were mixed together such that the concentration of the toner became 6% by mass to prepare a deep magenta two-component developer.

The pale magenta two-component developer and the deep magenta two-component developer were joined together to provide a magenta toner kit 1.

In a commercially available ordinary paper full-color copying machine (e.g., CLC1150 manufactured by Canon Inc.), the two-component developer having the deep magenta toner 1 was placed in a cyan developing device, and the two-component developer having the pale magenta toner 1 was placed in a magenta developing device. In addition, the above deep magenta toner 1 was introduced in a cyan toner hopper and the above pale magenta toner 1 was introduced in a magenta toner hopper. A patch image was formed on an ordinary paper ("TKCLA 4" for a color laser copying machine, manufactured by Canon Inc.) by overlapping, in a printer mode, an image of the pale magenta toner with a 12-level gray scale and an image of the deep magenta toner with 12-level gray scale one another while crossing each other at right angles. An example of the output image is shown in FIG. 9.

Subsequently, the values L*, a*, and b* of each patch were measured using the SpectroScan Transmission (manufactured by GretagMacbeth Co. Ltd.). In addition, the value c* was obtained from the values a* and b*. Then, the c*-L* graph was formed by plotting the values of each batch such that the horizontal axis represents the value of c* and the vertical axis represents the value L*. The area of a region, which was surrounded by the line of L*=60, the line of c*=0, and the measurement values, was obtained, and sizes of the reproducible color spaces were compared. When the value L* was less than 60, the area of a region, which was surrounded by the line passing through a point that indicated the minimum of L* and in parallel with the c* axis, the line of L*=0, and the measurement values, was measured. The evaluation results are shown in Table 10-1 and 10-2.

TABLE 10-1

| | Toner kit No. | Pale magenta toner No. | Deep magenta toner No. | $b^*_1$ | $b^*_2$ | $b^*_3$ | $b^*_4$ | $b^*_1-b^*_3$ | $b^*_2-b^*_4$ | $L^*_1$ | $L^*_2$ | $L^*_1-L^*_2$ | $H^*_1$ | $H^*_2$ | $H^*_2-H^*_1$ |
|---|---|---|---|---|---|---|---|---|---|---|---|---|---|---|---|
| Example B-1 | 1 | Pale color 1 | Deep color 1 | −12 | −15.9 | −7.6 | −9.8 | −4.4 | −6.1 | 80.5 | 77.3 | 3.2 | 332.5 | 346.1 | 13.6 |
| Example B-2 | 2 | Pale color 2 | Deep color 2 | −10.4 | −13.1 | −5.3 | −7.2 | −5.1 | −5.9 | 84.1 | 79.6 | 4.5 | 341.9 | 352.7 | 10.8 |
| Example B-3 | 3 | Pale color 2 | Deep color 1 | −10.4 | −13.1 | −7.6 | −9.8 | −2.8 | −3.3 | 84.1 | 77.3 | 6.8 | 341.9 | 346.1 | 4.2 |
| Example B-4 | 4 | Pale color 5 | Deep color 3 | −9.9 | −13.8 | −7.9 | −11.7 | −2 | −2.1 | 85.1 | 82.6 | 2.5 | 334.8 | 342.4 | 7.6 |
| Example B-5 | 5 | Pale color 6 | Deep color 4 | −7.8 | −9.9 | −3.6 | −3.8 | −4.2 | −6.1 | 84.3 | 81.8 | 2.5 | 342.6 | 359.2 | 16.6 |
| Example B-6 | 6 | Pale color 5 | Deep color 4 | −9.9 | −13.8 | −3.6 | −3.8 | −6.3 | −10 | 85.1 | 81.8 | 3.3 | 334.8 | 359.2 | 24.4 |
| Example B-7 | 7 | Pale color 2 | Deep color 3 | −10.4 | −13.1 | −7.9 | −11.7 | −2.5 | −1.4 | 84.1 | 82.6 | 1.5 | 341.9 | 342.4 | 0.5 |
| Comparative Example B-1 | 8 | — | Deep color 1 | −7.6 | −9.8 | −7.6 | −9.8 | 0 | 0 | 77.3 | 77.3 | 0 | 346.1 | 346.1 | 0 |
| Comparative Example B-2 | 9 | Pale color 5 | — | −9.9 | −13.8 | −9.9 | −13.8 | 0 | 0 | 85.1 | 85.1 | 0 | 334.8 | 334.8 | 0 |
| Reference Example B-1 | 10 | Pale color 3 | Deep color 1 | −24.1 | −32.5 | −7.6 | −9.8 | −16.5 | −22.7 | 78.1 | 77.3 | 0.8 | 312.8 | 346.1 | 33.3 |
| Reference Example B-2 | 11 | Pale color 7 | Deep color 3 | 4.1 | 5.9 | −7.9 | −11.7 | 12 | 17.6 | 87.4 | 82.6 | 4.8 | 11.3 | 342.4 | −28.9 |
| Reference Example B-3 | 12 | Pale color 4 | Deep color 1 | 6.1 | 8.7 | −7.6 | −9.8 | 13.7 | 18.5 | 78.6 | 77.3 | 1.3 | 16.4 | 346.1 | −30.3 |

Pale color: Pale magenta toner
Deep color: Deep magenta toner

Furthermore, a patch image of a low density area where L* was in the range of 85 or more and less than 100, and a patch image of an intermediate density area where L* was in the range of 70 or more and less than 85 were extracted, respectively. Then, the graininess of each image was evaluated by visual observation on the basis of the following evaluation criteria. The evaluation results are shown in Table 10-1 and 10-2.

A: Graininess and roughness are very good.

B: Graininess and roughness are good.

C: Normal graininess and roughness are observed.

D: Graininess or roughness stands out a little but within the bounds of practical use.

E: Graininess or roughness stands out.

Examples B-2 to B-7, Comparative Examples B-1 and B-2, and Reference Examples B-1 to B-3

Toner kits were prepared and the evaluation of an image was performed by the same way as those of Example B-1, except that each of the toner kits is constructed as shown in Table 10-1. In addition, the results are shown in Table 10-1 and 10-2.

In Example B-4, for the magenta toner kit 4 that showed favorable results in the above evaluation, the same patch image as that of Example B-1 were continuously printed for 6,000 sheets, followed by supplying each toner from the magenta toner kit 4 to each hopper. Likewise, the continuous image outputs of 6,000 sheets were repeated five times. As a result, it was confirmed that an excellent image was obtained while keeping the effects of reduced graininess and the extended color reproduction range even though the continuous outputs were performed.

TABLE 10-2

| | Toner kit No. | Pale magenta toner No. | Deep magenta toner No. | Graininess: Low density area | Graininess: Intermediate density area | Color space area |
|---|---|---|---|---|---|---|
| Example B-1 | 1 | Pale color 1 | Deep color 1 | B | B | 105.2 |
| Example B-2 | 2 | Pale color 2 | Deep color 2 | A | A | 110.5 |
| Example B-3 | 3 | Pale color 2 | Deep color 1 | A | B | 106.4 |
| Bxample B-4 | 4 | Pale color 5 | Deep color 3 | A | A | 114.7 |
| Example B-5 | 5 | Pale color 6 | Deep color 4 | B | A | 112.6 |
| Example B-6 | 6 | Pale color 5 | Deep color 4 | A | B | 110.1 |
| Example B-7 | 7 | Pale color 2 | Deep color 3 | A | B | 108.8 |
| Comparative Example B-1 | 8 | — | Deep color 1 | C | B | 100.7 |
| Comparative Example B-2 | 9 | Pale color 5 | — | A | A | 82.5 |
| Reference Example B-1 | 10 | Pale color 3 | Deep color 1 | B | C | 102.2 |
| Reference Example B-2 | 11 | Pale color 7 | Deep color 3 | B | D | 98.9 |
| Reference Example B-3 | 12 | Pale color 4 | Deep color 1 | C | D | 102.4 |

Example B-8

The pale magenta toner 2 and the ferrite carrier (42 $\mu$m in average particle diameter) surface-coated with a silicone resin were mixed together such that the concentration of the toner became 6% by mass to prepare a pale magenta two-component developer. In addition, a deep magenta two-component developer was prepared by the same way as that of the pale magenta two-component developer, except that the deep magenta toner 2 was used.

The pale magenta two-component developer and the deep magenta two-component developer were joined together to provide a magenta toner kit 13.

In a commercially available ordinary paper full-color copying machine (e.g., CLC1150 manufactured by Canon Inc.), the two-component developer having the deep magenta toner was placed in a cyan developing device, and the two-component developer having the pale magenta toner was placed in a magenta developing device. In addition, the above deep magenta toner 2 was introduced in a cyan toner hopper and the above pale magenta toner 2 was introduced in a magenta toner hopper. Using an ordinary paper ("TKCLA 4" for a color laser copying machine, manufactured by Canon Inc.), the graininess and roughness of the image outputted according to FIG. 15 was evaluated by visual observation on the basis of the following evaluation criteria by the same way as that of Example B-1. The evaluation results are shown in Table 11-1 and 11-2.

A: Graininess and roughness are very good.

B: Graininess and roughness are good.

C: Normal graininess and roughness are observed.

D: Graininess or roughness stands out a little but within the bounds of practical use.

E: Graininess or roughness stands out.

Furthermore, the gradation of each image was evaluated by visual observation on the basis of the following evaluation criteria. The evaluation results are shown in Table 11-1 and 11-2.

A: Gradation is very good.

B: Gradation is good.

C: Normal gradation is observed.

D: Insufficient gradation was observed, or unreasonable.

Just as in the case of Example B-1, the c*-L* graph was formed. The area of a region, which was surrounded by the line of L*=60, the line of c*=0, and measurement values, was obtained, and sizes of the reproducible color spaces were compared. When the value L* was less than 60, the area of a region, which was surrounded by the line passing through a point that indicated the minimum of L* and in parallel with the c* axis, the line of L*=0, and the measurement values, was measured. The evaluation results are shown in Table 11-1 and 11-2.

Comparative Examples B-3 and B-4

A deep magenta two-component developer or a pale magenta two-component developer was placed in the magenta developing device, while the toner is introduced into a magenta toner hopper. In this example, the cyan developing device was not used. The evaluation of an image was performed by the same way as that of Example B-8, except that the output was performed according to FIG. 17. The results are shown in Table 11-1 and 11-2.

Examples B-9 to B-12, Reference Examples B-4 and B-5

Toner kits were prepared and the evaluation of an image was performed by the same way as those of Example B-8, except that each of the toner kits is constructed as shown in Table 11-1. The results are shown in Table 11-1 and 11-2.

TABLE 11-1

| | Toner kit No. | Pale magenta toner No. | Deep magenta toner No. | $b^*_1$ | $b^*_2$ | $b^*_3$ | $b^*_4$ | $b^*_1-b^*_3$ | $b^*_2-b^*_4$ | $L^*_1$ | $L^*_2$ | $L^*_1-L^*_2$ | $H^*_1$ | $H^*_2$ | $H^*_2-H^*_1$ |
|---|---|---|---|---|---|---|---|---|---|---|---|---|---|---|---|
| Example B-8 | 13 | Pale color 2 | Deep color 2 | −10.4 | −13.1 | −5.3 | −7.2 | −5.1 | −5.9 | 84.1 | 79.6 | 4.5 | 342 | 352.7 | 10.8 |
| Example B-9 | 14 | Pale color 2 | Deep color 1 | −10.4 | −13.1 | −7.6 | −9.8 | −2.8 | −3.3 | 84.1 | 77.3 | 6.8 | 342 | 346.1 | 4.2 |
| Example B-10 | 15 | Pale color 5 | Deep color 3 | −9.9 | −13.8 | −7.9 | −11.7 | −2 | −2.1 | 85.1 | 82.6 | 2.5 | 335 | 342.4 | 7.6 |
| Example B-11 | 16 | Pale color 5 | Deep color 4 | −9.9 | −13.8 | −3.6 | −3.8 | −6.3 | −10 | 85.1 | 81.8 | 3.3 | 335 | 359.2 | 24.4 |
| Example B-12 | 17 | Pale color 2 | Deep color 3 | −10.4 | −13.1 | −7.9 | −11.7 | −2.5 | −1.4 | 84.1 | 82.6 | 1.5 | 342 | 342.4 | 0.5 |
| Comparative Example B-3 | 18 | — | Deep color 1 | — | — | −7.6 | −9.8 | — | — | — | 77.3 | — | — | 346.1 | — |
| Comparative Example B-4 | 19 | Pale color 5 | — | −9.9 | −13.8 | — | — | — | — | 85.1 | — | — | 335 | — | — |
| Reference Example B-4 | 20 | Pale color 3 | Deep color 1 | −24.1 | −32.5 | −7.6 | −9.8 | −16.5 | −22.7 | 78.1 | 77.3 | 0.8 | 313 | 346.1 | 33.3 |
| Reference Example B-5 | 21 | Pale color 7 | Deep color 3 | 4.1 | 5.9 | −7.9 | −11.7 | 12 | 17.6 | 87.4 | 82.6 | 4.8 | 11.3 | 342.4 | −28.9 |

Pale color: Pale magenta toner

Deep color: Deep magenta toner

TABLE 11-2

| | Toner kit No. | Pale magenta toner No. | Deep magenta toner No. | Graininess: Low density area | Graininess: Intermediate density area | Gradation | Color space area |
|---|---|---|---|---|---|---|---|
| Example B-8 | 13 | Pale color 2 | Deep color 2 | A | A | A | 110.8 |
| Example B-9 | 14 | Pale color 2 | Deep color 1 | A | B | B | 106.6 |
| Example B-10 | 15 | Pale color 5 | Deep color 3 | A | A | A | 114.9 |
| Example B-11 | 16 | Pale color 5 | Deep color 4 | A | B | A | 111.5 |
| Example B-12 | 17 | Pale color 2 | Deep color 3 | A | A | B | 109.1 |
| Comparative Example B-3 | 18 | — | Deep color 1 | C | B | C | 99.5 |
| Comparative Example B-4 | 19 | Pale color 5 | — | A | A | D | 76.2 |
| Reference Example B-4 | 20 | Pale color 3 | Deep color 1 | B | C | C | 100.3 |
| Reference Example B-5 | 21 | Pale color 7 | Deep color 3 | B | D | C | 99 |

Manufacturing Examples of Black Toner, Yellow Toner, and Cyan Toner

A black toner, a yellow toner, and a cyan toner were prepared by the same way as that of Manufacturing Example 7 of the magenta toner, except that the addition amount of each of the colorant, charge control agent, and external additive was changed to one listed in Table 12-1. The physical properties thereof are shown in Table 12-2.

TABLE 12-1

| Toner | Colorant | Addition amounts of the colorant (parts by mass) | Addition amounts of the charge control agent (parts by mass) | Addition amounts of the external agent (parts by mass) |
|---|---|---|---|---|
| Black toner | Carbon black | 6 | 3 | 2 |
| Yellow toner | Pigment Yellow 17 | 5 | 3 | 2 |
| Magenta toner | Pigment Red 122 | 5 | 3 | 2 |

TABLE 12-2

| Toner | BET in specific surface area ($m^2/cm^3$) | Weight average particle diameter ($\mu m$) | Number average particle diameter ($\mu m$) | Peak of molecular weight distribution | Tg (° C.) |
|---|---|---|---|---|---|
| Black toner | 3.6 | 6.3 | 5.3 | 11600 | 61 |
| Yellow toner | 3.5 | 6.5 | 5.5 | 11700 | 61 |
| Magenta toner | 3.6 | 6.4 | 5.4 | 11600 | 61 |

Example B-13

Two-component developers were prepared by the same way as that of Example B-8 using the toners listed below. Each toner kit includes four or five kinds of the prepared two-component developers. An image formation was performed using an electrophotographic apparatus shown in FIG. 10 to examine a significant difference.

(a):
The deep magenta toner 1
The above cyan toner
The above yellow toner
The above black toner (b):
The deep magenta toner 3
The pale magenta toner 5
The above cyan toner
The above yellow toner
The above black toner (c):
The pale magenta toner 3
The above cyan toner
The above yellow toner
The above black toner (d):
The deep magenta toner 1
The pale magenta toner 3
The above cyan toner
The above yellow toner
The above black toner As a result, comparing with the combination (a), the combination (b) was capable of inhibiting the graininess and the roughness over the whole area from the low density area to the high density area even in secondary colors from orange to violet, and also a favorable image having the extended color reproduction range was obtained.

On the other hand, in the case of the combination (c), the representable hue range was decreased, while a decrease in graininess was observed in the low density area in the case of the combination (d), a decrease in graininess of the low concentration part for the secondary colors was observed, compared with the combination (a), while an image superior in terms of graininess of the intermediate area was observed. In addition, there was no increase in the representable color space, and the color space was smaller than that of the combination (a). In other words, the effects of the present invention were sufficiently exerted in a full-color electrophotographic apparatus of the present example by using the deep magenta toner and the pale magenta toner having the hue range defined in the present invention like in the combination (b).

Example B-14

Using the following combinations, the respective toner kits were prepared and evaluated by the same way as that of Example B-8, except that a commercially available full-color one-component image forming apparatus (the Creative Processor 660, manufactured by Canon Inc.) was used.

(a):

Deep magenta toner (Deep magenta toner 3 was used as a one-component developer) in a cyan developing device (b):

Pale magenta toner. (Pale magenta toner 5 was used as a one-component developer) in a cyan developing device (c):

Deep magenta toner (Deep magenta toner 3 was used as a one-component developer) in a cyan developing device Pale magenta toner (Pale magenta toner 5 was used as a one-component developer) in a magenta developing device (d):

Deep magenta toner (Deep magenta toner 3 was used as a one-component developer) in a cyan developing device Pale magenta toner (Pale magenta toner 7 was used as a one-component developer) in a magenta developing device.

As a result, the combination (c) was the best in inhibiting the graininess and the roughness, and also a favorable image having the extended color reproduction range was obtained. Consequently, it was confirmed that the effects of the present invention was sufficiently exerted even in the one-component developing device.

Example C-1

In a four-neck flask (2 liters) equipped with a high-speed stirrer TK-homo mixer, 350 parts by mass of ion-exchange water and 225 parts by mass of a 0.1 mol/l $Na_3PO_4$ aqueous solution were added. Then, the revolving speed of the homo mixer was adjusted to 12,000 rpm, and the aqueous solution was heated at 65° C. Subsequently, 34 parts by weight of a 1.0 mol/l $CaCl_2$ aqueous solution was gradually added. Consequently, a water dispersing medium containing a minute water-insoluble dispersant $Ca_3(PO_4)_2$ was prepared.

| | |
|---|---|
| Styrene | 78 parts by mass |
| n-butyl acrylate | 22 parts by mass |
| Divinyl benzene | 0.2 parts by mass |
| C.I. pigment blue 15:3 | 0.5 parts by mass |
| C.I. pigment green 7 | 0.1 parts by mass |

-continued

| | |
|---|---|
| Saturated polyester resin (terephthalic acid - propylene oxide denatured bisphenol A copolymer, acid value = 15 mg KOH/g) | 5 parts by mass |
| Charge control agent (An aluminum compound of di-tertiary-butyl salicylic acid) | 3.5 parts of mass |
| Ester wax (melting point 76° C.) | 13 parts by mass |

Using an attritor, the above materials were dispersed for 3 hours to prepare a polymeric monomer composition. After that, 4 parts by mass of 2,2'-azobis (2,4-dimethylvaleronitrile), which was a polymerization initiator, was added in the polymeric monomer composition. Then, the polymeric monomer composition was introduced into the above water dispersing medium and was pulverized by stirring for 15 minutes while keeping a revolving number of 12,000 rpm. Subsequently, the stirring device was changed from a high-speed stirring device to a typical propeller stirring device, and the inside temperature of the flask was increased to 80° C. while keeping a revolving number of 150 rpm to conduct a polymerization for 10 hours. After the polymerization, the water dispersing medium was cooled and added with dilute hydrochloric acid to dissolve the water-insoluble dispersant, followed by washing and drying. Consequently, pale cyan toner particles having a weight average particle diameter of 6.3 $\mu$m were obtained.

A pale cyan toner 1 was obtained by externally adding 1.4 parts by mass of dry silica (120 $m^2/g$ in BET in specific surface area) having a primary particle diameter of 12 nm being treated with silicone oil and hexamethyldisilazane to 100 parts by mass of the obtained pale cyan toner particles.

A pale magenta toner 1 was obtained by the same way as that of Manufacturing Example 1 of the pale cyan toner, except that the type and addition amount of the colorant, the addition amounts of the charge control agent and the external agent were changed to those listed in Table 13-1.

In a four-neck flask (2 liters) equipped with a high-speed stirrer TK-homo mixer, 350 parts by mass of ion-exchange water and 225 parts by mass of a 0.1 mol/l $Na_3PO_4$ aqueous solution were added. Then, the revolving speed of the homo mixer was adjusted to 12,000 rpm, and the aqueous solution was heated at 65° C. Subsequently, 34 parts by weight of a 1.0 mol/l $CaCl_2$ aqueous solution was gradually added. Consequently, a water dispersing medium containing a minute water-insoluble dispersant $Ca_3(PO_4)_2$ was prepared.

| | |
|---|---|
| Styrene | 83 parts by mass |
| n-butyl acrylate | 17 parts by mass |
| Divinyl benzene | 0.2 parts by mass |
| C.I. pigment blue 15:3 | 4.2 parts by mass |
| Saturated polyester resin (terephthalic acid - propylene oxide denatured bisphenol A copolymer, acid value = 15 mg KOH/g) | 5 parts by mass |
| Charge control agent (An aluminum compound of di-tertiary-butyl salicylic acid) | 3.5 parts of mass |
| Ester wax (melting point 76° C.) | 13 parts by mass |

Using an attritor, the above materials were dispersed for 3 hours to prepare a polymeric monomer composition. After that, 4 parts by mass of 2,2'-azobis (2,4-dimethylvaleronitrile), which was a polymerization initiator, was added in the polymeric monomer composition. Then, the polymeric monomer composition was introduced into the above water dispersing medium and was pulverized by stirring for 15 minutes while keeping a revolving number of 12,000 rpm. Subsequently, the stirring device was changed from the high-speed stirring device to a typical propeller stirring device, and the inside temperature of the flask was increased to 80° C. while keeping a revolving number of 150 rpm to conduct a polymerization for 10 hours. After the polymerization, the water dispersing medium was cooled and added with dilute hydrochloric acid to dissolve the water-insoluble dispersant, followed by washing and drying. Consequently, deep cyan toner particles having a weight average particle diameter of 5.4 μm were obtained.

A deep cyan toner 1 was obtained by externally adding 2.5 parts by mass of dry silica (120 $m^2/g$ in BET in specific surface area) having a primary particle diameter of 12 nm being treated with silicone oil and hexamethyldisilazane to 100 parts by mass of the obtained deep cyan toner particles.

A deep magenta toner 1, a yellow toner 1, and a black toner 1 were obtained by the same way as that of Manufacturing Example 1 of the deep cyan toner, except that the type and addition amount of the colorant, the addition amounts of the charge control agent and the external agent were changed to those listed in Table 13-1.

The physical properties of each toner are shown in Table 13-2. Each of these toners and a ferrite carrier (42 μm in average particle diameter) surface-coated with a silicone resin were mixed together such that the concentration of the toner became 6% by mass. Consequently, a two-component developer was prepared.

A toner kit 1 was provided by combining a pale cyan two-component developer containing the pale cyan toner 1, a pale magenta two-component developer containing the pale magenta toner 1, a deep cyan two-component developer containing the deep cyan toner 1, a deep magenta two-component developer containing the deep magenta toner 1, a yellow two-component developer containing a yellow toner 1, and a black two-component developer containing the black toner 1.

The toner kit 1 constructed as described above was evaluated by being subjected to an image formation using the electrophotographic apparatus shown in FIG. 10. In this example, the pale cyan two-component developer was placed in the developing device 411*a*, the pale magenta two-component developer was placed in the developing device 411*b*, the yellow two-component developer was placed in the developing device 412, the deep cyan two-component developer was placed in the developing device 413, the deep magenta two-component developer was placed in the developing device 414, and the black two-component developer was placed in the developing device 415, respectively. At the time of placing the two-component developer in each developing device, the pale cyan toner 1 was introduced into a toner hopper of the developing device 411*a*, the pale magenta toner 1 was introduced into a toner hopper of the developing device 411*b*, the yellow toner 1 was introduced into a toner hopper of the developing device 412, the deep cyan toner 1 was introduced into a toner hopper of the developing device 413, the deep magenta toner 1 was introduced into a toner hopper of the developing device 414, and the black toner 1 was introduced into a toner hopper of the developing device 415, respectively.

A cyan image with a 12-level gray scale was formed based on FIG. 15 using the pale cyan toner and the deep cyan toner, and a magenta image with a 12-level gray scale was formed based on FIG. 15 using the pale magenta toner and the deep magenta toner. Also, a yellow image and a black image with a 12-level gray scale were formed based on FIG. 17 using the yellow toner and the black toner, respectively. A patch image was formed on the ordinary paper ("TKCLA 4" for a color laser copying machine, manufactured by Canon Inc.) by overlapping, in a printer mode, the cyan image and the magenta image, the cyan image and the yellow image, and the magenta image and the yellow image one another while crossing each other at right angles. An example of the output image is shown in FIG. 9.

The values of L*, a*, and b* of the output image were measured using SpectroScan Transmission (manufactured by GretagMacbeth Co., Ltd.), respectively. The value c* was obtained from the values a* and b*. Then, the c*-L* graph was formed by plotting the values for each color such that the horizontal axis represents the value of c* and the vertical axis represents the value L*. Furthermore, a patch image of a low density area where c* was in the range of 1 or more and less than 20, and a patch image of an intermediate density area where c* was in the range of 20 or more and less than 40 were extracted, respectively. Then, the graininess of each image was evaluated by visual observation on the basis of the following evaluation criteria.

A: Graininess and roughness are very good.

B: Graininess and roughness are good.

C: Normal graininess and roughness are observed.

D: Graininess or roughness stands out a little but within the bounds of practical use.

E: Graininess or roughness stands out.

The evaluation results are shown in Table 16-2. According to the present example, the graininess and the roughness over the whole area from the low density area to the high density area were inhibited, and also a favorable image having the extended color reproduction range was obtained.

Furthermore, a patch image with a 12-level gray scale of each of cyan, magenta, red, green, and blue was outputted, and the c*-L* graph was formed as described above. The area of a region, which was surrounded by the line of L*=60, the line of c*=0, and measurement values, was obtained. Then, sizes of the reproducible color spaces were compared. When the value L* was less than 60, the area of a region, which was surrounded by the line passing through a point that indicated the minimum of L* and in parallel with the c* axis, the line of L*=0, and the measurement values, was measured. The evaluation results are shown in Table 16-1.

Furthermore, an image in which a printing ratio of each toner was 10% was continuously outputted for 6,000 sheets, followed by supplying each toner. Likewise, the continuous image outputs of 6,000 sheets were repeated five times. As a result, it was confirmed that an excellent image was obtained while keeping the effects of reduced graininess and the extended color reproduction range even though the continuous outputs were performed.

Example C-2

A pale cyan toner 2 and a deep magenta toner 2 were obtained by the same way as that of Manufacturing Example 1 of the deep cyan toner, except that the type and addition amount of the colorant, the addition amounts of the charge control agent and the external agent were changed to those listed in Table 13-1. The physical properties of each toner are listed in Table 13-2.

Using the resulting toners, likewise the case of Example C-1, the pale cyan two-component developer containing the pale cyan toner 2, the pale magenta two-component developer containing the pale magenta toner 1, the deep cyan two-component developer containing the deep cyan toner 1, the deep magenta two-component developer containing the deep magenta toner 2, the yellow two-component developer containing the yellow toner 1, and the black two-component developer containing the black toner 1 were prepared, respectively. A toner kit 2 was provided by combining these developers.

The toner kit 2 constructed as described above was used for an image formation, and evaluation of the obtained image was conducted. As a result, even though the extent of the color reproduction range was slightly smaller than that of Example C-1, a favorable image, where the graininess and the roughness over the whole area from the low density area to the high density area were inhibited, was obtained. The evaluation results are shown in Table 15-1, 15-2, 16-1, and 16-2.

Comparative Example C-1

In the toner kit 1 of Example C-1, a toner kit 3 having four kinds of developers excluding the pale cyan two-component developer and the pale magenta two-component developer was prepared. The physical properties of each toner contained in the toner kit 3 are shown in Table 13-2. In this example, the developing device 411*a* and the developing device 411*b* were not used. The evaluation of an image was performed likewise the case of Example C-1, except that a patch image was obtained by outputting a color image for each toner on the basis of FIG. 17. Consequently, the color reproduction range was smaller than that of Example C-1, and there were observed graininess and roughness in the low density area. The evaluation results are shown in Table 15-1, 15-2, 16-1, and 16-2.

Comparative Example C-2

In the toner kit 1 of Example 1, a toner kit 4 including four kinds of developers except of the deep cyan two-component developer and the deep magenta two-component developer was prepared. The physical properties of each toner contained in the toner kit 4 are shown in Table 14-2. In this example, the developing device 411*a* and the developing device 411*b* were not used. The evaluation of an image was performed likewise the case of Example C-1, except that a patch image was obtained by outputting a color image for each toner on the basis of FIG. 17. Consequently, the color reproduction range was extremely small even though there was no graininess observed in the low density area for the whole color gamut. The evaluation results are shown in Table 16-2.

Reference Example C-1

A pale cyan toner 3, a pale magenta toner 2, and a deep cyan toner 2 were-obtained by the same way as that of Manufacturing Example 1 of the pale cyan toner, except that the type and addition amount of the colorant, the addition amounts of the charge control agent and the external agent were changed to those listed in Table 14-1. The physical properties of each toner are listed in Table 14-2.

Using the resulting toners, likewise the case of Example C-1, the pale cyan two-component developer containing the pale cyan toner 3, the pale magenta two-component developer containing the pale magenta toner 2, the deep cyan two-component developer containing the deep cyan toner 2, the deep magenta two-component developer containing the deep magenta toner 1, the yellow two-component developer containing the yellow toner 1, and the black two-component developer containing the black toner 1 were prepared, respectively. A toner kit 5 was provided by using the above developers in combination.

The toner kit 5 constructed as described above was used for image formation and evaluation of the obtained image was conducted. As a result, the color reproduction range was smaller than that of Example C-1, and graininess and roughness stood out in the intermediate density area. The evaluation results are shown in Table 16-2.

Example C-3

| | |
|---|---|
| Polyester resin (acid value of 7 mg KOH/g) prepared by a condensation polymerization of polyoxypropylene (2,2)-2,2-bis(4-hydroxy-phenyl)propane, fumaric acid, and 1,2,5-hexatricarboxylic acid | 100 parts by mass |
| C.I. pigment blue 15:3 | 0.5 parts by mass |
| An aluminum compound of di-tertiary-butyl salicylic acid | 2.6 parts by mass |

The above raw materials were preliminary mixed with each other using a Henschel mixer, and dissolved and kneaded by a biaxial extrusion type kneader. After cooling, the mixture was roughly pulverized into powders of about 1 to 2 mm in particle diameter by a hammer mill. Subsequently, the powders were further subjected to a fine pulverization with an air-jet type fine pulverizing apparatus. The resulting fine pulverized products were classified, thereby obtaining pale cyan toner particles having a weight average particle diameter of 7.3 $\mu$m.

A pale cyan toner 4 was obtained by externally adding 2.2 parts by mass of dry silica (120 $m^2/g$ in BET in specific surface area) having a primary particle diameter of 12 nm being treated with silicone oil and hexamethyldisilazane to 100 parts by mass of the obtained pale cyan toner particles. A pale magenta toner 3, a deep cyan toner 3, a deep magenta toner 3, a yellow toner 2, and a black toner 2 were obtained by the same way as that of Manufacturing Example 4 of the deep cyan toner, except that the type and addition amount of the colorant, the addition amounts of the charge control agent and the external agent were changed to those listed in Table 14-1. The physical properties of each toner are listed in Table 14-2.

Using the resulting toners, likewise the case of Example C-1, the pale cyan two-component developer containing the pale cyan toner 4, the pale magenta two-component developer containing the pale magenta toner 3, the deep cyan two-component developer containing the deep cyan toner 3, the deep magenta two-component developer containing the deep magenta toner 3, the yellow two-component developer containing the yellow toner 3, and the black two-component developer containing the black toner 3 were prepared, respectively. A toner kit 6 was provided by joining the above developers together.

The toner kit 6 constructed as described above was used for image formation and evaluation of the obtained image was conducted. As a result, even though the color reproduction range was slightly smaller than that of Example C-1, a favorable image, where the graininess and the roughness over the whole area from the low density area to the high density area were inhibited, was obtained. The evaluation results are shown in Table 16-2.

TABLE 13-1

| Example | Toner kit | Toner | Colorant Kind | Colorant Addition amounts | Manufacturing method | Addition amounts of the charge control agent (parts by mass) | Addition amounts of the external agent (parts by mass) |
|---|---|---|---|---|---|---|---|
| Example C-1 | Toner kit 1 | Pale cyan toner 1 | C.I. Pigment Blue 15:3 | 0.6 | Polymerization | 2.3 | 1.4 |
| | | | C.I. Pigment Green 7 | 0.1 | | | |
| | | Pale magenta toner 1 | C.I. Pigment Red 122 | 1.1 | Polymerization | 1.8 | 1.4 |
| | | Deep cyan toner 1 | C.I. Pigment Blue 16:3 | 4.2 | Polymerization | 3.5 | 2.5 |
| | | Deep magenta toner 1 | C.I. Pigment Red 122 | 3.0 | Polymerization | 2.7 | 2.4 |
| | | | C.I. Pigmant Red 269 | 1.5 | | | |
| | | Yellow toner 1 | C.I. Pigment Yellow 93 | 4.2 | Polymerization | 3 | 2.5 |
| | | Black toner 1 | Carbon black | 4.8 | Polymerization | 4 | 2.6 |
| Example C-2 | Toner kit 2 | Pale cyan toner 2 | C.I. Pigment Blue 15:3 | 0.7 | Polymerization | 2.4 | 1.5 |
| | | Pale magenta toner 1 | C.I. Pigment Red 122 | 1.1 | Polymerization | 1.8 | 1.4 |
| | | Deep cyan toner 1 | C.I. Pigment Blue 15:3 | 4.2 | Polymerization | 3.6 | 2.6 |
| | | Deep magenta toner 2 | C.I. Pigment Red 122 | 4.8 | Polymerization | 2.8 | 2.4 |
| | | Yellow toner 1 | C.I. Pigment Yellow 93 | 4.2 | Polymerization | 3 | 2.6 |
| | | Black toner 1 | Carbon black | 4.8 | Polymerization | 4 | 2.6 |
| Comparative Example C-1 | Toner kit 3 | Deep cyan toner 1 | C.I. Pigment Blue 15:3 | 4.2 | Polymerization | 3.5 | 2.5 |
| | | Deep magenta toner 1 | C.I. Pigment Red 122 | 3.0 | Polymerization | 2.7 | 2.4 |
| | | | C.I. Pigment Red 269 | 1.0 | | | |
| | | Yellow toner 1 | C.I. Pigment Yellow 93 | 4.2 | Polymerization | 3 | 2.5 |
| | | Black toner 1 | Carbon black | 4.8 | Polymerization | 4 | 2.6 |

TABLE 13-2

| Example | Toner kit | Toner | BET in specific surface area ($m^2/cm^3$) | Weight average particle diameter ($\mu m$) | Tg (° C.) | Average of the Tribo (mC/kg) | Image density 0.5 $mg/cm^2$ | Image density 1.0 $mg/cm^2$ |
|---|---|---|---|---|---|---|---|---|
| Example C-1 | Toner kit 1 | Pale cyan toner 1 | 2.6 | 6.3 | 55 | −32.8 | 0.44 | 0.85 |
| | | Pale magenta toner 1 | 2.5 | 6.3 | 55 | −33.5 | 0.46 | 0.85 |
| | | Deep cyan toner 1 | 4.3 | 5.4 | 58 | −32.5 | 1.45 | 1.96 |
| | | Deep magenta toner 1 | 4.2 | 5.4 | 58 | −33.2 | 1.18 | 1.72 |
| | | Yellow toner 1 | 4.3 | 5.5 | 58 | −33.1 | 1.13 | 1.52 |
| | | Black toner 1 | 4.5 | 5.3 | 58 | −32.4 | 1.29 | 1.86 |
| Example C-2 | Toner kit 2 | Pale cyan toner 2 | 2.7 | 6.3 | 58 | −33.2 | 0.47 | 0.87 |
| | | Pale magenta toner 1 | 2.5 | 6.2 | 58 | −33.5 | 0.46 | 0.85 |
| | | Deep cyan toner 1 | 4.3 | 5.4 | 58 | −32.5 | 1.45 | 1.96 |
| | | Deep magenta toner 2 | 4.2 | 5.5 | 58 | −32.2 | 1.17 | 1.55 |
| | | Yellow toner 1 | 4.3 | 5.5 | 58 | −33.1 | 1.13 | 1.52 |
| | | Black toner 1 | 4.5 | 5.3 | 58 | −32.4 | 1.29 | 1.88 |
| Comparative Example C-1 | Toner kit 3 | Deep cyan toner 1 | 4.3 | 5.4 | 58 | −32.5 | 1.45 | 1.96 |
| | | Deep magenta toner 1 | 4.2 | 5.4 | 58 | −33.2 | 1.18 | 1.72 |
| | | Yellow toner 1 | 4.3 | 5.5 | 58 | −33.1 | 1.13 | 1.52 |
| | | Black toner 1 | 4.5 | 5.3 | 58 | −32.4 | 1.29 | 1.86 |

TABLE 14-1

| Example | Toner kit | Toner | Colorant Kind | Colorant Addition amounts | Manufacturing method | Addition amounts of the charge control agent (parts by mass) | Addition amounts of the external agent (parts by mass) |
|---|---|---|---|---|---|---|---|
| Comparative Example C-2 | Toner kit 4 | Pale cyan toner 1 | C.I. Pigment Blue 15:3 | 0.5 | Polymerization | 2.3 | 1.4 |
| | | | C.I. Pigment Green 7 | 0.1 | | | |
| | | Pale magenta toner 1 | C.I. Pigment Red 122 | 1.1 | Polymerization | 1.8 | 1.4 |
| | | Yellow toner 1 | C.I. Piginent Yellow 93 | 4.2 | Polymerization | 3 | 2.5 |
| | | Black toner 1 | Carbon black | 4.8 | Polymerization | 4 | 2.6 |
| Reference Example C-1 | Toner kit 5 | Pale cyan toner 3 | C.I. Pigment Blue 15:3 | 0.1 | Polymerization | 2.3 | 1.4 |
| | | | C.I. Pigment Green 7 | 0.4 | | | |
| | | Pale magenta toner 2 | Solvent Red 24 | 0.4 | Polymerization | 3 | 2 |
| | | Deep cyan toner 2 | C.I. Pigment Blue 60 | 10 | Polymerization | 1.5 | 1 |
| | | Deep magenta toner 1 | C.I. Pigment Red 122 | 3.0 | Polymerization | 2.7 | 2.4 |
| | | | C.I. Pigment Red 269 | 1.0 | | | |
| | | Yellow toner 1 | C.I. Pigment Yellow 93 | 4.2 | Polymerization | 3 | 2.5 |
| | | Black toner 1 | Carbon black | 4.8 | Polymerization | 4 | 2.6 |
| Example C-3 | Toner kit | Pale cyan toner 4 | C.I. Pigment Blue 15:3 | 0.5 | Pulverization | 2.6 | 2.2 |
| | | Pale magenta toner 3 | C.I. Pigment Red 122 | 0.8 | Pulverization | 2.4 | 2.1 |

TABLE 14-1-continued

| Example | Toner kit | Toner | Colorant Kind | Colorant Addition amounts | Manufacturing method | Addition amounts of the charge control agent (parts by mass) | Addition amounts of the external agent (parts by mass) |
|---|---|---|---|---|---|---|---|
| | 6 | Deep cyan toner 3 | C.I. Pigment Blue 15:3 | 3.5 | Pulverization | 3.8 | 2.5 |
| | | Deep magenta toner 3 | C.I. Pigment Red 269 | 4.5 | Pulverization | 3.6 | 2.4 |
| | | Yellow toner 2 | C.I. Pigment Yellow 93 | 4 | Pulverization | 3.5 | 2.5 |
| | | Black toner 2 | Carbon black | 4.5 | Pulverization | 4 | 2.5 |

TABLE 14-2

| Example | Toner kit | Toner | BET in specific surface area ($m^2/cm^3$) | Weight average particle diameter ($\mu$m) | Tg (° C.) | Average of the Tribo (mC/kg) | Image density 0.5 $mg/cm^2$ | Image density 1.0 $mg/cm^2$ |
|---|---|---|---|---|---|---|---|---|
| Comparative Example C-2 | Toner kit 4 | Pale cyan toner 1 | 2.6 | 6.3 | 55 | −32.8 | 0.44 | 0.85 |
| | | Pale magenta toner 1 | 2.5 | 6.2 | 55 | −33.5 | 0.46 | 0.85 |
| | | Yellow toner 1 | 4.3 | 5.5 | 58 | −33.1 | 1.13 | 1.52 |
| | | Black toner 1 | 4.5 | 5.3 | 58 | −32.4 | 1.29 | 1.86 |
| Reference Example C-1 | Toner kit 5 | Pale cyan toner 3 | 2.6 | 6.3 | 55 | −32.8 | 0.35 | 0.68 |
| | | Pale magenta toner 2 | 3.3 | 6.3 | 55 | −35.3 | 0.23 | 0.41 |
| | | Deep cyan toner 2 | 2.1 | 6.3 | 55 | −24.7 | 1.73 | 2.14 |
| | | Deep magenta toner 1 | 4.2 | 5.4 | 58 | −33.2 | 1.18 | 1.72 |
| | | Yellow toner 1 | 4.3 | 5.5 | 58 | −33.1 | 1.13 | 1.52 |
| | | Black toner 1 | 4.5 | 5.3 | 58 | −32.4 | 1.29 | 1.86 |
| Example C-3 | Toner kit 6 | Pale cyan toner 4 | 3.5 | 7.3 | 61 | −28.9 | 0.45 | 0.86 |
| | | Pale magenta toner 3 | 3.4 | 7.3 | 61 | −28.8 | 0.45 | 0.83 |
| | | Deep cyan toner 3 | 4.8 | 6.9 | 61 | −29.2 | 1.41 | 1.92 |
| | | Deep magenta toner 3 | 4.7 | 6.9 | 61 | −29.1 | 1.21 | 1.65 |
| | | Yellow toner 2 | 4.8 | 6.9 | 61 | −29.3 | 1.12 | 1.61 |
| | | Black toner 2 | 4.8 | 6.9 | 61 | −28.9 | 1.27 | 1.82 |

TABLE 15-1

| Example | Toner kit | Pale cyan toner Toner No. | $a^*_1$ | $a^*_2$ | $L^*_1$ | $H^*_1$ | Deep cyan toner Toner No. | $a^*_3$ | $a^*_4$ | $L^*_2$ | $H^*_2$ |
|---|---|---|---|---|---|---|---|---|---|---|---|
| Example C-1 | Toner kit 1 | 1 | −25.2 | −36.6 | 85.5 | 218.4 | 1 | −15.1 | −21.7 | 82.2 | 234.1 |
| Example C-2 | Toner kit 2 | 2 | −21.6 | −30.5 | 85.7 | 223.5 | 1 | −15.1 | −21.7 | 82.2 | 234.1 |
| Comparative Example C-1 | Toner kit 3 | | | | | | 1 | −15.1 | −21.7 | 82.2 | 234.1 |
| Comparative Example C-2 | Toner kit 4 | 1 | −25.2 | −36.6 | 85.5 | 218.4 | | | | | |
| Reference Example C-1 | Toner kit 5 | 3 | −34.4 | −58.1 | 84.1 | 207.4 | 2 | −5.5 | −8.2 | 73 | 261.2 |
| Example C-3 | Toner kit 6 | 4 | −21.8 | −30.7 | 85.6 | 223.3 | 3 | −16.8 | −26.5 | 82.9 | 232.8 |

TABLE 15-2

| Example | Toner kit | Pale magenta toner Toner No. | $b^*_1$ | $b^*_2$ | $L^*_3$ | $H^*_3$ | Deep magenta toner Toner No. | $b^*_3$ | $b^*_4$ | $L^*_4$ | $H^*_4$ |
|---|---|---|---|---|---|---|---|---|---|---|---|
| Example C-1 | Toner kit 1 | 1 | −9.8 | −13.7 | 85.2 | 334.9 | 1 | −7.2 | −10.9 | 82.4 | 344.3 |
| Example C-2 | Toner kit 2 | 1 | −9.8 | −13.7 | 85.2 | 334.9 | 2 | −8 | −11.9 | 82.5 | 342.1 |
| Comparative Example C-1 | Toner kit 3 | | | | | | 1 | −7.2 | −10.9 | 82.4 | 344.3 |
| Comparative Example C-2 | Toner kit 4 | 1 | −9.8 | −13.7 | 85.2 | 334.9 | | | | | |
| Reference | Toner kit | 2 | 4.2 | 5.9 | 87.4 | 11.3 | 1 | −7.2 | −10.9 | 82.4 | 344.3 |

TABLE 15-2-continued

| | | Pale magenta toner | | | | | Deep magenta toner | | | | |
|---|---|---|---|---|---|---|---|---|---|---|---|
| Example | Toner kit | Toner No. | $b^*_1$ | $b^*_2$ | $L^*_3$ | $H^*_3$ | Toner No. | $b^*_3$ | $b^*_4$ | $L^*_4$ | $H^*_4$ |
| Example C-1 | 5 | | | | | | | | | | |
| Example C-3 | Toner kit 6 | 3 | −10 | −13.9 | 85.4 | 334.4 | 3 | −5.6 | −7.7 | 80.1 | 351.9 |

TABLE 16-1

| Example | Toner kit | $a^*_1$–$a^*_3$ | $a^*_2$–$a^*_4$ | $L^*_1$–$L^*_2$ | $H^*_1$–$H^*_2$ | $b^*_1$–$b^*_3$ | $b^*_2$–$b^*_4$ | $L^*_3$–$L^*_4$ | $H^*_3$–$H^*_4$ |
|---|---|---|---|---|---|---|---|---|---|
| Example C-1 | Toner kit 1 | −10.1 | −14.9 | 3.3 | 15.7 | −2.6 | −2.8 | 2.8 | 9.4 |
| Example C-2 | Toner kit 2 | −6.5 | −8.8 | 3.5 | 10.6 | −1.8 | −1.8 | 2.7 | 7.2 |
| Comparative Example C-1 | Toner kit 3 | — | — | — | — | — | — | — | — |
| Comparative Example C-2 | Toner kit 4 | — | — | — | — | — | — | — | — |
| Reference Example C-1 | Toner kit 5 | −28.9 | −49.9 | 11.1 | 53.8 | 11.4 | 16.8 | 5 | 333 |
| Example C-3 | Toner kit 6 | −5 | −4.2 | 2.7 | 9.5 | −4.4 | −6.2 | 5.3 | 17.5 |

TABLE 16-2

| | | Graininess | | Color space | | | | |
|---|---|---|---|---|---|---|---|---|
| Example | Toner kit | Low density area | Intermediate density area | Cyan | Magenta | Red | Green | Blue |
| Example C-1 | Toner kit 1 | A | A | 117.3 | 115.1 | 114.2 | 114.8 | 110.6 |
| Example C-2 | Toner kit 2 | A | A | 112 | 110.6 | 107.7 | 108.7 | 104.1 |
| Comparative Example C-1 | Toner kit 3 | C | B | 101.5 | 99.4 | 96.9 | 97.2 | 96.6 |
| Comparative Example C-2 | Toner kit 4 | A | A | 31.3 | 32.7 | 28.4 | 29.1 | 30.5 |
| Reference Example C-1 | Toner kit 5 | B | C | 99.7 | 97.8 | 98.8 | 90.3 | 96.7 |
| Example C-3 | Toner kit 6 | A | A | 110.7 | 108.9 | 105.9 | 106.4 | 103.9 |

What is claimed is:

1. An image forming apparatus of an electrophotographic system, which performs a color image formation using a plurality of toners, wherein the image forming apparatus is configured, for at least one color, to:

use a deep toner and a pale toner which have hues different from each other;

form an image on a high lightness area using only the pale toner; and form an image on a half tone area using the deep toner and the pale toner in combination.

2. The image forming apparatus according to claim 1, wherein the deep toner and the pale toner have different lightnesses from each other at a point where a color saturation of the deep toner and a color saturation of the pale toner are equal to each other.

3. The image forming apparatus according to claim 2, wherein the lightness of the deep toner and the lightness of the pale toner are different from each other at least in an area where a lightness in a CIELAB color space is 60 or more.

4. The image forming apparatus according to claim 1, wherein a displacement of a hue angle of each of the deep toner and the pale toner is $3^{\Omega}$ or more in a CIELAB color space.

5. The image forming apparatus according to claim 1, wherein a displacement of a hue angle of each of the deep toner and the pale toner is $5^{\Omega}$ or more in a CIELAB color space.

6. The image forming apparatus according to claim 1, wherein a displacement of a hue angle of each of the deep toner and the pale toner is $30^{\Omega}$ or less in a CIELAB color space.

7. The image forming apparatus according to claim 1, wherein a displacement of a hue angle of each of the deep toner and the pale toner is $20^{\Omega}$ or less in the CIELAB color space.

8. The image forming apparatus according to claim 1, wherein a displacement of a hue angle of each of the deep toner and the pale toner at a lightness is $3^{\Omega}$ in a CIELAB color space, the lightness being defined by:

$$(Lm-Lp)\times 0.2+Lp$$

where Lp denotes a minimum lightness of the pale toner and Lm denotes a lightness of a sheet on which the image is formed.

9. The image forming apparatus according to claim 1, wherein an area on which an image formation is performed by the deep toner and the pale toner in combination has one fifth or more of the total gradation levels of the one color.

10. The image forming apparatus according to claim 1, wherein the color image formation is performed with 3 or more colors comprising at least cyan, magenta, and yellow; and wherein both the deep toner and the pale toner are used for each of cyan and magenta.

11. The image forming apparatus according to claim 1, wherein each of the deep toner and the pale toner comprises a binder resin and a colorant, and the colorants included in the deep toner and the pale toner are different colorants.

12. The image forming apparatus according to claim 11, wherein a content of the colorant in the pale toner is one fifth or less of a content of the colorant in the deep toner.

13. The image forming apparatus according to claim 1, wherein the deep toner and the pale toner each comprises a binder resin and a colorant, and the colorants included in the deep toner and the pale toner are same colorant; and wherein contents of the colorant in the deep toner and the pale toner are different.

14. The image forming apparatus according to claim 13, wherein the content of the colorant in the pale toner is one fifth or less of the content of the colorant in the deep toner.

15. The image forming apparatus according to claim 1, wherein a color signal of each of the deep toner and the pale toner is generated from a color signal of an input image by a direct mapping.

16. The image forming apparatus according to claim 1, wherein a color signal of an input image is converted into a color signal for an image formation; and wherein the color signal for the image formation is separated into a color signal of the deep toner and a color signal of the pale toner.

17. The image forming apparatus according to claim 1, wherein only the pale toner is used for an image formation on an area where a density of an image to be formed is 0.3 or less.

18. An image forming apparatus of an electrophotographic system, which performs a color image formation using a plurality of toners, wherein the color image formation is configured, for at least one color, to:

use a deep toner and a pale toner which have lightnesses different from each other at a point on a CIELAB color space, where a color saturation of the deep toner and a color saturation of the pale toner are equal to each other;

form an image on a high lightness area using only the pale toner; and form an image on a halftone area using the deep toner and the pale toner in combination.

19. The image forming apparatus according to claim 18, wherein the lightness of the deep toner and the lightness of the pale toner are different from each other at least in an area where a lightness in the CIELAB color space is 60 or more.

20. The image forming apparatus according to claim 18, wherein a displacement of the lightness of the deep toner and the lightness of the pale toner is $5^{\Omega}$ or more in an area where a lightness in the CIELAB color space is 60 or more.

21. The image forming apparatus according to claim 18, wherein the deep toner and the pale toner comprise a binder resin and a colorant, and the colorants included in the deep toner and the pale toner are different colorants.

22. The image forming apparatus according to claim 21, wherein a content of the colorant in the pale toner is one fifth or less of a content of the colorant in the deep toner.

23. The image forming apparatus according to claim 18, wherein the deep toner and the pale toner each comprises a binder resin and a colorant, and the colorants included in the deep toner and the pale toner are same colorant; and wherein contents of the colorant in the deep toner and the pale toner are different.

24. The image forming apparatus according to claim 23, wherein the content of the colorant in the pale toner is one fifth or less of the content of the colorant in the deep toner.

25. The image forming apparatus according to claim 18, wherein the color image formation is performed with 3 or more colors comprising at least cyan, magenta, and yellow; and wherein both the deep toner and the pale toner are used for each of cyan and magenta.

26. The image forming apparatus according to claim 18, wherein a color signal of each of the deep toner and the pale toner is generated from a color signal of an input image by a direct mapping.

27. The image forming apparatus according to claim 18, wherein a color signal of an input image is converted into a color signal for image formation; and wherein the color signal for the image formation is separated into a color signal of the deep toner and a color signal of the pale toner.

28. The image forming apparatus according to claim 18, wherein only the pale toner is used for an image formation on an area where the density of an image to be formed is 0.3 or less.

29. A toner kit comprising:

a pale cyan toner comprising at least a binder resin and a colorant; and a deep cyan toner comprising at least a binder resin and a colorant, the pale cyan toner and the deep cyan toner being separated from each other, wherein when a toner image fixed on plain paper is expressed by an L*a*b* color coordinate system where a* represents a hue in the red-green direction, b* represents a hue in the yellow-blue direction, and L* represents a lightness, in a fixed image of the pale cyan toner, the pale cyan toner has a value of a* ($a^*_{C1}$) in a range of −19 to −30 when b* is −20 and a value of a* ($a^*_{C2}$) in a range of −29 to −45 when b* is −30; and in a fixed image of the deep cyan toner, the deep cyan toner has a value of a* ($a^*_{C3}$) in a range of −7 to −18 when b* is −20 and a value of a* ($a^*_{C4}$) in a range of −10 to −28 when b* is −30.

30. The toner kit according to claim 29, wherein a difference between $a^*_{C1}$ and $a^*_{C3}$ ($a^*_{C1}-a^*_{C3}$) is in a range of −22 to −1; and wherein a difference between $a^*_{C2}$ and $a^*_{C4}$ ($a^*_{C2}-a^*_{C4}$) is in a range of −33 to −1.

31. The toner kit according to claim 29, wherein the difference between $a^*_{C1}$ and $a^*_{C3}$ ($a^*_{C1}-a^*_{C3}$) is in a range of −12 to −3; and wherein the difference between $a^*_{C2}$ and $a^*_{C4}$ ($a^*_{C2}-a^*_{C4}$) is in a range of −15 to −3.

32. The toner kit according to claim 29, wherein the $a^*_{C1}$ is in a range of −26 to −21;

the $a^*_{C2}$ is in a range of −37 to −30;

the $a^*_{C3}$ is in a range of −18 to −11;

the $a^*_{C4}$ is in a range of −27 to −20;

a difference between $a^*_{C1}$ and $a^*_{C3}$ ($a^*_{C1}-a^*_{C3}$) is in a range of −12 and −3; and a difference between $a^*_{C2}$ and $a^*_{C4}$ ($a^*_{C2}-a^*_{C4}$) is in a range of −15 and −3.

33. The toner kit according to claim 29, wherein the pale cyan toner has a value of $L_c^*$ in a range of 85 to 90 when c* represented by the equation $c^*=\sqrt{a^{*2}+b^{*2}}$ is 30; and wherein the deep cyan toner has the value of $L_c^*$ in a range of 74 to 84 when c* is 30.

34. The toner kit according to claim 29, wherein a hue angle of the pale cyan toner is in a range of 214 to 226°; and wherein a hue angle of the deep cyan toner is in a range of 228 to 260°.

35. The toner kit according to claim 29, wherein the colorant of each of the pale cyan toner and the deep cyan toner contains a pigment.

36. The toner kit according to claim 29, wherein the pale cyan toner comprises 0.4 to 1.5% by mass of the colorant with respect to a total amount of the toner; and wherein the deep cyan toner comprises 2.5 to 8.5% by mass of the colorant with respect to the total amount of the toner.

37. The toner kit according to claim 29, wherein the deep cyan toner provides an optical density in a range of 1.5 to 2.5 for a solid image having a toner amount of 1 mg/cm$^2$ on paper; and wherein the pale toner provides an optical density in a range of 0.82 to 1.35 for the solid image having the toner amount of 1 mg/cm$^2$ on paper.

38. The toner kit according to claim 29, wherein the pale cyan toner and the deep cyan toner each have a charge control agent; and wherein a ratio of a content of the charge control agent in the pale cyan toner to a content of the charge control agent in the deep cyan toner is in a range of 0.60 to 0.95.

39. The toner kit according to claim 29, wherein a weight average particle diameter of the pale cyan toner is in a range of 3 to 9 $\mu$m; and wherein a weight average particle diameter of the deep cyan toner is in the range of 3 to 9 $\mu$m.

40. The toner kit according to claim 29, wherein a ratio of a weight average particle diameter of the pale cyan toner to a weight average particle diameter of the deep cyan toner is in a range of 1.05 to 1.40.

41. The toner kit according to claim 29, wherein each of the pale cyan toner and the deep cyan toner comprises inorganic fine powders selected from a group consisting of titania, alumina, silica, and double oxides thereof; and wherein a ratio of a specific surface area of the pale cyan toner to a specific surface area of the deep cyan toner is in a range of 0.60 to 0.95.

42. The toner kit according to claim 29, further comprising:

a pale color two-component developer comprising at least the pale cyan toner and a carrier; and a deep color two-component developer comprising at least the deep cyan toner and a carrier.

43. The toner kit according to claim 29, further comprising:

a pale color one-component developer comprising the pale cyan toner; and a deep color one-component developer comprising the deep cyan toner.

44. A deep cyan toner to be used in combination with a pale cyan toner, said pale cyan toner comprising at least a resin binder and a colorant;

wherein when a toner image fixed on plain paper is expressed by an L*a*b* color coordinate system where a* represents a hue in the red-green direction, b* represents a hue in the yellow-blue direction, and L* represents a lightness, a value of a*($a^*_{C1}$) in a range of −19 to −30 when b* is −20; and a value of a* ($a^*_{C2}$) in a range of −29 to −45 when b* is −30, and said deep cyan toner comprising at least a resin binder and a colorant, wherein when the toner image fixed on plain paper is expressed by the L*a*b* color coordinate system, a value of a* ($a^*_{C3}$) when b* is −20 is in a range of −7 to −18; and a value of a* ($a^*_{C4}$) when b* is −30 is in a range of −10 to −28.

45. The deep cyan toner according to claim 44, wherein a difference between $a^*_{C1}$ and $a^*_{C3}$ ($a^*_{C1}-a^*_{C3}$) is in a range of −22 to −1; and wherein a difference between $a^*_{C1}$ and $a^*_{C3}$ ($a^*_{C2}-a^*_{C4}$) is in a range of −33 to −1.

46. The deep cyan toner according to claim 44, wherein a difference between $a^*_{C1}$ and $a^*_{C3}$ ($a^*_{C1}-a^*_{C3}$) is in a range of −12 and −3; and wherein a difference between $a^*_{C2}$ and $a^*_{C4}$ ($a^*_{C2}-a^*_{C4}$) is in a range of −15 and −3.

47. The deep cyan toner according to claim 44, wherein the $a^*_{C1}$ is in a range of −26 to −21;

the $a^*_{C2}$ is In a range of −37 to −30;

the $a^*_{C3}$ is in a range of −18 to −11;

the $a^*_{C4}$ is in a range of −27 to −20;

a difference between $a^*_{C1}$ and $a^*_{C3}$ ($a^*_{C1}-a^*_{C3}$) is in a range of −12 and −3; and a difference between $a^*_{C2}$ and $a^*_{C4}$ ($a^*_{C2}-a^*_{C4}$) is in a range of −15 and −3.

48. A pale cyan toner to be used in combination with a deep cyan toner, said deep cyan toner comprising at least a resin binder and a colorant;

wherein when a toner image fixed on plain paper is expressed by an L*a*b* color coordinate system where a* represents a hue in the red-green direction, b* represents a hue in the yellow-blue direction, and L* represents a lightness, a value of a* ($a^*_{C3}$) in a range of −7 to −18 when b* is −20; and a value of a* ($a^*_{C4}$) in a range of −10 to −28 when b* is −30, and said pale cyan toner comprising at least a resin binder an a colorant, wherein when the toner image fixed on plain paper is expressed by the L*a*b* color coordinate system, a value of a* ($a^*_{C1}$) when b* is −20 is in a range of −19 to −30; and a value of a* ($a^*_{C2}$) when b* is −30 is in a range of −29 to −45.

49. The pale cyan toner according to claim 48, wherein a difference between $a^*_{C1}$ and $a^*_{C3}$ ($a^*_{C1}-a^*_{C3}$) is in a range of −22 to −1; and wherein a difference between $a^*_{C2}$ and $a^*_{C4}$ ($a^*_{C2}-a^*_{C4}$) is in a range of −33 to −1.

50. The pale cyan toner according to claim 48, wherein a difference between $a^*_{C1}$ and $a^*_{C3}$ ($a^*_{C1}-a^*_{C3}$) is in a range of −12 and −3; and wherein a difference between $a^*_{C2}$ and $a_{C4}$ ($a^*_{C2}-a^*_{C4}$) is in a range of −15 and −3.

51. The pale cyan toner according to claim 48, wherein the $a^*_{C1}$ is in a range of −26 to −21;

the $a^*_{C2}$ is in a range of −37 to −30;

the $a^*_{C3}$ is in a range of −18 to −11;

the $a^*_{C4}$ is in a range of −27 to −20;

a difference between $a^*_{C1}$ and $a^*_{C3}$ ($a^*_{C1}-a^*_{C3}$) is in a range of −12 and −3; and a difference between $a^*_{C2}$ and $a^*_{C4}$ ($a^*_{C2}-a^*_{C4}$) is in a range of −15 and −3.

52. A method for forming an image comprising the steps of:

forming an electrostatic charge image on an electrostatic charge image bearing member being charged;

forming a toner image by developing the formed electrostatic charge image by a toner;

transferring the formed toner image on a transfer material; and fixing the transferred toner image on the transfer material to obtain a fixed image, wherein the step of forming the electrostatic charge image comprises the steps of:

forming a first electrostatic charge image to be developed by a first toner selected from a pale cyan toner and a deep cyan toner; and forming a second electrostatic charge image to be developed by a second toner selected from the pale cyan toner and the deep cyan toner, except of the first toner;

wherein the step of forming the toner image comprises the steps of:

forming a first cyan toner image by developing the first electrostatic charge image with the first toner; and forming a second cyan toner image by developing the second electrostatic charge image with the second toner;

wherein the step of transferring comprises the step of transferring the first cyan toner image and the second cyan toner image to form a cyan toner image composed of the first cyan toner image and the second cyan toner image which are being overlapped one on another on the transfer material;

wherein the pale cyan toner comprises at least a binder resin and a colorant and the deep cyan toner comprises at least a binder resin and a colorant;

when a toner image fixed on plain paper is expressed by an L*a*b* color coordinate system where a* represents a hue in the red-green direction, b* represents a hue in the yellow-blue direction, and L* represents a lightness, in a fixed image of the pale cyan toner, the pale cyan toner has a value of a*($a^*_{C1}$) in a range of −19 to −30 when b* is −20 and a value of a* ($a^*_{C2}$) in a range of −29 to −45 when b* is −30; and in a fixed image of the deep cyan toner, the deep cyan toner has a value of a* ($a^*_{C3}$) in a range of −7 to −18 when b* is −20 and a value of a* ($a^*_{C4}$) in a range of −10 to −28 when b* is −30.

53. The method for forming an image according to claim 52, wherein the step of fixing the toner image is the step of heating and pressing the transfer material which has the transferred toner image.

54. The method for forming an image according to claim 52, wherein the step of forming the electrostatic charge image comprises the steps of:

forming an electrostatic charge image for magenta to be developed by a magenta toner;

forming an electrostatic charge image for yellow to be developed by a yellow toner; and forming an electrostatic charge image for black to be developed by a black toner;

wherein the step of forming the toner image comprises the steps of:

forming a magenta toner image by developing the electrostatic charge image for magenta with the magenta toner;

forming a yellow toner image by developing the electrostatic charge image for yellow with the yellow toner; and forming a black toner image by developing the electrostatic charge image for black with the black toner; and wherein the step of transferring comprises the step of transferring the magenta toner image, the yellow toner image, and the black toner image on the transfer material to form a full-color toner image on the transfer material by overlapping the magenta toner image, the yellow toner image, and the black toner image together with the cyan toner image one on another.

55. The method for forming an image according to claim 52, wherein the step of transferring comprises the steps of:

transferring the toner image of each color on an intermediate transfer member to form a toner image on the intermediate transfer member by overlapping the toner images of the respective colors one on another; and transferring the toner image formed on the intermediate transfer member on the transfer material.

56. The method for forming an image according to claim 52, wherein a difference between $a^*_{C1}$ and $a^*_{C3}$ is in a range of −22 and −1; and wherein a difference between $a^*_{C2}$ and $a^*_{C4}$ is in a range of −33 and −1.

57. The method for forming an image according to claim 52, wherein a difference between $a_{C1}$ and $a^*_{C3}$ ($a^*_{C1}-a^*_{C3}$) is in a range of −12 and −3; and wherein a difference between $a^*_{C2}$ and $a^*_{C4}$ ($a^*_{C2}-a^*_{C4}$) is in a range of −15 and −3.

58. The method for forming an image according to claim 52, wherein the $a^*_{C1}$ is in a range of −26 to −21;

the $a^*_{C2}$ is in a range of −37 to −30;

the $a^*_{C3}$ is in a range of −18 to −11;

the $a^*_{C4}$ is in a range of −27 to −20;

a difference between $a^*_{C1}$ and $a^*_{C3}$ ($a^*_{C1}-a^*_{C3}$) is in a range of −12 and −3; and a difference between $a^*_{C2}$ and $a^*_{C4}$ ($a^*_{C2}-a^*C4$ is in a range of −15 and −3.

59. The method for forming an image according to claim 52, wherein the pale cyan toner has a value of L* in a range of 85 to 90 when c* represented by the equation $c^*=\sqrt{a^{*2}+b^{*2}}$ is 30; and wherein the deep cyan toner has the value of L* in a range of 74 to 84 when c* is 30.

60. The method for forming an image according to claim 52, wherein a hue angle of the pale cyan toner is in the range of 214 to 226°; and wherein a hue angle of the deep cyan toner is in a range of 228 to 260°.

61. The method for forming an image according to claim 52, wherein the colorant of each of the pale cyan toner and the deep cyan toner contains a pigment.

62. The method for forming an image according to claim 61, wherein the pale cyan toner comprises 0.4 to 1.5% by mass of the colorant with respect to a total amount of the toner: and wherein the deep cyan toner comprises 2.5 to 8.5% by mass of the colorant with respect to the total amount of the toner.

63. The method for forming an image according to claim 52, wherein the deep cyan toner provides an optical density in a range of 1.5 to 2.5 for a solid image having a toner amount of 1 mg/cm$^2$ on paper; and wherein the pale toner provides an optical density in a range of 0.82 to 1.35 for the solid image having the toner amount of 1 mg/cm$^2$ on paper.

64. The method for forming an image according to claim 52, wherein the pale cyan toner and the deep cyan toner each have a charge control agent; and wherein a ratio of a content of the charge control agent in the pale cyan toner to a content of the charge control agent in the deep cyan toner is in a range of 0.60 to 0.95.

65. The method for forming an image according to claim 52, wherein a weight average particle diameter of the pale cyan toner is in a range of 3 to 9 $\mu$m; and wherein a weight average particle diameter of the deep cyan toner is in the range of 3 to 9 $\mu$m.

66. The method for forming an image according to claim 52, wherein a ratio of a weight average particle diameter of the pale cyan toner to a weight average particle diameter of the deep cyan toner is in a range of 1.05 to 1.40.

67. The method for forming an image according to claim 52, wherein each of the pale cyan toner and the deep cyan toner comprises inorganic fine powders selected from a group consisting of titania, alumina, silica, and double oxides thereof; and when each specific surface area of the inorganic fine powders is measured by a BET method, a ratio of the specific surface area of the inorganic fine powders comprised in the pale cyan toner to the specific surface area of the inorganic fine powders comprised in the deep cyan toner is in a range of 0.60 to 0.95.

68. The method for forming an image according to claim 52, further comprising:

a pale color two-component developer comprising at least the pale cyan toner and a carrier; and a deep color two-component developer comprising at least the deep cyan toner and a carrier.

69. The method for forming an image according to claim 52, further comprising:

using a pale color one-component developer comprising the pale cyan toner; and using a deep color one-component developer comprising the deep cyan toner.

70. A toner kit comprising:

a pale magenta toner comprising at least a binder resin and a colorant; and a deep magenta toner comprising at least a binder resin and a colorant, the pale magenta toner and the deep magenta toner being separated from each other, wherein when a toner image fixed on plain paper is expressed by an L*a*b* color coordinate system where a* represents a hue in the red-green direction, b* represents a hue in the yellow-blue direction, and L* represents a lightness, in a fixed image of the pale magenta toner, the pale magenta toner has a value of b* ($b^*_{M1}$) in a range of −18 to 0 when a* is 20 and value of b* ($b^*_{M2}$) in a range of −26 to 0 when a* is 30; and in a fixed image of the deep magenta toner, the deep magenta toner has a value of b* ($b^*_{M3}$) in a range of −16 to 2 when a* is 20 a value of b* ($b^*_{M4}$) in a range of −24 to 3 when a* is 30, a difference between $b^*_{M1}$ and $b^*_{M3}$ ($b^*_{M1}-b^*_{M3}$) in a range of −8 to −1, and a difference between $b^*_{M2}$ and $b^*_{M4}$ ($b^*_{M2}-b^*_{M4}$) in a range of −12 to −1.

71. The toner kit according to claim 70, wherein a difference between $b^*_{M1}$ and $b^*_{M3}$ ($b^*_{M1}-b^*_{M3}$) is in a range of −7 and −1; and wherein a difference between $b^*_{M2}$ and $b^*_{M4}$ ($b^*_{M2}-b^*_{M4}$) is in a range of −11 and −2.

72. The toner kit according to claim 70, wherein a difference between $b^*_{M1}$ and $b^*_{M3}$ ($b^*_{M1}-b^*_{M3}$) is in a range of −7 and −2; and wherein a difference between $b^*_{M2}$ and $b^*_{M4}$ ($b^*_{M2}-b^*_{M4}$) is in a range of −10 and −2.

73. The toner kit according to claim 70, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

74. The toner kit according to claim 70, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

75. The toner kit according to claim 72, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

76. The toner kit according to claim 72, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

77. The toner kit according to claim 70, wherein the pale magenta toner and the deep magenta toner have triboelectric charge characteristics with the same polarity; and wherein a difference between the two-component tribo values of the respective magenta toners is an absolute value of 5 mC/kg or less.

78. The toner kit according to claim 70, wherein the pale magenta toner has a value of L* which is expressed by $L^*_{M1}$ when c* represented by the equation $c=\sqrt{a^{*2}+b^{*2}}$ is 30, and the $L^*_{M1}$ is in a range of 78 to 90;

wherein the deep magnetic toner has a value of L* which is expressed by $L^*_{M2}$ when c* is 30, and the $L^*_{M2}$ is in a range of 74 to 87; and wherein a difference between $L^*_{M1}$ and $L^*_{M2}$ is in a range of 0.4 to 12.

79. The toner kit according to claim 70, wherein the pale magenta toner has a value of $H^*_{M1}$ in a range of 325 to 350°, where $H^*_{M1}$ represents a hue angle with respect to a fixed solid image where the amount of toner on paper is 0.5 mg/cm$^2$;

wherein the deep magenta toner has the value of $H^*_{M2}$ in a range of 340 to 10$^{\Omega}$, where $H^*_{M2}$ represents a hue angle with respect to a fixed solid image where the amount of toner on paper is 0.5 mg/cm$^2$; and wherein an angle formed between $H^*_{M1}$ and $H^*_{M2}$ ($H^*_{M2}-H^*_{M1}$) is in a range of 2 to 30$^{\Omega}$.

80. The toner kit according to claim 70, wherein the colorant of each of the pale magenta toner and the deep magenta toner contains a pigment.

81. The toner kit according to claim 70, wherein the pale magenta toner comprises 0.4 to 1.5% by mass of the colorant with respect to a total amount of the toner; and wherein the deep magenta toner comprises 2.5 to 8.5% by mass of the colorant with respect to the total amount of the toner.

82. The toner kit according to claim 70, wherein the deep magenta toner provides an optical density in a range of 1.5 to 2.5 for a solid image having a toner amount of 1 mg/cm$^2$ on paper; and wherein the pale magenta toner provides an optical density in a range of 0.82 to 1.35 for the solid image having the toner amount of 1 mg/cm$^2$ on paper.

83. The toner kit according to claim 70, wherein the pale magenta toner and the deep magenta toner each have a charge control agent; and wherein a ratio of a content of the charge control agent in the pale magenta toner to a content of the charge control agent in the deep magenta toner is in a range of 0.60 to 0.95.

84. The toner kit according to claim 70, wherein a weight average particle diameter of the pale magenta toner is in a range of 3 to 9 $\mu$m; and wherein a weight average particle diameter of the deep magenta toner is in the range of 3 to 9 $\mu$m.

85. The toner kit according to claim 70, wherein a ratio of a weight average particle diameter of the pale magenta toner to a weight average particle diameter of the deep magenta toner is in a range of 1.05 to 1.40.

86. The toner kit according to claim 70, wherein each of the pale magenta toner and the deep magenta toner comprises inorganic fine powders selected from a group consisting of titania, alumina, silica, and double oxides thereof; and wherein a ratio of a specific surface area of the pale magenta toner to a specific surface area of the deep magenta toner is in a range of 0.60 to 0.95.

87. The toner kit according to claim 70, further comprising:

a pale color one-component developer comprising the pale magenta toner; and a deep color one-component developer comprising the deep magenta toner.

88. A deep magenta toner to be used in combination with a pale magenta toner, said pale magenta toner comprising at least a resin binder and a colorant;

wherein when a toner image fixed on plain paper is expressed by an L*a*b* color coordinate system where a* represents a hue in the red-green direction, b* represents a hue in the yellow-blue direction, and L* represents a lightness, a value of b* ($b^*_{M1}$) in a range of −18 to 0 when a* is 20 in a fixed image; and a value of b* ($b^*_{M2}$) in a range of −26 to 0 when a* is 30, and said deep magenta toner comprising at least a resin binder and a colorant, wherein when the toner image fixed on plain paper is expressed by the L*a*b* color coordinate system, a value of b* ($b^*_{M3}$) when a* is 20 is in a range of −16 to 2;

a value of b* ($b^*_{M4}$) when a* is 30 is in a range of −24 to 3;

a difference between $b^*_{M1}$ and $b^*_{M3}$ ($b^*_{M1}-b^*_{M3}$) is in a range of −8 to −1; and a difference between $b^*_{M2}$ and $b^*_{M4}$ ($b^*_{M2}-b^*_{M4}$) is in a range of −12 to −1.

89. The deep magenta toner according to claim 88, wherein a difference between $b^*_{M1}$ and $b^*_{M3}$ ($b^*_{M1}-b^*_{M3}$) is in a range of −7 and −1; and wherein a difference between $b^*_{M2}$ and $b^*_{M4}$ ($b^*_{M2}-b^*_{M4}$) is in a range of −11 and −2.

90. The deep magenta toner according to claim 88, wherein a difference between $b^*_{M1}$ and $b^*_{M3}$ ($b^*_{M1}-b^*_{M3}$) is in a range of −7 and −2; and wherein a difference between $b^*_{M2}$ and $b^*_{M4}$ ($b^*_{M2}-b^*_{M4}$) is in a range of −10 and −2.

91. The deep magenta toner according to claim 88, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

92. The deep magenta toner according to claim 88, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

93. The deep magenta toner according to claim 90, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

94. The deep magenta toner according to claim 90, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

95. A pale magenta toner to be used in combination with a deep magenta toner, said deep magenta toner comprising at least a resin binder and a colorant;

wherein when a toner image fixed on plain paper is expressed by an L*a*b* color coordinate system where a* represents a hue in the red-green direction, b* represents a hue in the yellow-blue direction, and L* represents a lightness, a value of b* ($b^*_{M3}$) in a range of −16 to 2 when a* is 20 in a fixed image; and a value of b* ($b^*_{M4}$) in a range of −24 to 3 when a* is 30, and said pale magenta toner comprising at least a resin binder and a colorant, wherein a value of b* ($b^*_{M1}$) when a* is 20 in a fixed image is in a range of −18 to 0;

a value of b* ($b^*_{M2}$) when a* is 30 is in a range of −26 to 0;

a difference between $b^*_{M1}$ and $b^*_{M3}$ ($b^*_{M1}-b^*_{M3}$) is in a range of −8 to −1; and a difference between $b^*_{M2}$ and $b^*_{M4}$ ($b^*_{M2}-b^*_{M4}$) is in a range of −12 to −1.

96. The pale magenta toner according to claim 95, wherein a difference between $a^*_{M1}$ and $a^*_{M3}$ ($b^*_{M1}-b^*_{M3}$) is in a range of −7 and −1; and wherein a difference between and $a^*_{M2}$ and $a^*_{M4}$ ($b^*_{M2}-b^*_{M4}$) is in a range of −11 and −2.

97. The pale magenta toner according to claim 95, wherein a difference between $b^*_{M1}$ and $b^*_{M3}$ ($b^*_{M1}-b^*_{M3}$) is in a range of −7 and −2; and wherein a difference between $b^*_{M2}$ and $b^*_{M4}$ ($b^*_{M2}-b^*_{M4}$) is in a range of −10 and −2.

98. The pale magenta toner according to claim 95, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

99. The pale magenta toner according to claim 95, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

100. The pale magenta toner according to claim 97, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

101. The pale magenta toner according to claim 97, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

102. A method for forming an image comprising the steps of:

forming an electrostatic charge image on an electrostatic charge image bearing member being charged;

forming a toner image by developing the formed electrostatic charge image by a toner;

transferring the formed toner image on a transfer material; and fixing the transferred toner image on the transfer material under heat and pressure to obtain a fixed image, wherein the step of forming the electrostatic charge image comprises the steps of:

forming a first electrostatic charge image to be developed by a first toner selected from a pale magenta toner and a deep magenta toner; and forming a second electrostatic charge image to be developed by a second toner selected from the pale magenta toner and the deep magenta toner, except of the first toner;

wherein the step of forming the toner image comprises the steps of:

forming a first magenta toner image by developing the first electrostatic charge image with the first toner; and forming a second magenta toner image by developing the second electrostatic charge image with the second toner;

wherein the step of transferring comprises the step of transferring the first magenta toner image and the second magenta toner image to form a magenta toner image composed of the first magenta toner image and the second magenta toner image which are being overlapped one on another on the transfer material;

wherein the pale magenta toner comprises at least a binder resin and a colorant and a deep magenta toner comprises at least a binder resin and a colorant;

when a toner image fixed on plain paper is expressed by an L*a*b* color coordinate system where a* represents a hue in the red-green direction, b* represents a hue in the yellow-blue direction, and L* represents a lightness, in a fixed image of the pale magenta toner, the pale magenta toner has a value of b* ($b^*_{M1}$) in a range of −18 to 0 when a* is 20 and a value of b* ($b^*_{M2}$) in a range of −26 to 0 when a is 30; and in a fixed image of the deep magenta toner, the deep magenta toner has a value of b* ($b^*_{M3}$) in a range of −16 to 2 when a* is 20 and a value of b* ($b^*_{M4}$) in a range of −24 to 3 when a* is 30, a difference between $b^*_{M1}$ and $b^*_{M3}$ ($b^*_{M2}-b^*_{M3}$) in a range of −8 to −1, and a difference between $b^*_{M2}$ and $b^*_{M4}$−($b^*_{M2}-b^*_{M4}$) in a range of −12 to −1.

103. The method for forming an image according to claim 102, wherein a difference between $b^*_{M1}$ and $b^*_{M3}$ ($b^*_{M1}-b^*_{M3}$) is in a range of −7 and −1; and wherein a difference between $b^*_{M2}$ and $b^*_{M4}$ ($b^*_{M2}-b^*_{M4}$) is in a range of −11 and −2.

104. The method for forming an image according to claim 102, wherein a difference between $b^*_{M1}$ and $b^*_{M3}$ ($b^*_{M1}-b^*_{M3}$) is in a range of −7 and −2; and wherein a difference between $b^*_{M2}$ and $b^*_{M4}$ ($b^*_{M2}-b^*_{M4}$) is in a range of −10 and −2.

105. The method for forming an image according to claim 102, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

106. The method for forming an image according to claim 102, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

107. The method for forming an image according to claim 104, wherein the $b^*_{M1}$ is in a range of −13 to −4;

the $b^*_{M2}$ is in a range of −15 to −5;

the $b^*_{M3}$ is in a range of −12 to 0; and the $b^*_{M4}$ is in a range of −15 to 0.

108. The method for forming an image according to claim 104, wherein the $b^*_{M1}$ is in a range of −13 to −4;

the $b^*_{M2}$ is in a range of −15 to −5;

the $b^*_{M3}$ is in a range of −11 to −2; and the $b^*_{M4}$ is in a range of −14 to −3.

109. The method for forming an image according to claim 102, wherein the pale magenta toner and the deep magenta toner have tribo-electric charge characteristics with the same polarity; and wherein a difference between the two-component tribo values of the respective magenta toners is an absolute value of 5 mC/kg or less.

110. The method for forming an image according to claim 102, wherein the step of forming the electrostatic charge image comprises the steps of:

forming an electrostatic charge image for cyan to be developed by a cyan toner;

forming an electrostatic charge image for yellow to be developed by a yellow toner; and forming an electrostatic charge image for black to be developed by a black toner;

wherein the step of forming the toner image comprises the steps of:

forming a cyan toner image by developing the electrostatic charge image for cyan with the cyan toner;

forming a yellow toner image by developing the electrostatic charge image for yellow with the yellow toner;

forming a black toner image by developing the electrostatic charge image for black with the black toner; and wherein the step of transferring comprises the step of transferring the cyan toner image, the yellow toner image, and the black toner image on the transfer material to form a full-color toner image on the transfer material by overlapping the cyan toner image, the yellow toner image, and the black toner image together with the magenta toner image one on another.

111. The method for forming an image according to claim 102, wherein the step of transferring comprises the steps of:

transferring the toner image of each color on an intermediate transfer member to form a toner image on the intermediate transfer member by overlapping the toner images of the respective colors one on another; and transferring the toner image formed on the intermediate transfer member on the transfer material.

112. The method for forming an image according to claim 102, wherein the pale magenta toner has a value of L* which is expressed by $L^*_{M1}$ when c* represented by the equation $c=\sqrt{a^{*2}+b^{*2}}$ is 30, and the $L^*_{M1}$ is in a range of 78 to 90;

wherein the deep magenta toner has a value of L* which is expressed by $L^*_{M2}$ when c* is 30, and the $L^*_{M2}$ is in a range of 74 to 87; and wherein a difference between $L^*_{M1}$ and $L^*_{M2}$ is in a range of 0.4 to 12.

113. The method for forming an image according to claim 102, wherein the pale magenta toner has a value of $H^*_{M1}$ in a range of 325 to $350^{\Omega}$, where $H^*_{M1}$ represents a hue angle with respect to a fixed solid image where the amount of toner on paper is 0.5 mg/cm$^2$;

wherein the deep magenta toner has the value of $H^*_{M2}$ in a range of 340 to $10^{\Omega}$, where $H^*_{M2}$ represents a hue angle with respect to a fixed solid image where the amount of toner on paper is 0.5 mg/cm$^2$; and wherein an angle formed between $H^*_{M1}$, and $H^*_{M2}$ ($H^*_{M2}-H^*_{M1}$) is In a range of 2 to $30^{\Omega}$.

114. The method for forming an image according to claim 102, wherein the colorant of each of the pale magenta toner and the deep magenta toner contains a pigment.

115. The method for forming an image according to claim 102, wherein the pale magenta toner comprises 0.4 to 1.5% by mass of the colorant with respect to a total amount of the toner; and wherein the deep magenta toner comprises 2.5 to 8.5% by mass of the colorant with respect to the total amount of the toner.

116. The method for forming an image according to claim 102, wherein the deep magenta toner provides an optical density in a range of 1.5 to 2.5 for a solid image having a toner amount of 1 mg/cm$^2$ on paper; and wherein the pale magenta toner provides an optical density in a range of 0.82 to 1.35 for the solid image having the toner amount of 1mg/cm$^2$ on paper.

117. The method for forming an image according to claim 102, wherein the pale magenta toner and the deep magenta toner each have a charge control agent; and wherein a ratio of a content of the charge control agent in the pale magenta toner to a content of the charge control agent in the deep magenta toner is in a range of 0.60 to 0.95.

118. The method for forming an image according to claim 102, wherein a weight average particle diameter of the pale magenta toner is in a range of 3 to 9 μm; and wherein a weight average particle diameter of the deep magenta toner is in the range of 3 to 9 μm.

119. The method for forming an image according to claim 102, wherein a ratio of a weight average particle diameter of the pale magenta toner to a weight average particle diameter of the deep magenta toner is in a range of 1.05 to 1.40.

120. The method for forming an image according to claim 102, wherein each of the pale magenta toner and the deep magenta toner comprises inorganic fine powders selected from a group consisting of titania, alumina, silica, and double oxides thereof; and wherein when each specific surface area of the inorganic fine powders is measured by a BET method, a ratio of the specific surface area of the inorganic fine powders comprised in the pale magenta toner to the specific surface area of the inorganic fine powders comprised in the deep magenta toner is in a range of 0.60 to 0.95.

121. The method for forming an image according to claim 102, further comprising:

using a pale color one-component developer comprising the pale magenta toner; and using a deep color one-component developer comprising the deep magenta toner.

122. A toner kit comprising:

a pale cyan toner comprising at least a binder resin and a colorant; and a deep cyan toner comprising at least a binder resin and a colorant, a pale magenta toner comprising at least a binder resin and a colorant; and a deep magenta toner comprising at least a binder resin and a colorant, the pale cyan toner, the deep cyan toner, the pale magenta toner, and the deep magenta toner being separated from each other, wherein when a toner image fixed on plain paper is expressed by an L*a*b* color coordinate system where a* represents a hue in the red-green direction, b* represents a hue in the yellow-blue direction, and L* represents a lightness, in a fixed image of the pale cyan toner, the pale cyan toner has a value of a* ($a^*_{C1}$) in a range of −19 to −30 when b* is −20 and a value of a* ($a^*_{C2}$) in a range of −29 to −45 when b* is −30;

in a fixed image of the deep cyan toner, the deep cyan toner has a value of a* ($a^*_{C3}$) in a range of −7 to −18 when b* is −20 and a value of a* ($a^*_{C4}$) in a range of −10 to −28 when b* is −30;

in a fixed image of the pale magenta toner, the pale magenta toner has a value of b* ($b^*_{M1}$) in a range of −18 to 0 when a* is 20 and value of b* ($b^*_{M2}$) in a range of −26 to 0 when a* is 30; and in a fixed image of the deep magenta toner, the deep magenta toner has a value of b* ($b^*_{M3}$) in a range of −16 to 2 when a* is 20 a value of b* ($b^*_{M4}$) in a range of −24 to 3 when a* is 30, a difference between $b^*_{M1}$ and $b^*_{M3}$ ($b^*_{M1}-b^*_{M3}$) in a range of −8 to −1, and a difference between $b^*_{M2}$ and $b^*_{M4}$ ($b^*_{M2}-b^*_{M4}$) in a range of −12 to −1.

123. A method for forming an image comprising the steps of:

forming an electrostatic charge image on an electrostatic charge image bearing member being charged;

forming a toner image by developing the formed electrostatic charge image by a toner;

transferring the formed toner image on a transfer material; and fixing the transferred toner image on the transfer material to obtain a fixed image, wherein the step of forming the electrostatic charge image comprises the steps of:

forming a first electrostatic charge image to be developed by a first toner selected from a group of toners consisting of a pale cyan toner and a deep cyan toner and a pale magenta toner and a deep magenta toner;

forming a second electrostatic charge image to be developed by a second toner selected from the group of toners, except of the first toner;

forming a third electrostatic charge image to be developed by a third toner selected from the group of toners, except of the first toner and the second toner; and forming a fourth electrostatic charge image to be developed by a fourth toner selected from the group of toners, except of the first toner, the second toner, and the third toner;

wherein the step of forming the toner image comprises the steps of:

forming a first toner image by developing the first electrostatic charge image with the first toner;

forming a second toner image by developing the second electrostatic charge image with the second toner;

forming a third toner image by developing the third electrostatic charge image with the third toner; and forming a fourth toner image by developing the fourth electrostatic charge image with the fourth toner;

wherein the step of transferring comprises the step of transferring the first toner image, the second toner image, the third toner image, and the fourth toner image to form a color toner image composed of the first toner image, the second toner image, the third toner image, and the fourth toner image which are being overlapped one on another on the transfer material;

wherein each of the pale cyan toner, the deep cyan toner, the pale magenta toner, and the deep magenta toner comprises at least a binder resin and a colorant;

when a toner image fixed on plain paper is expressed by an L*a*b* color coordinate system where a* represents a hue in the red-green direction, b* represents a hue in the yellow-blue direction, and L* represents a lightness, in a fixed image of the pale cyan toner, the pale cyan toner has a value of a* ($a^*_{C1}$) in a range of −19 to −30 when b* is −20 and a value of a* ($a^*_{C2}$) in a range of −29 to −45 when b* is −30;

in a fixed image of the deep cyan toner, the deep cyan toner has a value of a* ($a^*_{C3}$) in a range of −7 to −18 when b* is −20 and a value of a* ($*_{C4}$) in a range of −10 to −28 when b* is −30;

in a fixed image of the pale magenta toner, the pale magenta toner has a value of b* ($b^*_{M1}$) in a range of −18 to 0 when a* is 20 and value of b* ($b^*_{M2}$) in a range of −26 to 0 when a is 30; and in a fixed image of the deep magenta toner, the deep magenta toner has a value of b* ($b^*_{M3}$) in a range of −16 to 2 when a* is 20 a value of b* ($b^*_{M4}$) in a range of −24 to 3 when a* is 30, a difference between $b^*_{M1}$ and $b^*_{M3}$ ($b^*_{M1}-b^*_{M3}$) in a range of −8 to −1, and a difference between $b^*_{M2}$ and $b^*_{M4}$ ($b^*_{M2}-b^*_{M4}$) in a range of −12 to −1.

* * * * *

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 1

Line 27, “applied” should read --applied.--.

COLUMN 2

Line 13, “portion” should read --portion which--;
Line 22, “images” should read --image,--;
Line 27, “teach” should read --teaching--;
Line 29, “teach” should read --teaching--; and
Line 52, “even” should read --evenly--.

COLUMN 4

Line 5, after “-30,” close up right margin;
Line 6, before “the pale” close up left margin--; and “an” should read --and--.

COLUMN 5

Line 27, “an” should read --and--; and
Line 43, “of;”should read --of:--.

COLUMN 8

Line 23, “drum 11 in” should read --drum 11. In--.

COLUMN 10

Line 55, “overlapped” should read --overlapped on--; and
Line 65, “toner” should read --toner with--.

COLUMN 11

Line 15, “overlapped” should read --overlapped on--.

COLUMN 14

Line 46, “in” should read --instead--; and
Line 47, “stead” should be deleted--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 15

Line 10, "data." should read --data,--;
Line 26, "It" should read --it--; and
Line 43, "an on linear" should read --a nonlinear--.

COLUMN 17

Line 37, " $C^* = \sqrt{a^{*2} + {}^{b*2}}$ " should read -- $C^* = \sqrt{a^{*2} + b^{*2}}$ --.

COLUMN 19

Line 1, "to 2." should read --to -2.--; and
Line 61, "on was" should read --which was--.

COLUMN 20

Line 17, "were" should read --was--; and
Line 38, "$(L^*_1-L^*_{M2})$"should read --$(L^*_{M1}-L^*_{M2})$--.

COLUMN 24

Line 33, "used. In" should read --used in--.

COLUMN 25

Line 3, "grass" should read --glass--;
Line 17, "deravatives" should read --derivatives--;
Line 28, "denatrured" should read --denatured--;
Line 37, "maybe" should read --may be--;
Line 57, "bounds." should read --bonds.--; and
Line 60, "bounds" should read --bonds--.

COLUMN 28

Line 56, "3]" should read --3].--.

COLUMN 29

Line 11, "term" should read --terms--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 30

Line 27, “pale tones” should read --magenta toners--; and
Line 66, “octahedron” should read --octahedron,--.

COLUMN 32

Line 4, “descried” should read --described--;
Line 17, “acrylatemonomers” should read --acrylate monomers--;
Line 22, “en” should read --diene--;
Line 41, “be” should read --occur.--; and
Line 42, “occurred.” should be deleted--.

COLUMN 33

Line 12, “shall” should read --shell--;
Line 15, “becomes” should read --becomes a--;
Line 17, “intention” should read --invention--;
Line 34, “ing;” should read --ing:--;
Line 47, “including;” should read --including:--; and
Line 57, “comparative” should read --comparatively--.

COLUMN 34

Line 42, “such an” should read --such a--.

COLUMN 35

Line 9, “sued” should read --used--;
Line 29, “gradation etc” should read --gradation, etc.--; and
Line 61, “forma” should read --form a--.

COLUMN 36

Line 12, “overlapped” should read --overlapped on--; and
Line 44, “chare” should read --charge--.

COLUMN 37

Line 46, “selenium tellurium” should read --selenium-tellurium--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 40

Line 13, "$a_{23}$" (first occurrence) should read --$a_{22}$--
Line 21, "coverts" should read --converts--;
Line 23, "respectively" should read --respectively.--; and
Line 58, "RM etc." should read --RAM, etc.--.

COLUMN 41

Line 21, "a" should read --an--.

COLUMN 42

Line 36, "37, consequently," should read --37. Consequently,--.

COLUMN 44

Line 56, "(clockwise)" should read --(clockwise).--.

COLUMN 45

Line 13, "diselectrified" should read --discharged--; and
Line 40, "an" should read --a--.

COLUMN 48

Line 53, "from-each" should read --from each--.

COLUMN 49

Line 16, "30" should read --3°--.

COLUMN 50

Line 58, "preliminary" should read --preliminarily--.

COLUMN 53

Line 55, "one another" should read --over one another--; and
Line 56, "FIGS." should read --FIG.--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 54

Table 3-2, "5.6" (2nd occurrence) should read --5.5--; and
Line 3-2, "12100" should read --12700--.

COLUMN 55

Line 64, "observed" should read --observed.--.

COLUMN 56

Table 5-1, "64" should read --54--; and
Line 53, "devices"should read --device,--.

COLUMN 58

Table 7-2, "6.4" should read --5.4--.

COLUMN 60

Line 21, "was" should read --were--.

COLUMN 61

Line 3, "an" should read --a--; and
Line 4, "10 mol/l" should read --1.0 mol/l--.

COLUMN 62

Table 8-1, "Solvet Red 24" should read --Solvent Red 24--.

COLUMN 63

Table 8-2, "3.6" should read --3.5--.

COLUMN 64

Line 55, "one another" should read --over one another--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 71

Line 5, “area in” should read --area. In--; and
Line 46, “was” should read --were--.

COLUMN 74

Line 4, “image” should read --image on--; and
Line 61, “likewise” should read --likewise in--.

COLUMN 75

Line 23, “likewise” should read --likewise in--;
Line 39, “likewise” should read --likewise--;
Line 49, “were-obtained” should read --were obtained--; and
Line 55, “likewise” should read --likewise in--.

COLUMN 76

Line 20, “preliminary” should read --preliminarily--; and
Line 47, “likewise” should read --likewise in--.

COLUMN 77

Line 13-1, “Blue 16:3” should read --Blue 15:3--.

COLUMN 78

Table 13-1, “0.6” should read --0.5--;
Table 13-1, “3.6” should read --3.5--; and
Table 31-1, “2.6” (2 occurrences) should read --2.5--.

COLUMN 80

Table 14-2, “1.61” should read --1.51--.

COLUMN 81

Line 66, “$3^{\Omega}$” should read --3°--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 82

Line 47, "$5^{\Omega}$" should read --5°--;
Line 51, "$30^{\Omega}$" should read --30°--;
Line 55, "$20^{\Omega}$" should read --20°--; and
Line 59, "$3^{\Omega}$" should read --3°--.

COLUMN 83

Line 51, "halftone" should read --half tone--; and
Line 59, "$5^{\Omega}$" should read --5°--.

COLUMN 86

Line 23, "$a^*_{C1}$ and $a^*_{C3}$" should read --$a^*_{C2}$ and $a^*_{C4}$--;
Line 33, "In" should read --in--; and
Line 54, "an" should read --and--.

COLUMN 87

Line 4, "$a_{C4}$" should read --$a^*_{C4}$--.

COLUMN 88

Line 48, "$a_{C1}$ " should read --$a^*_{C1}$ --; and
Line 60, "($a^*_{C2}$-a*C4" should read --($a^*_{C2}$-$a^*_{C4}$)--.

COLUMN 89

Line 3, "$226^{\Omega}$;" should read --226°;--;
Line 5, "$260^{\Omega}$" should read --260°--; and
Line 12, "toner: and" should read --toner; and--.

COLUMN 90

Line 13, "20 a" should read --20 and 1--; and
Line 67, "$350^{\Omega}$," should read --350°--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 91

Line 5, "$10^{\Omega}$" should read --10°--; and
Line 9, "$30^{\Omega}$" should read --30°--.

COLUMN 93

Line 6, "$a^*_{M1}$ and $a^*_{M4}$" should read --$b^*_{M2}$ and $b^*_{M4}$--; and
Line 8, "$a^*_{M2}$ and $a^*_{M4}$" should read --$b^*_{M2}$ and $b^*_{M4}$--.

COLUMN 94

Line 16, "a" should read --a*--;
Line 21, "$(b^*_{M2}-b^*_{M3})$" should read --$(b^*_{M1}-b^*_{M3})$--; and
Line 49, "$-(b^*_{M2}-b^*_{M4})$" should read --$(b^*_{M2}-b^*_{M4})$--.

COLUMN 95

Line 41, "$350^{\Omega}$" should read --350°--;
Line 45, "$10^{\Omega}$" should read --10°--;
Line 49, "H*M1," should read --H*M1--;
Line 50, "In" should read --in--; and "$30^{\Omega}$" should read --30°--.

COLUMN 97

Line 1, "20 a" should read --20 and a--.

UNITED STATES PATENT AND TRADEMARK OFFICE

CERTIFICATE OF CORRECTION

PATENT NO. : 6,996,358 B2
APPLICATION NO. : 10/441165
DATED : February 7, 2006
INVENTOR(S) : Yasukazu Ayaki et al.

It is certified that error appears in the above-identified patent and that said Letters Patent is hereby corrected as shown below:

COLUMN 98

Line 31, “a” should read --a*--;
Line 35, “20a” should read --20 and a--.

Signed and Sealed this

Seventh Day of November, 2006

JON W. DUDAS
*Director of the United States Patent and Trademark Office*